US007549296B2

(12) United States Patent
Gschneidner, Jr. et al.

(10) Patent No.: US 7,549,296 B2
(45) Date of Patent: Jun. 23, 2009

(54) LOW TEMPERATURE CRYOCOOLER REGENERATOR OF DUCTILE INTERMETALLIC COMPOUNDS

(75) Inventors: Karl A. Gschneidner, Jr., Ames, IA (US); Alexandra O. Tsokol, Ames, IA (US); Vitalij K. Pecharsky, Ames, IA (US)

(73) Assignee: Atlas Scientific, San Jose, CA (US)

( * ) Notice: Subject to any disclaimer, the term of this patent is extended or adjusted under 35 U.S.C. 154(b) by 280 days.

(21) Appl. No.: 11/061,141

(22) Filed: Feb. 18, 2005

(65) Prior Publication Data

US 2005/0217280 A1 Oct. 6, 2005

Related U.S. Application Data

(60) Provisional application No. 60/546,740, filed on Feb. 23, 2004.

(51) Int. Cl.
*F25B 9/00* (2006.01)
*F28D 17/02* (2006.01)

(52) U.S. Cl. ..... 62/6; 165/4

(58) Field of Classification Search ..... 62/6; 165/4

See application file for complete search history.

(56) References Cited

U.S. PATENT DOCUMENTS 5,124,215 A * 6/1992 Hashimoto ..... 428/611
5,186,765 A 2/1993 Arai et al. ..... 148/301
5,269,854 A 12/1993 Takahashi et al. ..... 148/301
5,332,029 A * 7/1994 Tokai et al. ..... 165/4
5,537,826 A 7/1996 Gschneidner et al. ..... 62/6
5,593,517 A 1/1997 Saito et al. ..... 148/301
5,806,979 A 9/1998 Gschneidner, Jr. et al. .... 374/34
5,974,807 A * 11/1999 Gao et al. ..... 62/6
6,003,320 A 12/1999 Okamura et al. ..... 62/6
6,022,486 A 2/2000 Tokai et al. ..... 252/67
6,318,090 B1 * 11/2001 Gschneidner et al. ..... 62/6
2002/0139510 A1 * 10/2002 Ishizaki ..... 165/10
2005/0274439 A1 12/2005 Gschneidner ..... 420/416

OTHER PUBLICATIONS

U.S. Appl. No. 60/425,964, filed Nov. 2002, Gschneidner et al.
Ackerman et al., Cryogenic Regenerative Heat Exchangers, Plenum Press, New York, 1997.
Walker et al., Cryocoolers Part 1: Fundamentals, Plenum Press, New York, 1983.
Radebaugh, Cryocooler Applications, Cold Facts, vol. 16, No. 1, Winter 2000, pp. 1, 6, 7, 8, 16, 21, and 24-25.
ter Brake et al., Low-power Cryocooler Survey, Cryogenics, vol. 42, 2002, pp. 705-718.
Buschow et al., Extremely Large Heat Capacities between 4 and 10 K, Cryogenics, vol. 15, 1975, pp. 261-264.
Sahashi et al., New Magnetic Material R3T System with Extremely Large Heat Capacities Used as Heat Regenerators, Adv. Cryogenic Eng., vol. 35, 1990, pp. 1175-1182.
Kuriyama et al., High Efficient Two-stage GM Refrigerant with Magnetic Material in Liquid Helium Temperature Region, Adv. Cryogenic Eng., vol. 35, 1990, pp. 1261-1269.
Satoh et al., A Gifford-McMahon Cycle Cryocooler below 2 K, Cryocoolers 11, Kluwer Academic/Plenum Publishers, New York, 2001, pp. 381-386.
Numazawa et al., New regenerator Material for Sub-4K Cryocoolers, Cryocoolers 11, Kluwer Academic/Plenum Publishers, New York 2001, pp. 465-473.
Morin et al, Competition Between Multi-q Antiferromagnetic Structures in Cubic Rare Earth-Copper Compounds, J. Magn. Magn. Mater., vol. 21, 1980, pp. 243-256.

(Continued)

*Primary Examiner*—William C Doerrler

(57) ABSTRACT

A multi-stage cryocooler having a relatively low temperature stage to cool to less than about 15K and having a regenerator including a ductile intermetallic compound including one or more rare earth elements and one or more non-rare earth metals.

18 Claims, 45 Drawing Sheets

OTHER PUBLICATIONS

Hill, The Specific Heats of ErAg and TbAg Between 0.5 and 21 K, J. Phys. F: Met. Phys., vol. 17, 1987, pp. 243-255.
Biwa et al., Evaluation of Low-Temperature Specific Heats and Thermal Conductivities of Er-Ag Alloys as Regenerator Materials, Jpn. J. Appl. Phys, vol. 35, 1996, pp. 2244-2248.
Yagi et al., Studies of Low Temperature Specific Heats and Thermal Conductivities of CsC1-type $(Pr_{1-X}Nd_x)$ Ag ($0 \leqq x \leqq 1$) Intermetallic Compounds: Application to Regenerator Materials, Jpn. J. Appl. Phys., vol. 36, 1997, pp. 5638-5643.
Rawat et al., The Similar Dependence of the Magnetocaloric Effect and Magneto-resistance in TmCu and TmAg Compounds and Its Implications, J. Phys: Condens. Matter, vol. 13, 2001, pp. L379-L387.
Gschneidner et al., Low Temperature Cryocooler Regenerator Materials, Cryocoolers 12, Kluwer Academic/Plenum Publishers, New York, 2003, pp. 457-465.
Gschneidner et al., Effect of Interstitial Impurities on Magnetic Transitions of Er-rich $Pr_xEr_{1-x}$ Alloys, J. Solid State Chem., vol. 171, 2003, pp. 324-328.
Gschneidner, Jr. et al., Development of New Cryocooler Regenerator Materials, Presented at the 13th International Cryocooler Conference, Paper No. 83, Mar. 29-Apr. 1, 2004, pp. 1-9.

* cited by examiner

LOW TEMPERATURE CRYOCOOLER REGENERATOR OF DUCTILE INTERMETALLIC COMPOUNDS

This application claims benefits and priority of provisional application Ser. No. 60/546,740 filed Feb. 23, 2004.

FIELD OF INVENTION

The present invention relates to magnetic regenerator materials for cryocoolers comprising ductile intermetallic compounds, which order magnetically below 30 K, and, more particularly, to magnetic regenerators to enhance the cooling power and efficiency and closed cycle cryocoolers operating from approximately 300 K to approximately 2 K.

BACKGROUND OF THE INVENTION

Regenerators are an integral part of cryocoolers to reach low temperatures between 4 K and 20 K (approximately 270 to 250 K below room temperature) regardless of the refrigeration technique employed; e.g., regardless of whether the known Gifford-McMahon, Stirling, pulse tube, etc. cooling technique is employed. A two stage Gifford-McMahon cycle cryocooler or refrigerator used to reach extremely low temperatures, such as approximately 10 K, without a liquid refrigerant is discussed in U.S. Pat. No. 5,186,765. For discussion of other cryocoolers, see books entitled "Cryogenic Heat Exchangers", Plenum Press, New York, 1997, by R. A. Ackerman and entitled "Cryocoolers Part 1: Fundamentals", Plenum Press, New York, 1983, by G. Walker, and the papers entitled "Cryocooler Applications", *Cold Facts*, vol. 16, no. 1 (Winter 2000) by R. Radebaugh, pp. 1, 6, 7, 8, 16, 21, 24-25 and "Low-power Cryocooler Survey", *Cryogenics*, vol. 42, (2002), by ter Brake and Wiegerinck, pp. 705-718.

One important property of a highly effective regenerator is that the regenerator material should have a large volumetric heat capacity. Most commercial regenerators today employ bronze or stainless steel screens or spheres to cool down to approximately 100 K, and lead (Pb) spheres to cool below 100 K, with 10 K being the no heat-load low temperature limit because the heat capacity of lead becomes extremely low at that temperature. Sometimes a combination of bronze or stainless steel and lead are used for cooling below 50 K with a layered regenerator bed for a single stage refrigerator. Or, a two stage refrigerator is used with a bronze alloy and stainless steel materials used in the high temperature stage and lead (Pb) used in the low temperature stage as a result of the heat capacity of lead not decreasing as quickly as that of the other materials below 100 K. Above 100 K, most metallic, non-magnetic materials have the same molar heat capacity, reaching the DuLong-Petit limit of 3R, where R (=8.314 J/mol K) is the universal gas constant. In general, the higher the heat capacity of the regenerator bed material, the greater the cooling power of a cryocooler, all other parameters being equal.

The potential use of lanthanide intermetallic compounds, which exhibit low magnetic ordering temperatures (e.g. less than 10 K), as cryogenic magnetic regenerator materials (refrigerant or cold accumulating materials) was pointed out nearly 25 years ago by Buschow et al. in an article entitled "Extremely Large Heat Capacities between 4 and 10 K, *Cryogenics*, vol. 15, (1975), pages 261-264. However, a practical lanthanide regenerator material was not developed and put into use until about 15 years later when the use of $Er_3Ni$ (a brittle intermetallic compound) as a low temperature stage regenerator material in a two-stage Gifford-McMahon cryocooler was proposed by Sahashi et al. in "New Magnetic Material $R_3T$ System with Extremely Large Heat Capacities Used as Heat Regenerators", *Adv. Cryogenic Eng.*, vol. 35, (1990), pages 1175-1182 and by Kuriyama et al. in "High Efficient Two-Stage GM Refrigerator with Magnetic Material in Liquid Helium Temperature Region", *Adv. Cryogenic Eng.*, vol. 35 (1990), pages 1261-1269.

These articles proposed the replacement of the lead (Pb) lower stage regenerator material with $Er_3Ni$ intermetallic compound material. Replacement of the lead lower stage regenerator material with $Er_3Ni$ material (a *brittle* intermetallic compound) permitted improved cooling to approximately 4.2 K instead of the approximately 10 K achievable with the previously used lead lower stage regenerator material with a reasonable refrigeration capacity at the lowest temperature. This improvement in cooling (i.e. to approximately 4.2 K) is attributable to the significantly higher heat capacity of $Er_3Ni$ than lead below 25 K (the heat capacity of lead becomes negligible below 10 K).

The Gschneidner and Pecharsky U.S. Pat. No. 5,537,826 issued Jul. 23, 1996, describes an improved regenerator for the low temperature stage (e.g. below 20 K) of a two stage Gifford-McMahon cryocooler. The patented regenerator comprises intermetallic compounds $Er_6Ni_2Pb$, $Er_6Ni_2(Sn_xGa_{1-x})$, where x is greater than 0 and less than 1, and $Er_6Ni_2Sn$ as a regenerator component.

An object of the present invention is to reduce the cost and to improve the reliability, efficiency and increase the cooling power of a cryocooler at low temperatures from about 2 K up to approximately 30 K.

Another object of the present invention is to utilize ductile magnetic rare earth (lanthanide) based intermetallic compounds, which can be easily fabricated into tough, non-brittle, corrosion resistant spherical powders, or thin sheets, or thin wires, or screens, or porous monolithic forms (such as cartridges), as the regenerator material.

Another object of the present invention is to provide a cryocooler with a regenerator having significantly higher heat capacity than the aforementioned previously used low temperature (less than 30K) regenerator materials and combinations thereof, such as $Er_3Ni$, $HoCu_2$ and $Pr_xEr_{1-x}$.

More recently, $HoCu_2$ (a brittle intermetallic compound) has replaced $Er_3Ni$ as the choice regenerator material for cooling down to approximately 2 K, see Satoh et al., "A Gifford-McMahon Cycle Cryocooler below 2 K", *Cryocoolers* 11, R. G. Ross, Jr., editor, Kluwer Academic/Plenum Publishers, New York (2001), pp. 381-386. Also $GdAlO_3$ (a brittle oxide has been suggested as a magnetic regenerator to reach temperatures below that attainable with either $Er_3Ni$ and $HoCu_2$, i.e. about 2 K; it orders magnetically at 3.8 K. [Numazawa et al., "New Regenerator Material for Sub-4 K Cryocoolers", *Cryocoolers* 11, R. G. Ross, Jr., editor, Kluwer Academic/Plenum Publishers, New York (2001), pp. 465-473].

The low temperature heat capacity properties of several rare earth—copper or silver binary compounds with the CsCl-type crystal, which have magnetic ordering temperatures below 20 K, have been reported in the literatue. However, none of the authors were aware of the ductile nature of these B2, CsCl-type compounds. These include: HoCu, ErCu, TmCu, PrAg, NdAg, $(Pr_{1-x}Nd_x)Ag$, TbAg, ErAg, and TmAg. The first measurements were made on HoCu, ErCu, and TmCu, which were found to exhibit two or more magnetic ordering peaks: HoCu—at 13.4, 20 and 26.5 K; ErCu—at 10.9 and 13.8 K; and TmCu—at 6.7 and 7.7 K ["Competition Between Multi-*q*Antiferromagnetic Structures in Cubic Rare Earth-Copper Compounds", *J. Magn. Magn. Mater.*, vol. 21, (1980) by Morin and Schmidt, pp. 243-256].

The heat capacities of TbAg and ErAg from 0.5 and 21 K were measured and no magnetic transition was observed below 21 K for TbAg and three peaks at 11, 14.5, and 15.2 K for ErAg ["The Specific Heats of ErAg and TbAg Between 0.5 and 21 K", *J. Phys. F: Met. Phys.*, vol. 17, (1987) by R. W. Hill]. The heat capacity of ErAg is reasonably large at the 15 K double peak to warrant consideration as a regenerator material. Indeed Japanese scientists have proposed that ErAg be utilized as a regenerator material from 9 to 17 K. ["Evaluation of Low-temperature Specific Heats and Thermal Conductivities of Er—Ag Alloys as Regenerator Materials", *Jpn. J. Appl. Phys.*, vol. 35, (1996) by Biwa et al., pp. 2244-2248]. The heat capacities of PrAg, NdAg, and $(Pr_{1-x}Nd_x)Ag$ were measured from 2 to 25 K and only a single magnetic ordering peak was observed. The peak temperatures varied from 10 K for PrAg to 23 K for NdAg, while those for the ternary alloys were 11, 12.5, and 17 K for x=0.1 (also x=0.2), 0.5 (also x=0.6) and 0.8, respectively ["Studies of Low Temperature Specific Heats and Thermal Conductivities of CsCl-type $(Pr_{1-x}Nd_x)$ Ag ($0 \leqq x \leqq 1$) Intermetallic Compounds: Application to Regenerator Materials", *Jpn. J. Appl. Phys.*, vol. 36, (1997) by Yagi et al., pp. 5638-5643]. These authors found that the heat capacity maxima of the ternary alloys are generally significantly less than those of the two end members. They also suggested that PrAg would be a better regenerator alloy than $Er_3Ni$ at least over the 8 to 15 K temperature range. More recently, the large heat capacity of TmCu was confirmed, and that of TmAg was reported to be reasonably large at its magnetic ordering temperature, about 8 K ["The Similar Dependence of the Magnetocaloric Effect and Magneto-resistance in TmCu and TmAg Compounds and Its Implications", *J. Phys. Condens. Matter* vol. 13, (2001) by Rawat and Das, pp. L379-L387]. This research substantiates the potential of TmCu as a low temperature cryocooler regenerator alloy and suggests that TmAg has only marginal utility as a regenerator material.

SUMMARY OF THE INVENTION

The present invention provides in one embodiment a cryocooler having improved cooling at the low temperature range or stages of operation, for example, 2 K up to 30 K, by using a passive magnetic regenerator comprising one or more regenerator components including a magnetic rare earth (lanthanide) metal as a component of a binary or ternary intermetallic compound and a non-rare earth metal as the other component. To reach temperatures of 30 K, standard cooling techniques are utilized, e.g. a Gifford-McMahon or a pulse tube cryocooler. The present invention envisions using one or more of the regenerator components in a particular embodiment to reach temperatures below 30 K, i.e. down to as low as about 2 K. An intermetallic compound is an ordered arrangement of the component atoms (two or more) on specific lattice sites in the crystal. The magnetic regenerator component(s) may comprise one or more rare earth (lanthanide) metals including Sc, Y, La, Ce, Pr, Nd, Pm, Sm, Eu, Gd, Tb, Dy, Ho, Er, Tm, Yb, and Lu with non-rare earth metals which form the CsCl, B2-type crystal structure (for example, Mg, Al, Co, Ni, Fe, Mn, Ga, Cu, Zn, Ru, Rh, Pd, Ag, Cd, In, Ir, Pt, Au, Hg, and Tl).

The rare earth (lanthanide) intermetallic compounds with the B2-type crystal structure can be used in the form of a layered regenerator bed comprising different metal and/or alloy layers in the form of wires, foils, jelly rolls, screens, monolithic porous cartridges, powders (spherical and non-spherical), or as a particulate bed comprising different metal particulate regions. The regenerator bed can include other materials such as $HoCu_2$, $Er_3Ni$, ErNi, $Pr_xEr_{1-x}$, $GdAlO_3$., lead, etc. to tailor regenerative properties of the regenerator bed. The magnetic regenerator is advantageous in that it can be tailored to improve cooling power and efficiency of the cryocooler in the temperature range or stage of operation from approximately 30 K to approximately 2 K.

Moreover, since the regenerator rare earth B2 intermetallic compounds are relatively ductile as compared, for example, to brittle intermetallic compounds (such as $HoCu_2$, $Er_3Ni$, ErNi), the regenerator layers or particulates will not attrite or comminute and pulverize in use of the regenerator. For example, the regenerator rare earth B2 intermetallic compounds typically have a ductility of at least about 5%, preferably about 10% and greater, tensile elongation prior to fracture when tensile tested in the as-cast or heat treated (annealed) condition at room temperature in ambient air pursuant to ASTM test E8-82 described in publication Annual Book of ASTM Standards published by American Society for Testing and Materials, 1985, V.301, West Conshohocken, Pa., incorporated herein by reference. Further, these rare earth intermetallic compounds can be readily fabricated into wires, screens, sheets, or spheres or porous monolithic form for use as regenerator components.

The advantage of the materials embodied in this invention, is that they can be easily and economically fabricated into a form which allows the design engineer to choose from spherical particles, wire screens, wire mesh, flat plates, jelly rolls, porous monolithic forms, etc. to construct the regenerator. Furthermore, since these materials are tough, they will not deform (as the soft lead spheres do) or comminute or decrepitate and pulverize (as the brittle intermetallic compounds do) under the cyclic high pressure gas flows used in present day cryocoolers. Furthermore, the embodied materials are oxidation resistant and do not become fine oxide powders when exposed to air as does Nd metal spheres or foil, which are used as regenerator materials in cryocoolers operating at 10 K or less.

The foregoing and other objects, features and advantages of the present invention will become apparent from the following more detailed description taken with the following drawings.

DESCRIPTION OF THE INVENTION

Figure 1:
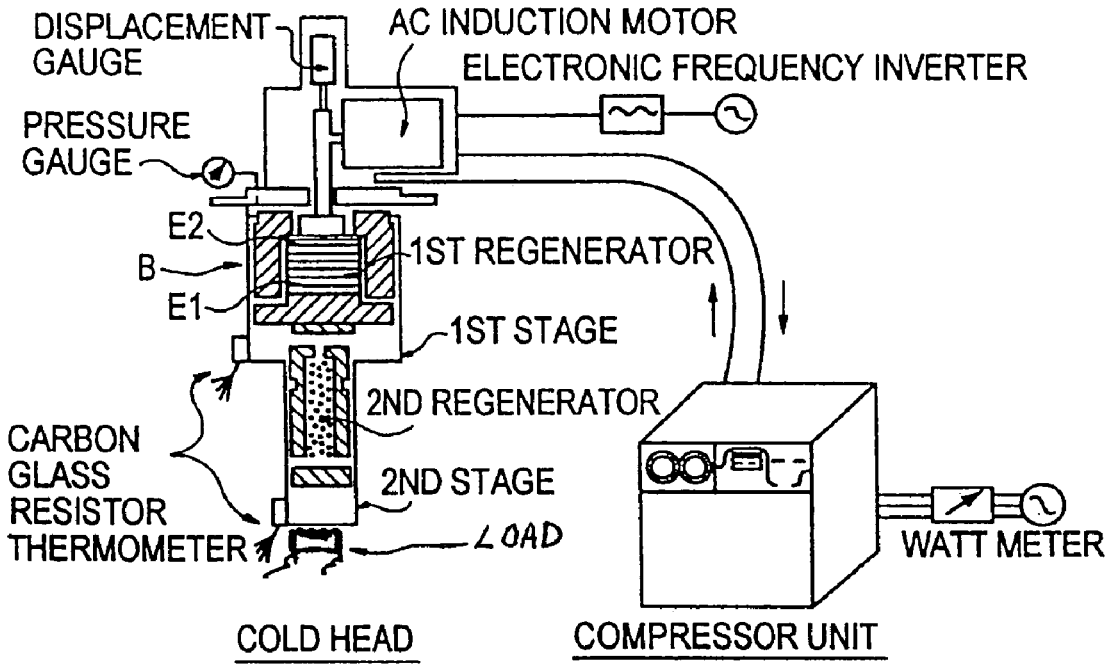
FIG. 1 PRIOR ART
FIG. 1 is a schematic illustration of a two stage Gifford-McMahon cryocooler wherein the cryocooler includes first and second stage regenerators for operation at different high and low temperature ranges or stages of operation. The embodiment of this invention is concerned with second or low temperature stage regenerator materials.

FIG. 1 is a schematic illustration of a two stage Gifford-McMahon cryocooler with which the invention may be practiced wherein the cryocooler includes the first and second stage regenerators shown for operation at different high and low temperature ranges or stages of operation as is known from aforementioned U.S. Pat. No. 5,186,765 for example. Regenerator features and components described below pursuant to embodiments of the invention preferably are employed as the second or low temperature stage regenerator for purposes of illustration and not limitation.

Figure 2:
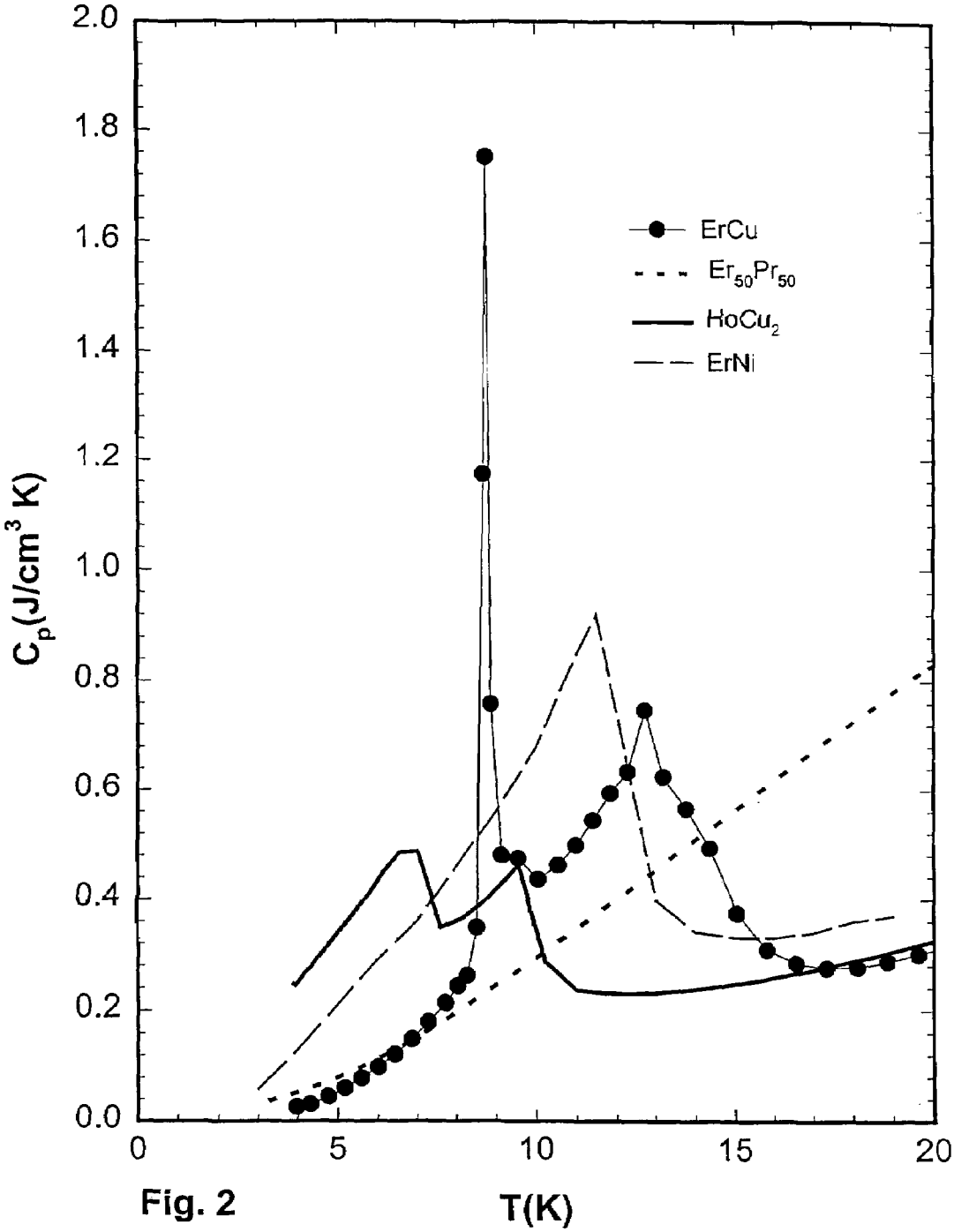
FIG. 2 is a graph which shows the volumetric heat capacity of ErCu, a ductile intermetallic compound, from 0 to 20 K compared to the low temperature prototype regenerator materials $HoCu_2$, ErNi, $Er_{50}Pr_{50}$.

Referring to FIG. 2, it is seen that ErCu has two peaks in the heat capacity due to magnetic ordering about 9 K and about 13 K. The volumetric heat capacity at 9 K is more than three times larger than the twin peaks of $HoCu_2$ and twice as large as that of ErNi, while that of the 13 K peak is slightly smaller than that of ErNi. This suggests that ErCu-base alloys might be a competitive cryocooler regenerator material with $HoCu_2$ if the peaks could be shifted to lower temperatures without a significant loss of the volumetric heat capacity by alloying either for the Er or for the Cu on both components. Similarly if the magnetic ordering transition temperatures could be merged (or brought closer together) with the maximum heat capacity peaks) near 12 K without a significant loss in the volumetric thermal properties, ErCu-base alloys might be competitive with ErNi. As noted earlier, $HoCu_2$ and ErNi are brittle intermetallic compounds, but ErCu-base alloys are ductile intermetallic compounds, and thus have many more possibilities to be easily and more economically fabricated into more efficient regenerator designs (e.g. plates, screens, wire mesh, etc.) than $HoCu_2$ and ErNi. Furthermore, since the ErCu-base materials are ductile, they will be more robust than $HoCu_2$ and ErNi and less likely to suffer attrition and comminution during the operation of the cryocooler due to the high frequency alternating gas flows at high pressure.

In general, the regenerator rare earth B2 intermetallic compounds described herein typically have a ductility of at least about 5%, preferably about 10% and greater, tensile elongation prior to fracture when tensile tested at room temperature in ambient air pursuant to ASTM test E8-82. These ductile rare earth intermetallic compounds can be readily fabricated into wires, screens, sheets, or spheres or porous monolithic form for use as regenerator components. It is for these reasons, a series of ErCu-base alloys were designed as improved cryocooler regenerator materials.

The shifting of magnetic ordering temperatures, in general, can be affected by alloying another element for either Er or for Cu, but there is no simple rule(s) to guide one in choosing the alloying agent or dopant element to achieve the desired properties, i.e. the appropriate magnetic ordering temperature with a reasonable volumetric heat capacity. As Gschneidner et al. ["Low Temperature Cryocooler Regenerator Materials", *Cryocooler* 13, R. G. Ross, Jr., editor, Kluwer Academic/Plenum Publishers, New York, (2003) pages 457-465] point out, systematic trends are known but significant and unexpected deviations occur when the concentration of the dopant varies, and thus a blend of an Edisonian approach and systematics is required to find alloys with the desired properties. This observation of the unpredictability of magnetic ordering phenomena upon alloying was beautifully demonstrated in a later publication by Gschneidner et al. ["Effect of Interstitial Impurities on Magnetic Transitions of Er-rich $Pr_xEr_{1-x}$ Alloys", *J. Solid State Chem.*, vol. 171, (2003) by Gschneidner, et al., pp. 324-328] who found that several of the pure Er transitions (two second order and one first order magnetic transitions) disappear upon alloying, however, upon further Pr additions (>15 at. %) a new first order magnetic transition appears.

Figure 3:
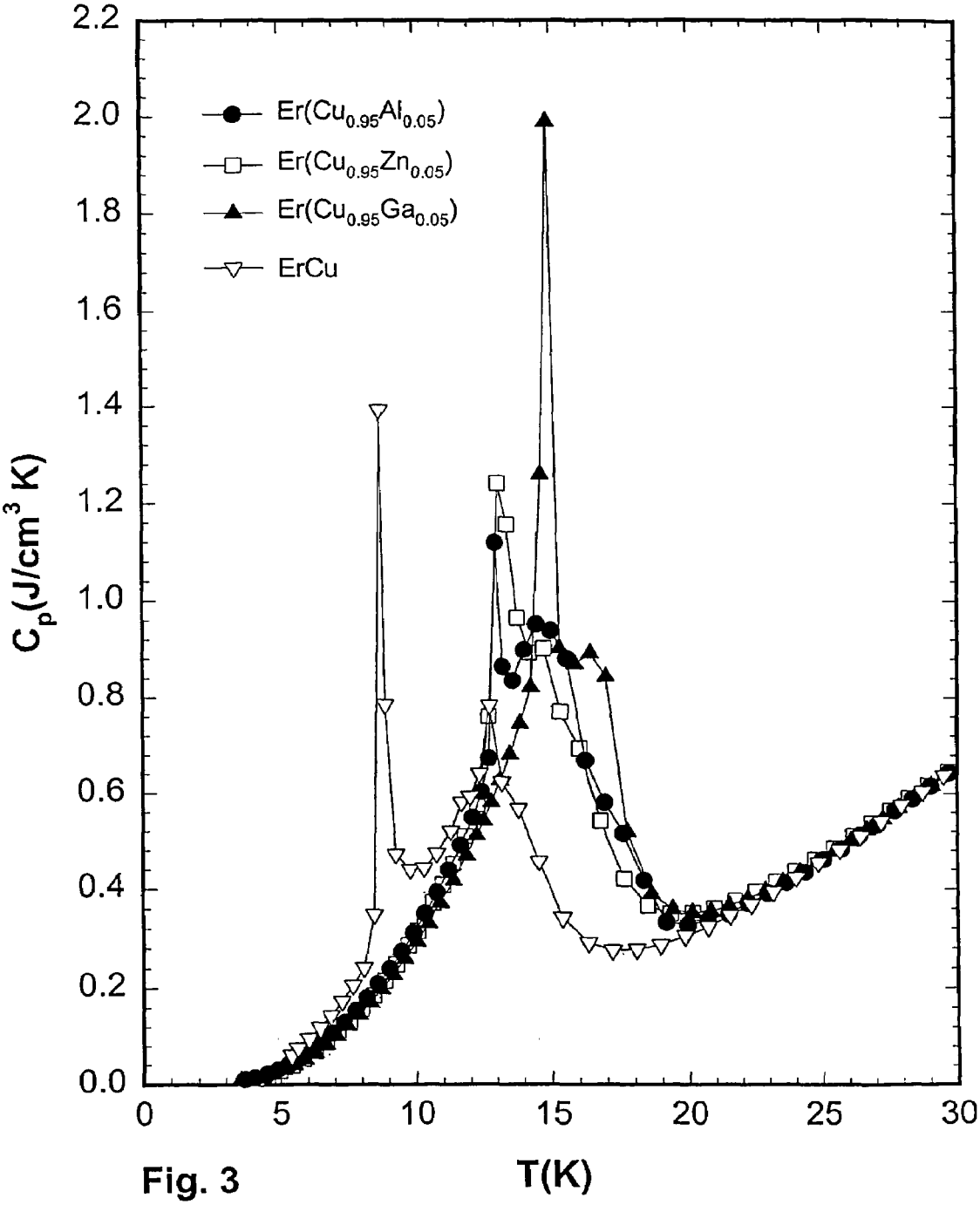
FIG. 3 is a graph which shows the volumetric heat capacity of ErCu, and three $Er(Cu_{0.95}M_{0.05})$ doped alloys where M=Al, Zn and Ga from 0 to 30 K.

FIG. 3 summarizes the effect of alloying Al, Zn, and Ga as a partial substitute for Cu (5%) in ErCu. In all cases the lower ordering temperature is shifted upward by about 5 K by Al and Zn additions and about 7 K by Ga, while the upper order temperature is also shifted upward by about 2 K for Al and Zn and about 3 K by Ga. This difference in the shifts tends to cause the two peaks to overlap and thus broaden the magnetic heat capacity peak and increases its peak value significantly near the upper ordering temperature of pure ErCu. These results suggest that all three substituted alloys would make good regenerator alloys above 12 K. This is quite evident in FIGS. 4*a* and 4*b* which compare the volumetric heat capacity of $Er(Cu_{0.95}Al_{0.05})$ and $Er(Cu_{0.95}Ga_{0.05})$, respectively, with the three prototype regenerator materials $HoCu_2$, ErNi, $Er_{50}Pr_{50}$. The results for $Er(Cu_{0.95}Zn_{0.05})$ are nearly identical with that of $Er(Cu_{0.95}Al_{0.05})$, see FIG. 3. These three alloys would make excellent regenerator materials for the 13 to 17 K range, filling in the gap between ErNi and $Er_{50}Pr_{50}$. All three alloys have the B2, CsCl-type structure and are ductile.

Figure 5A:
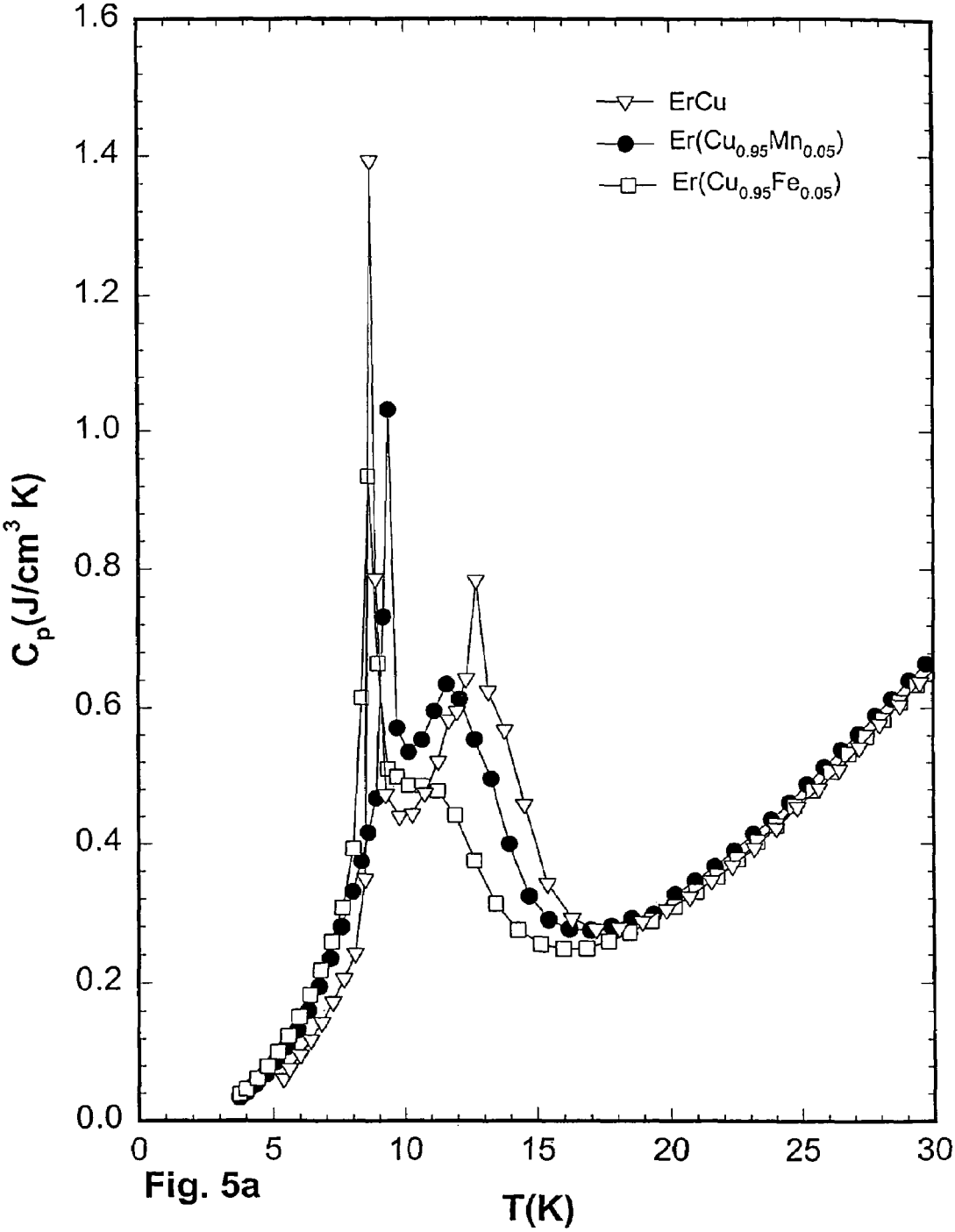
FIGS. 5*a* and 5*b* are graphs which show the volumetric heat capacity of ErCu and $Er(Cu_{0.95}M_{0.05})$ doped alloys, where M=Mn and Fe (FIG. 5*a*) and M=Co and Ni (FIG. 5*b*) from 0 to 30 K.
Figure 5B:
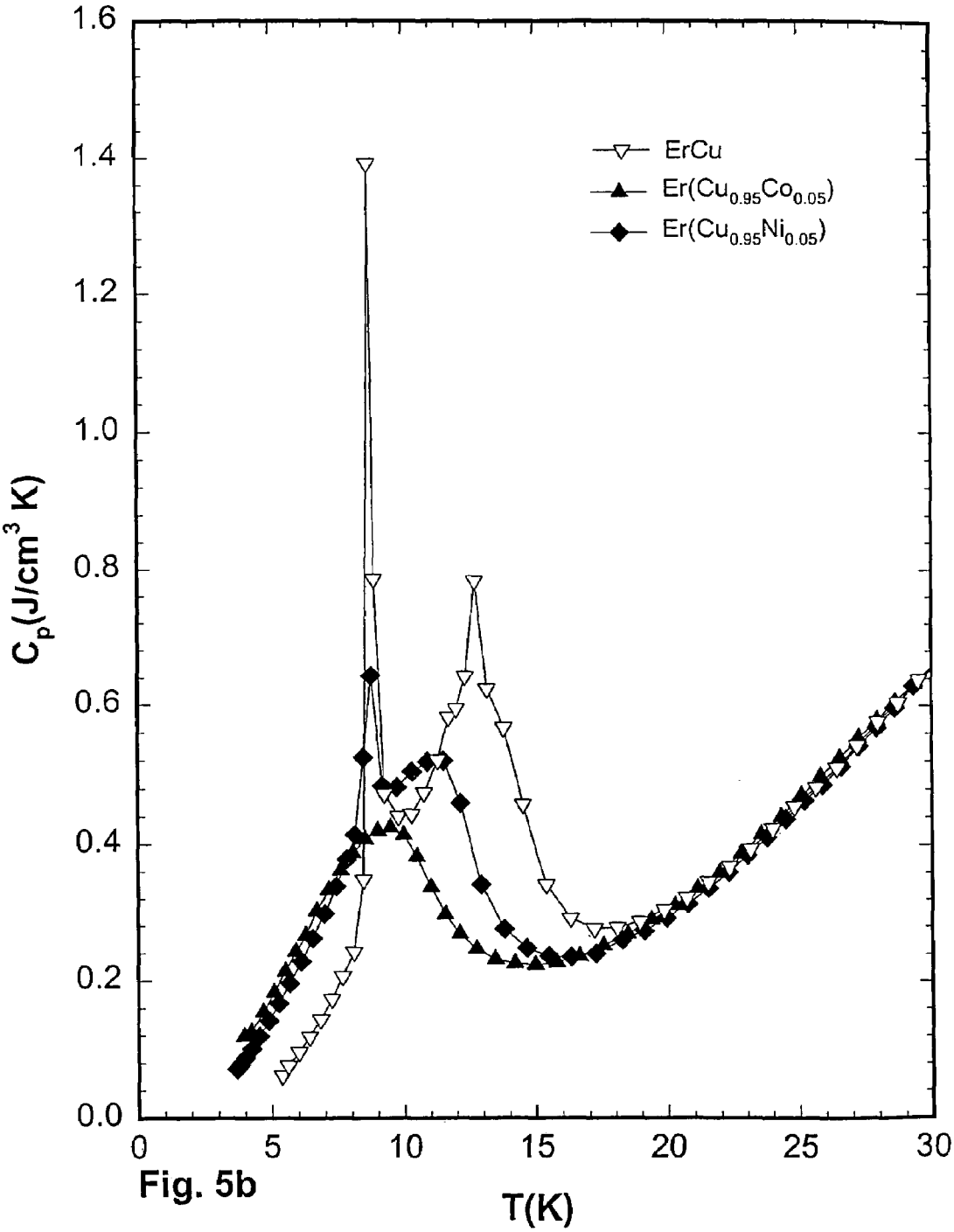
Figure 6:
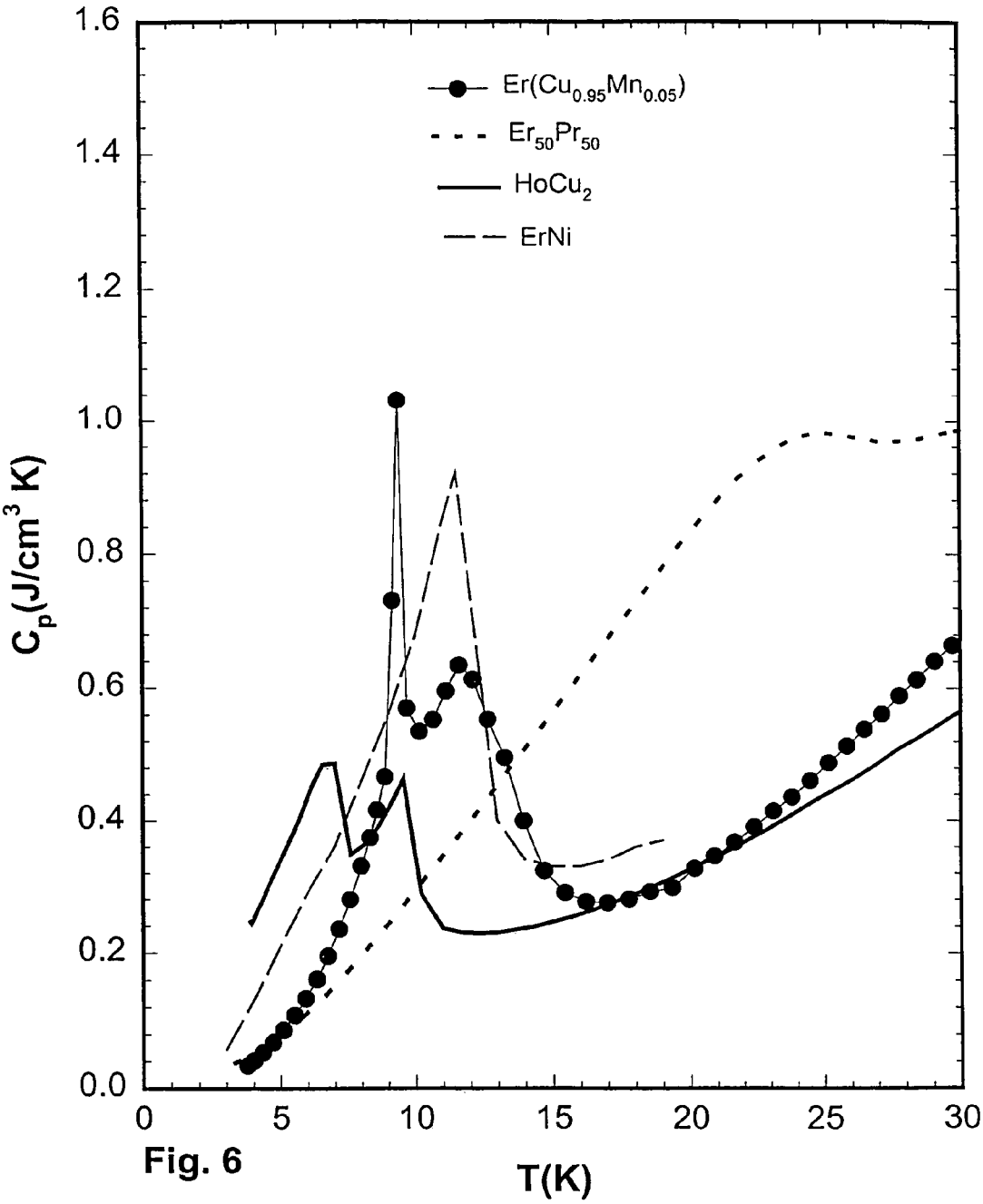
FIG. 6 is a graph which shows the volumetric heat capacity of $Er(Cu_{0.95}Mn_{0.05})$ from 0 to 30 K compared to the low temperature prototype regenerator materials $HoCu_2$, ErNi, $Er_{50}Pr_{50}$.

FIGS. 5*a* and 5*b* are plots of the volumetric heat capacities of Cu substitute ErCu by 5% of Mn and Fe, and Co and Ni, respectively. The Mn and Fe substitution tends to shift the two peaks of pure ErCu closer together, but at the same time slightly reduce the volumetric heat capacity (FIG. 5*a*). The Co and Ni additions for Cu tend to significantly reduce the volumetric heat capacity, especially Co, while lowering the upper peak temperature of pure ErCu by about 4 K for Co and 2 K for Ni. The most promising alloy of this group is $Er(Cu_{0.95}Mn_{0.05})$, and its volumetric heat capacity is compared to that of $HoCu_2$, ErNi, $Er_{50}Pr_{50}$ prototypes in FIG. 6. As seen, its heat capacity overlaps that of ErNi and would be a replacement for ErNi as a cryocooler regenerator material. All of these four ternary alloys have the B2, CsCl-type structure and are ductile.

Figure 7A:
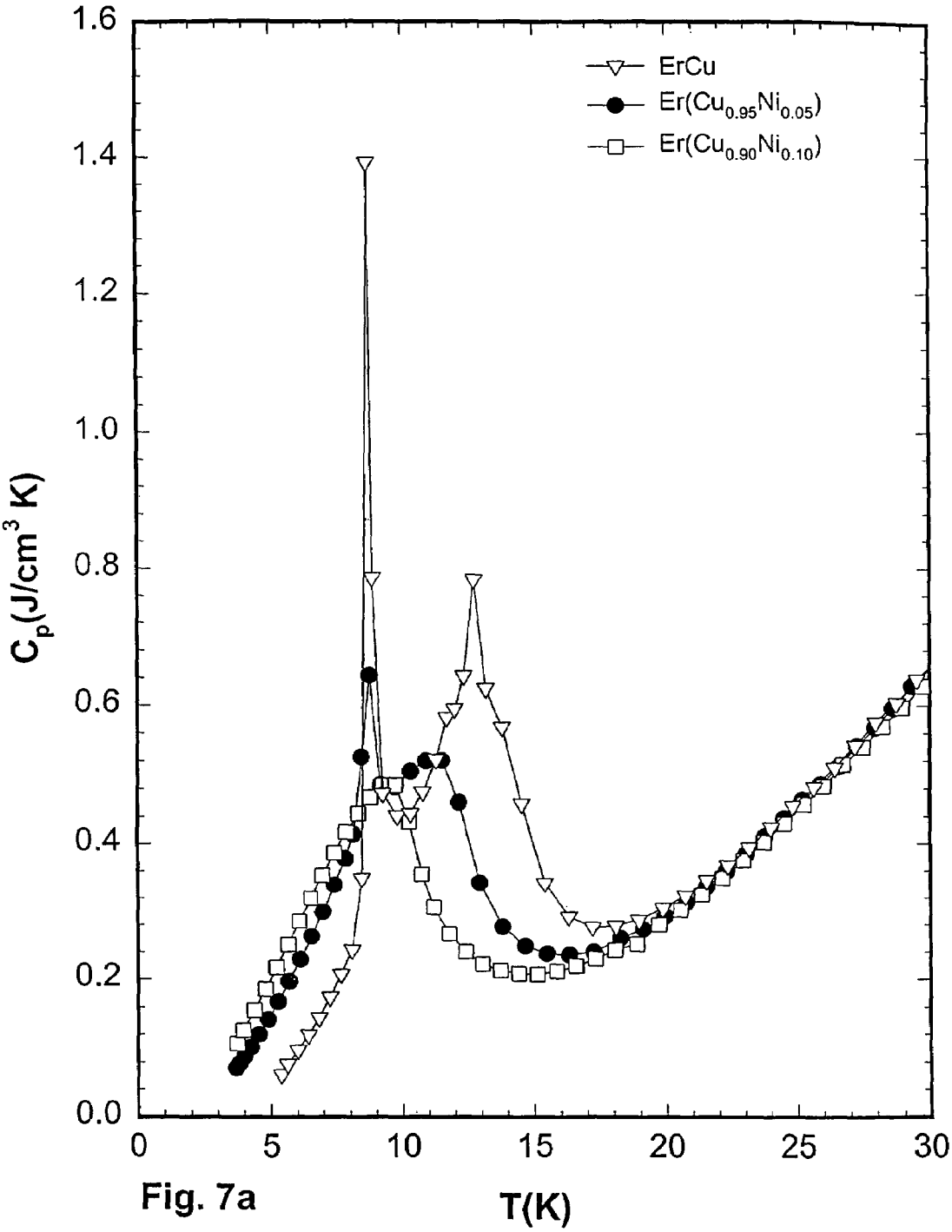
FIGS. 7*a* and 7*b* are graphs which show the volumetric heat capacity of ErCu and $Er(Cu_{1-x}Ni_x)$ doped alloys, where x=0.05 and 0.10 (FIG. 7*a*) and x=0.15 and 0.20 (FIG. 7*b*) from 0 to 30 K.
Figure 7B:
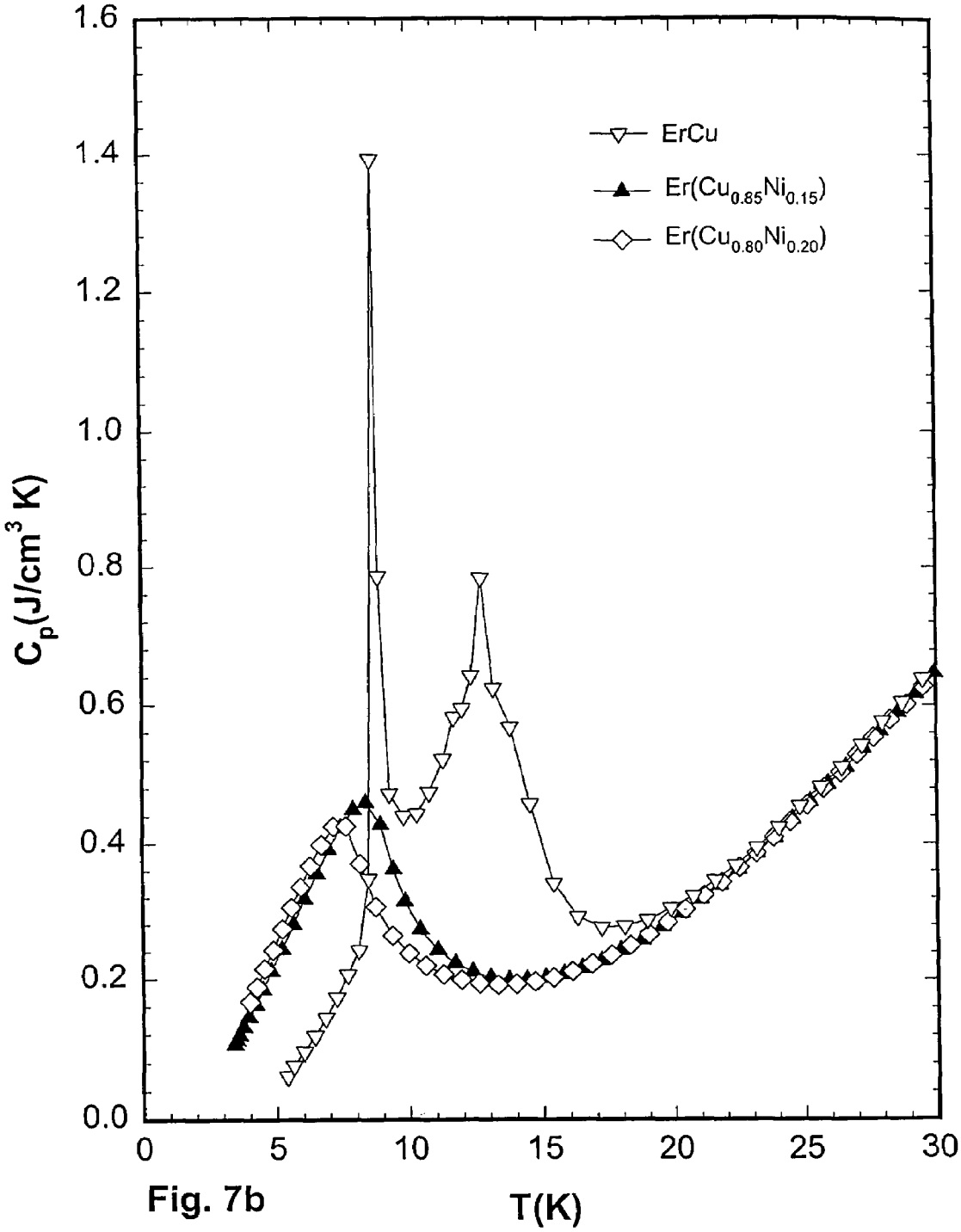
Figure 8:
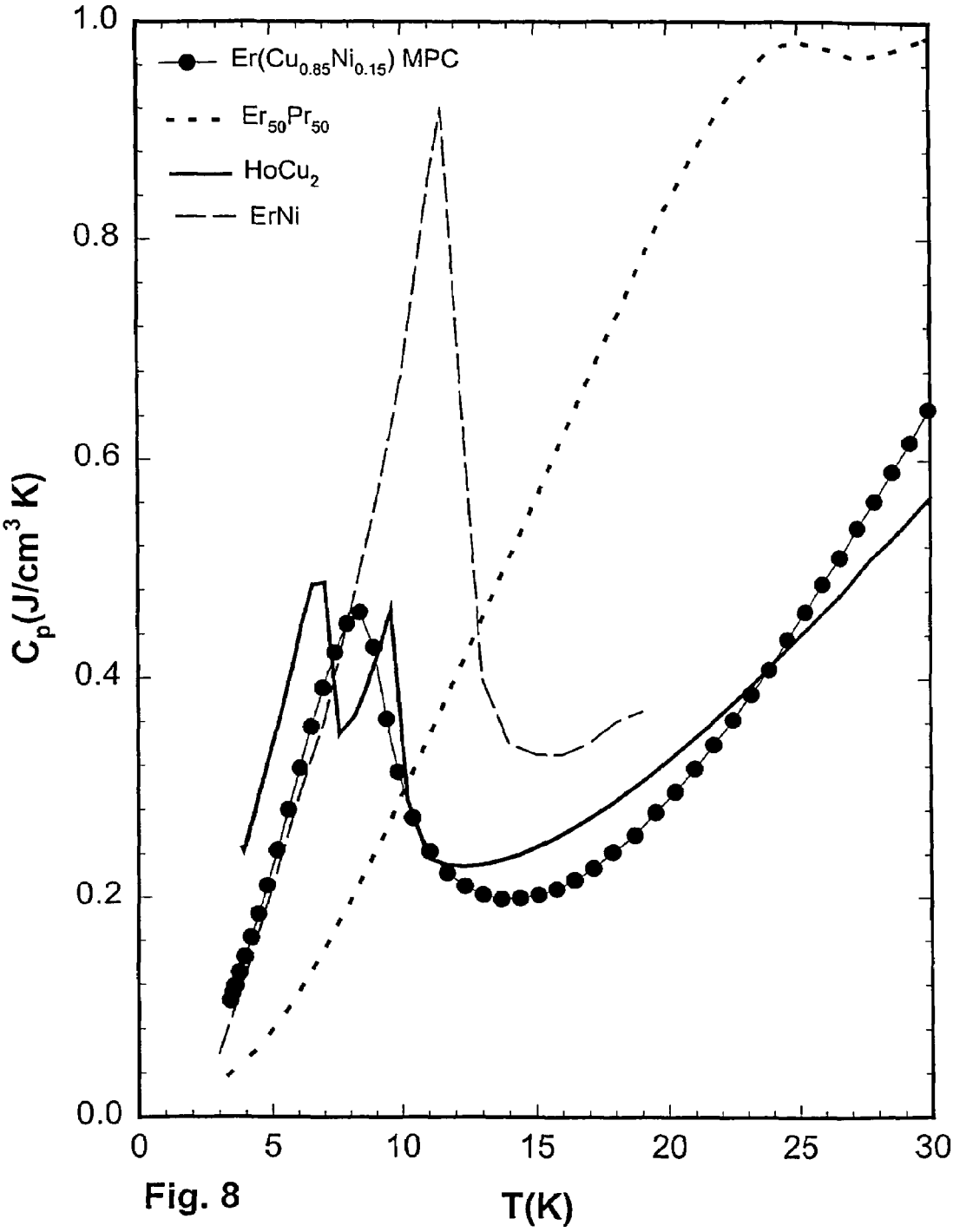
FIG. 8 is a graph which shows the volumetric heat capacity of $Er(Cu_{0.85}Ni_{0.15})$ from 0 to 30 K compared to the low temperature prototype regenerator materials $HoCu_2$, ErNi, $Er_{50}Pr_{50}$.

FIGS. 7*a* and 7*b* summarize the effect of Ni substitutions for Cu in ErCu up to 20% on the ordering temperatures and the volumetric heat capacity. Ni additions tend to destroy the upper magnetic ordering peak; a 10% Ni addition is sufficient to do this (FIG. 7*a*). The Ni substitutions also lower both the volumetric heat capacity and reduce magnetic ordering temperatures. These alloys could be used as substitutes for $HoCu_2$ as a regenerator material, e.g. see FIG. 8, where the volumetric heat capacity of $Er(Cu_{0.85}Ni_{0.15})$ is compared to the three prototype regenerator materials, $HoCu_2$, ErNi, $Er_{50}Pr_{50}$. All of the $Er(Cu_{1-x}Ni_x)$ alloys have the B2, CsCl-type structure and are ductile intermetallic compounds.

Figure 9:
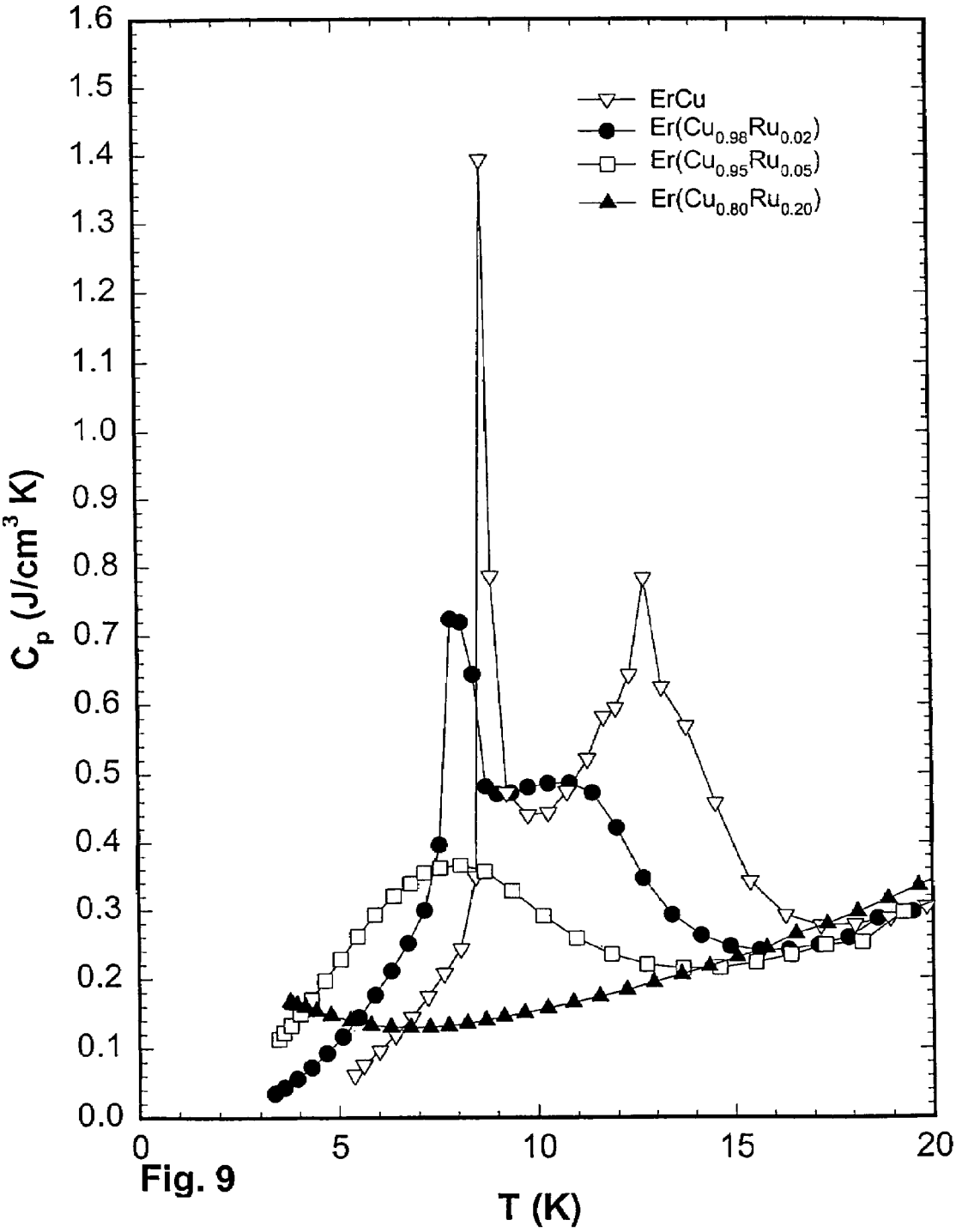
FIG. 9 is a graph which shows the volumetric heat capacity of ErCu and $Er(Cu_{1-x}Ru_x)$ doped alloys for x=0.02, 0.05, and 0.20 from 0 to 20 K.
Figure 10:
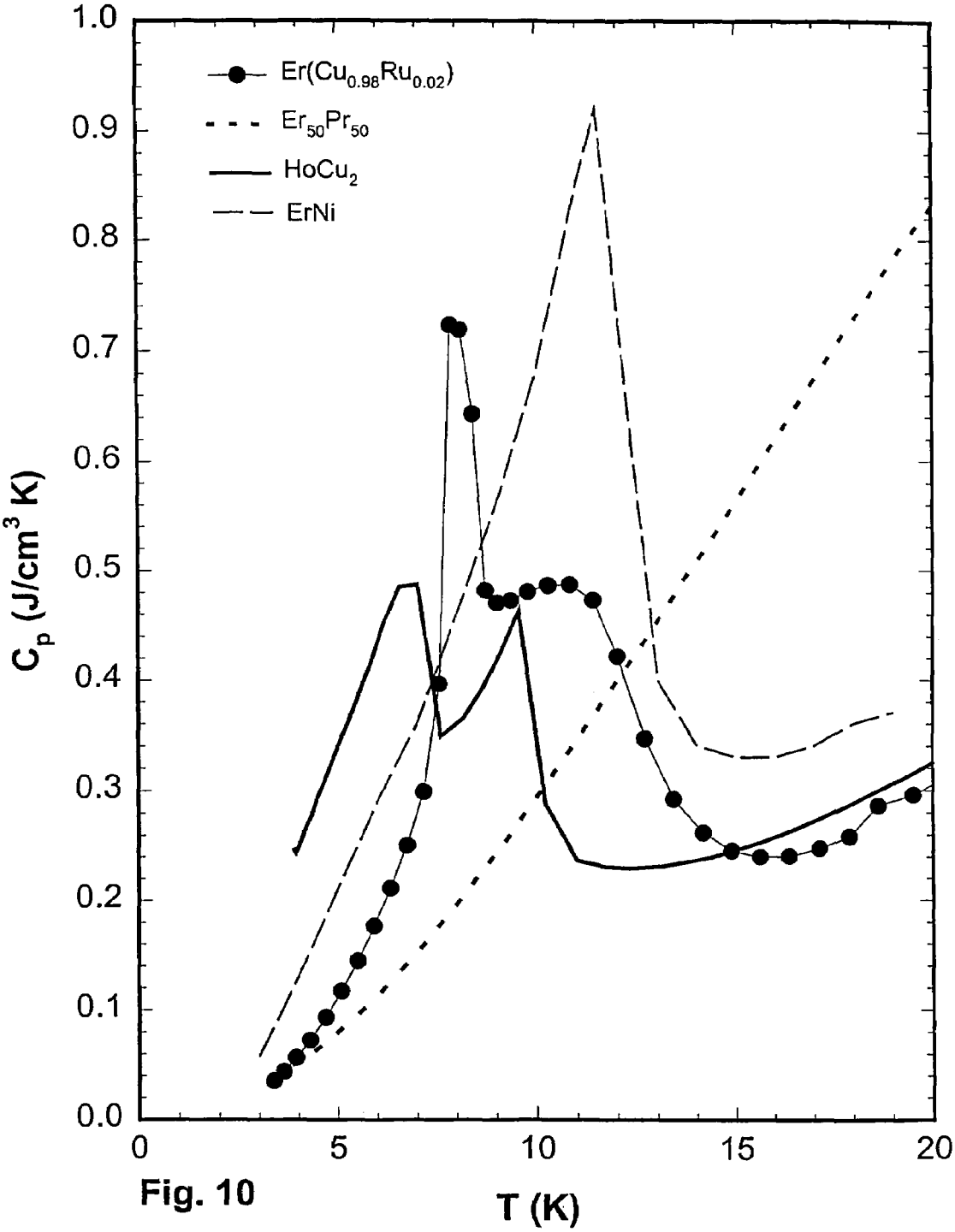
FIG. 10 is a graph which shows the volumetric heat capacity of $Er(Cu_{0.98}Ru_{0.02})$ from 0 to 20 K compared to the low temperature prototype regenerator materials $HoCu_2$, ErNi, $Er_{50}Pr_{50}$.

FIG. 9 shows the volumetric heat capacity of $Er(Cu_{1-x}R_x)$ alloys as Ru is substituted for Cu in ErCu. Ru additions behave somewhat like the Ni additions (compare FIG. 9 with FIGS. 7*a* and 7*b*), except it takes less Ru to achieve the same results, i.e. the destruction of the upper ordering peak, the shifting of the lower ordering peak to lower temperatures, and the reduction of the volumetric heat capacity. FIG. 10 compares the volumetric heat capacities of $Er(Cu_{0.98}Ru_{0.02})$ with $HoCu_2$, ErNi, $Er_{50}Pr_{50}$. This plot shows that the 2% Ru substituted alloys could substitute for $HoCu_2$ as a low temperature regenerator material. The Ru substituted alloys also have the B2, CsCl type structure and are ductile.

Figure 11:
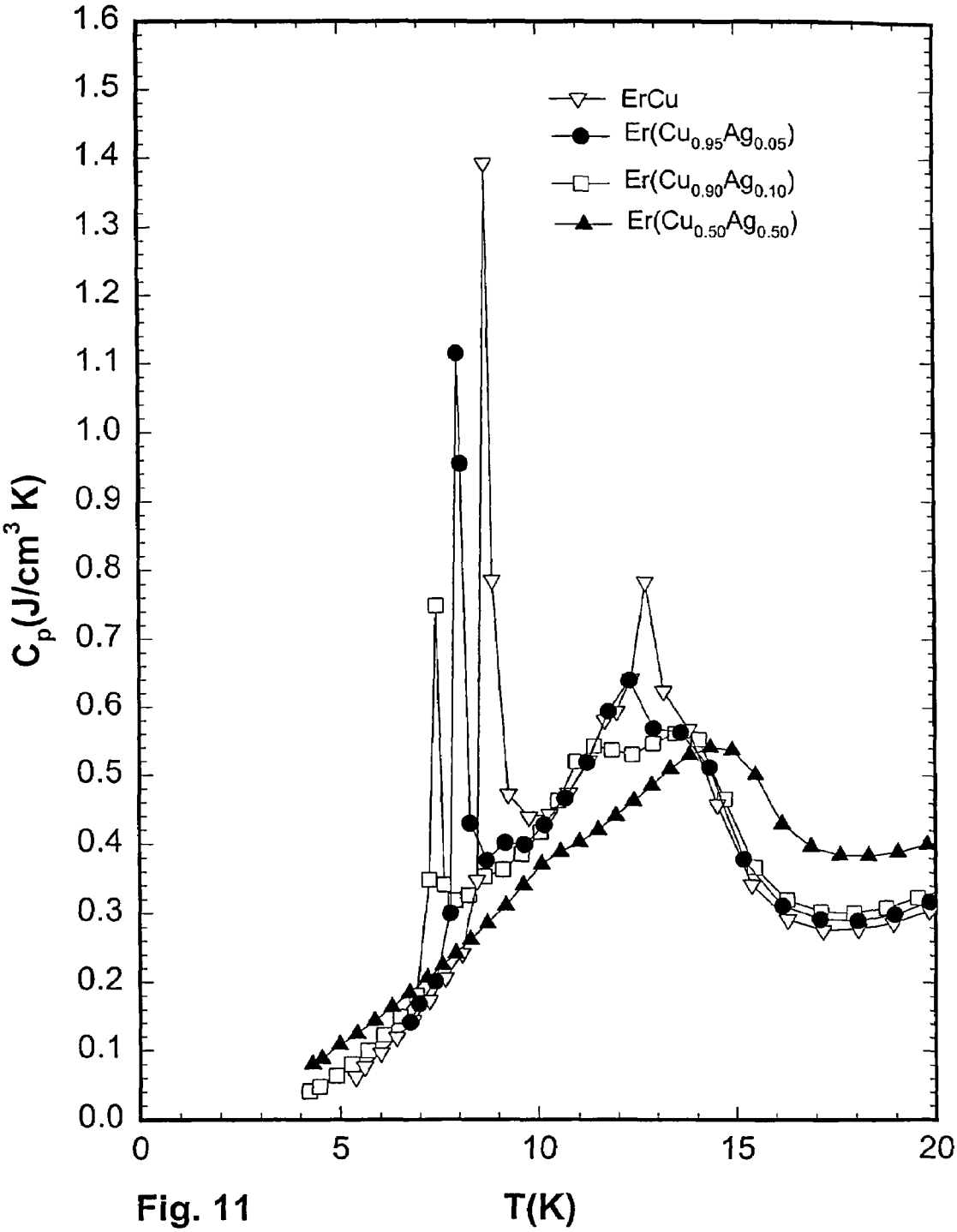
FIG. 11 is a graph which shows the volumetric heat capacity of ErCu and $Er(Cu_{1-x}Ag_x)$ doped alloys for x=0.05, 0.10, and 0.50 from 0 to 20 K.
Figure 12:
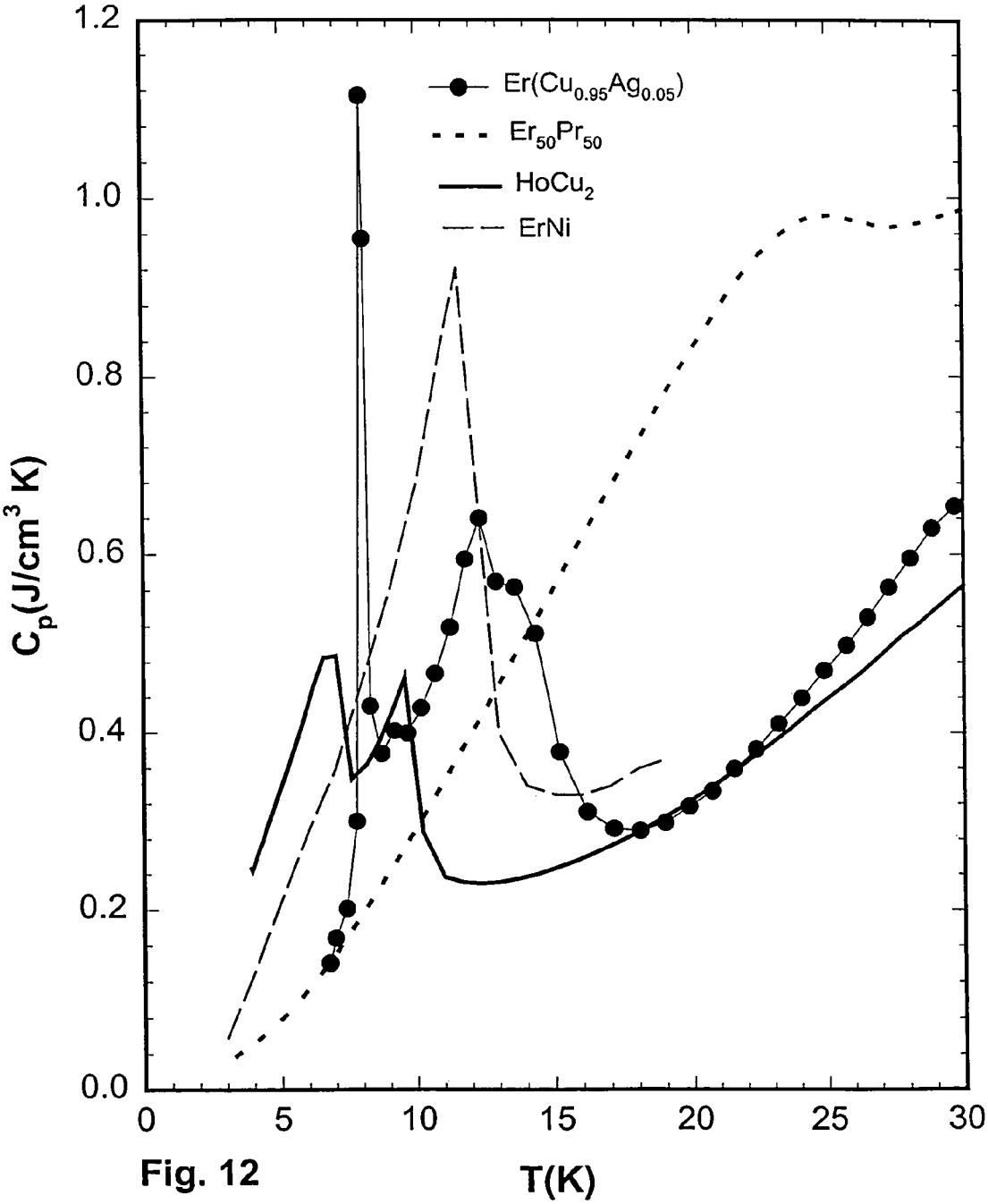
FIG. 12 is a graph which shows the volumetric heat capacity of $Er(Cu_{0.95}Ag_{0.05})$ from 0 to 30 K compared to the low temperature prototype regenerator materials $HoCu_2$, ErNi, $Er_{50}Pr_{50}$.

The influence of Ag substitutions for Cu in ErCu is shown in FIG. 11. Both magnetic ordering temperatures and the volumetric heat capacities are lower as the Ag concentration is increased. However, when 50% of the Cu is replaced there is only one broad ordering peak, which has a higher ordering temperature than that of the upper ordering peak of pure ErCu. FIG. 12 shows the heat capacities of $Er(Cu_{0.95}Ag_{0.05})$ and the three prototype regenerator materials, $HoCu_2$, ErNi, $Er_{50}Pr_{50}$. The $Er(Cu_{1-x}Ag_x)$ alloys have the B2, CsCl type structure and are ductile intermetallic compounds.

Figure 13:
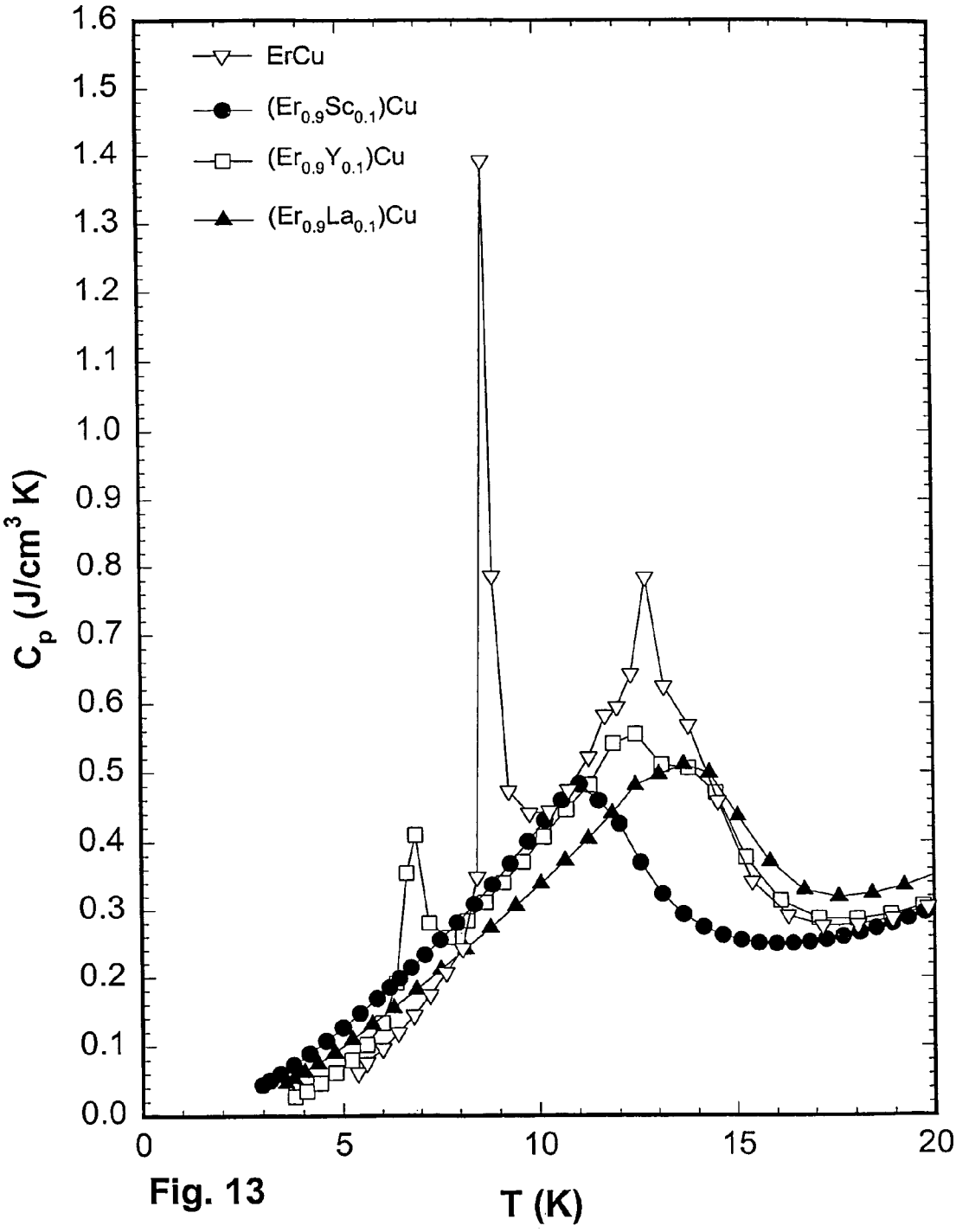
FIG. 13 is a graph which shows the volumetric heat capacity of ErCu and $(Er_{0.9}R_{0.1})Cu$ doped alloys where R=Sc, Y, and La, from 0 to 20 K.

The volumetric heat capacity of $(Er_{0.09}R_{0.1})Cu$ doped alloys, where R=Sc, Y and Lu are presented in FIG. 13. Sc and La substitutions wipe-out the lower magnetic transition and as a result there is only one magnetic ordering peak. For Sc it is about half way between the two peaks of EuCu, while for La it occurs at about 14K, about one degree above the upper ordering temperature of EuCu. The Y addition behaves much differently from Sc and La, in that there are still two peaks, but of a much lower heat capacity value than that of the pure EuCu compound. The lower peak of EuCu is shifted downward by about 2 K and the upper one by about 1 K.

Figure 14A:
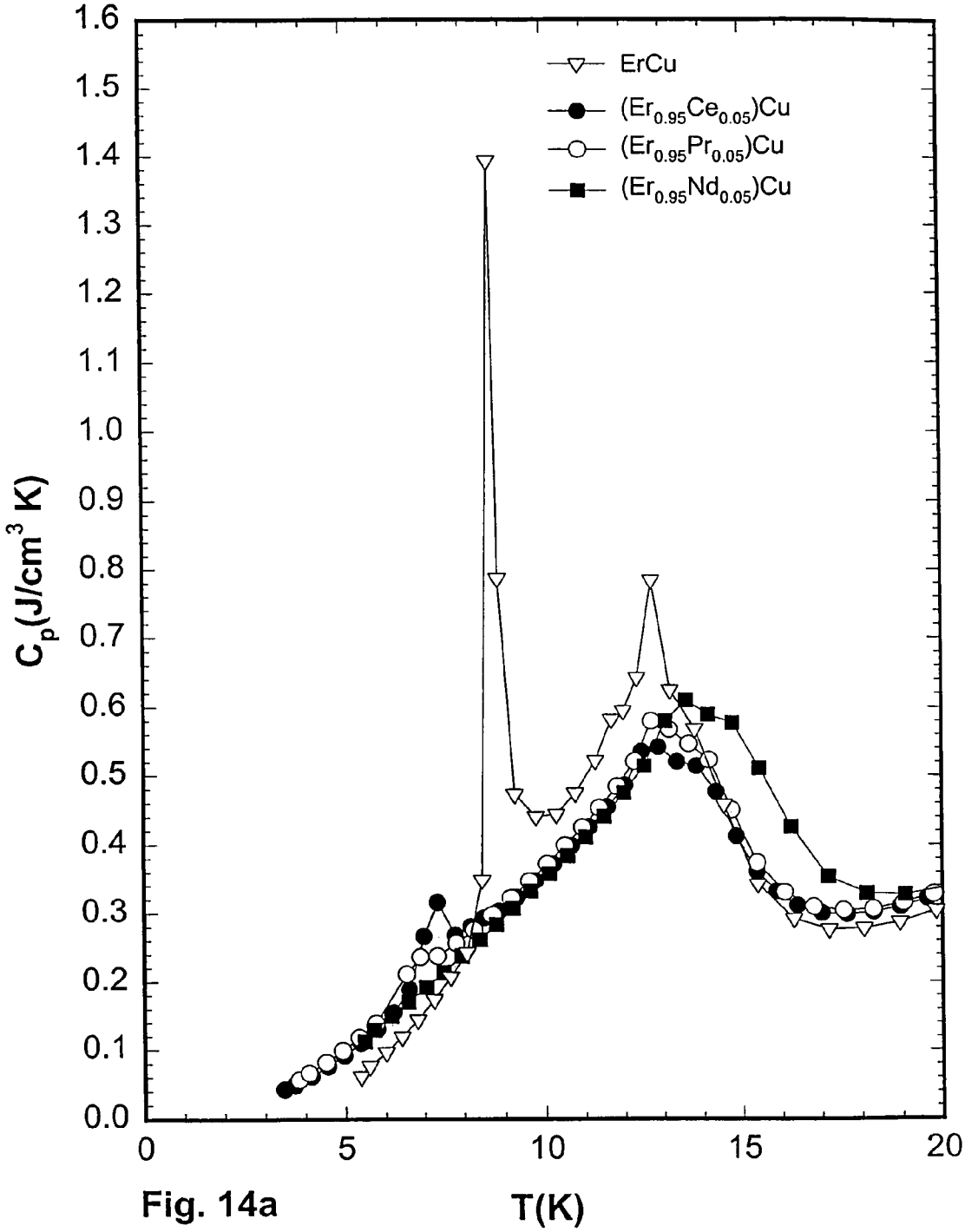
FIGS. 14*a*, 14*b*, and 14*c* are graphs which show the volumetric heat capacity of ErCu and $(Er_{0.9}R_{0.1})Cu$ doped alloys, where R=Ce, Pr, and Nd (FIG. 14*a*), Gd and Tb (FIG. 14*b*), and Dy and Ho (FIG. 14*c*), from 0 to 20 K.
Figure 14B:
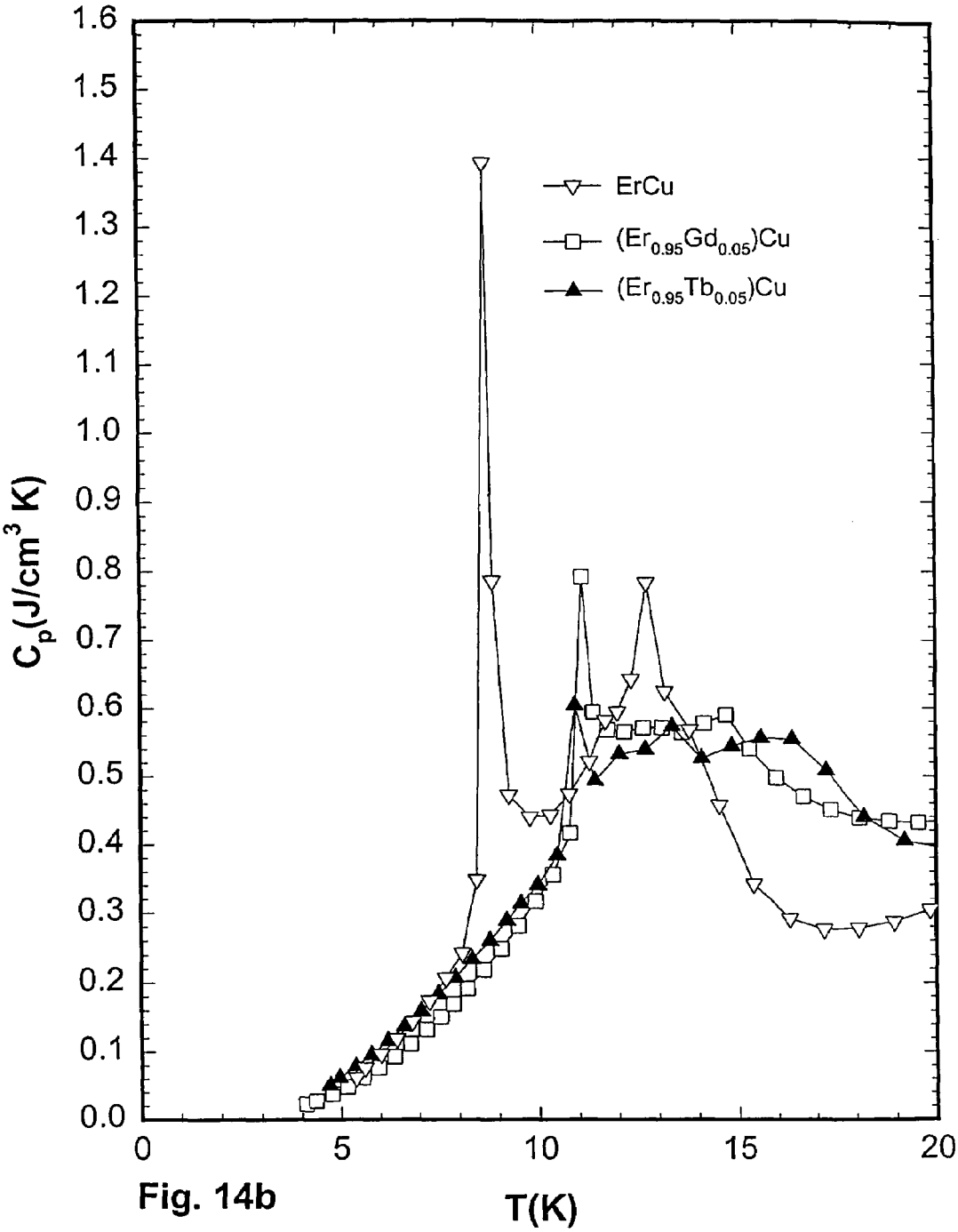
Figure 14C:
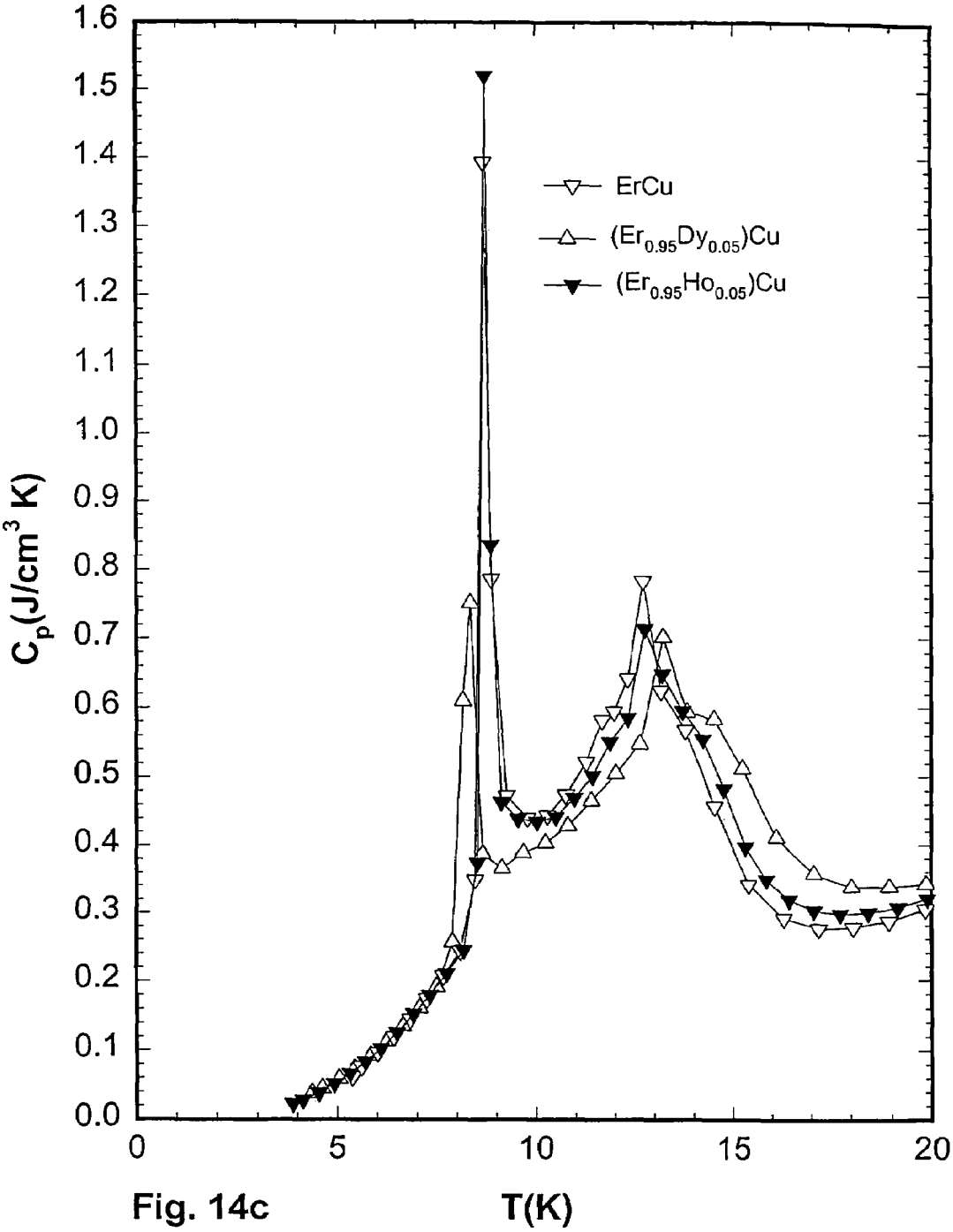

The influence of the magnetic lanthanide metals for a 5% substitution of Er on the volumetric heat capacity of ErCu is shown in FIG. 14*a* for Ce, Pr and Nd dopants, in FIG. 14*b* for Gd and Th substitutions, and in FIG. 14*c* for Dy and Ho additives. The Ce, Pr and Nd substitutions (FIG. 14*a*) behave very much like the La substitutions (see FIG. 13), basically only one broad peak close to the upper magnetic ordering temperatures of pure ErCu. However, for the Ce additive there is on additional small peak about 1 K below the lower ordering peak of ErCu. The heavy lanthanides (see FIGS. 14*b* and 14*c*) behave differently from the light lanthanides (FIG. 14*a*) in that both peaks of pure ErCu still remain upon alloying. In the case of Gd and Tb dopants (FIG. 14*b*) the peaks are shifted to a higher temperature and the volumetric heat capacities are considerably reduced. The Dy and Ho additives, (FIG. 14*c*) in contrast to the other lanthanides, hardly have any affect on either the ordering temperature or the volumetric heat capacity, and Ho more so than Dy. For Dy, the temperature spread between the lower and upper ordering peaks is widened by about 2 K with low transition temperature shifted downward and the upper temperatures upward. All of the $(Eu_{1-x}R_x)Cu$ alloys shown in FIGS. 13, 14*a*, 14*b* and 14*c* are ductile intermetallic compounds with B2, CsCl-type structures.

Figure 15:
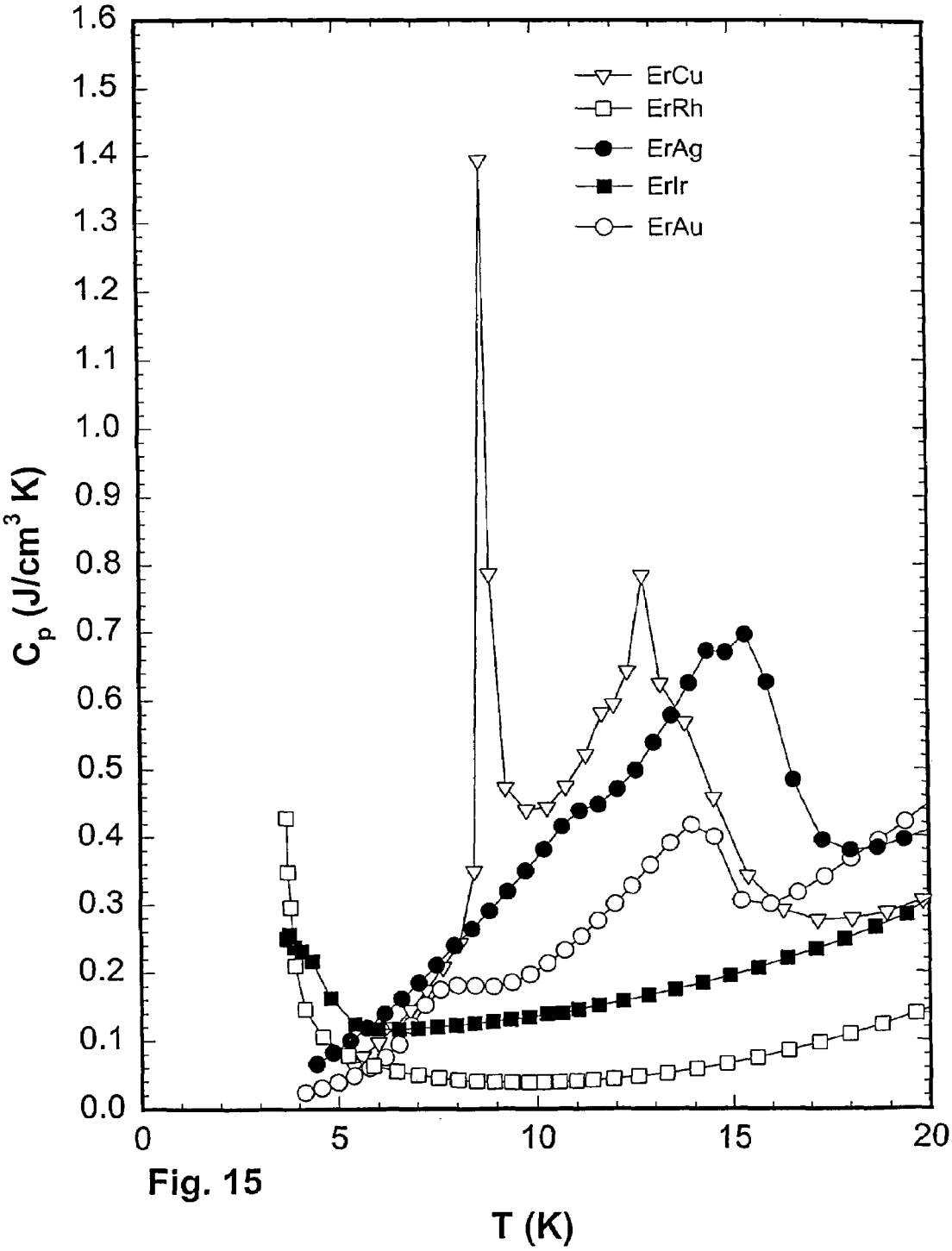
FIG. 15 is a graph which shows the volumetric heat capacity of a number of ductile binary ErM CsCl-type intermetallic compounds, where M=Cu, Rh, Ag, Ir, and Au, from 0 to 20 K.

FIG. 15 shows the volumetric heat capacity of the binary ErM (where M=Cu, Rh, Ag, Ir, Au) B2, CsCl-type intermetallic compounds, all of which are ductile. Of these five compounds, only ErCu has two magnetic ordering temperatures, while the others probably have one magnetic transition: ErAg at about 16 K, ErAu at about 14 K and ErRh and ErIr below 4 K. It is possible that ErAu may have a second magnetic transition at about 7.5 K but this needs to be verified by other physical property measurements such as the magnetic susceptibility or electrical resistivity. The upswing in the volumetric heat capacity below 5 K of ErRh and ErIr suggests that these two compounds might be good magnetic cryocooler regenerator materials for cooling below 4 K, but lower temperature heat capacity measurements needs to be made to verify the actual peak heat capacity values and their magnetic ordering temperatures.

Figure 16:
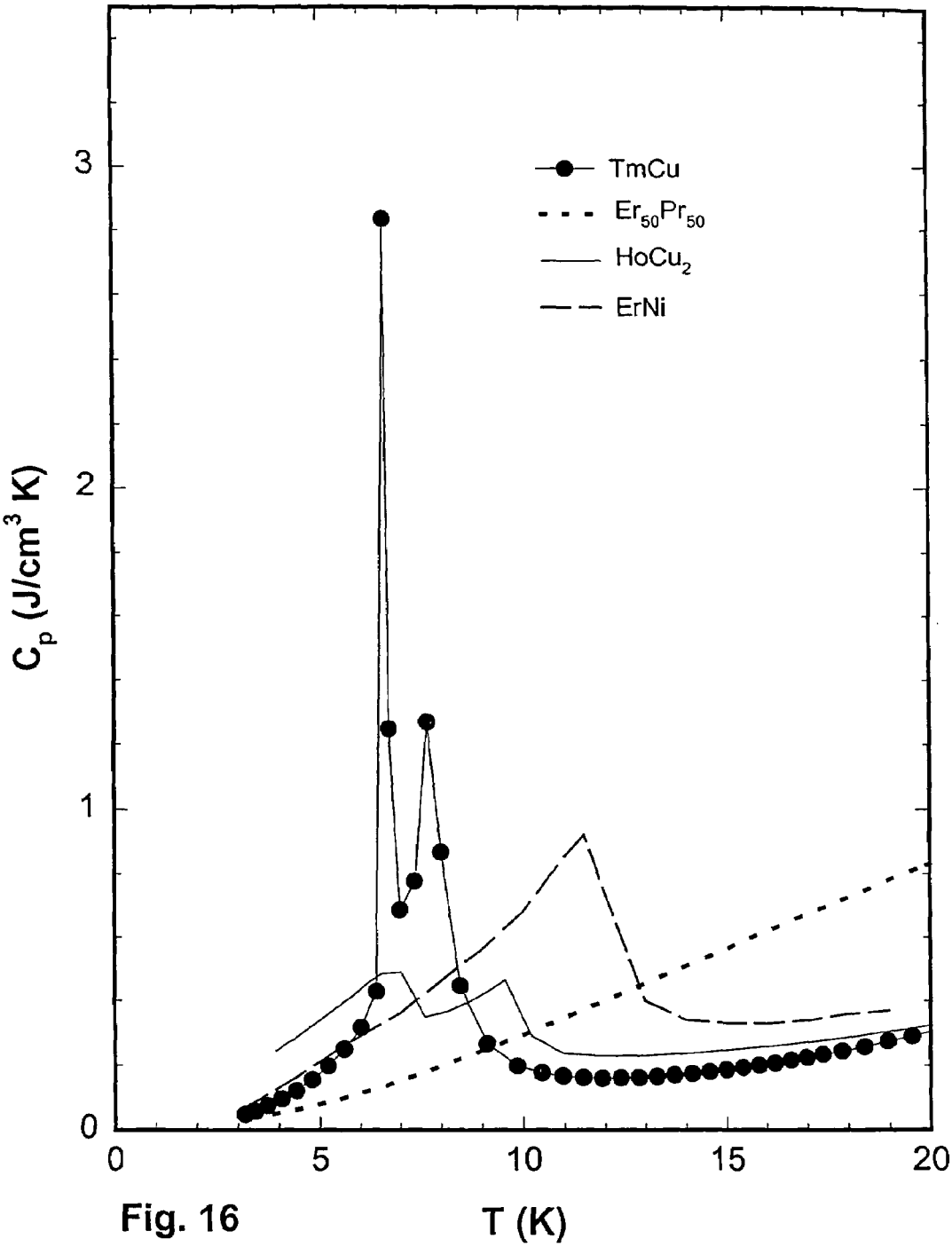
FIG. 16 is a graph which shows the volumetric heat capacity of TmCu, a ductile intermetallic compound, from 0 to 20 K compared to the low temperature prototype regenerator materials $HoCu_2$, ErNi, $Er_{50}Pr_{50}$.

FIG. 16 is a graph of the volumetric heat capacity of TmCu along with those of the three prototype cryocooler regenerator materials $HoCu_2$, ErNi, $Er_{50}Pr_{50}$. The heat capacity shows two peaks (at 7 and 8 K) with extremely high heat capacities, more than twice as large as that of ErCu (see FIG. 2), and very much larger than that of $HoCu_2$. TmCu would make an excellent replacement for $HoCu_2$ for cryocooler to reach 4 to 5 K. TmCu has the B2, CsCl-type structure and is a ductile intermetallic compound.

Figure 17:
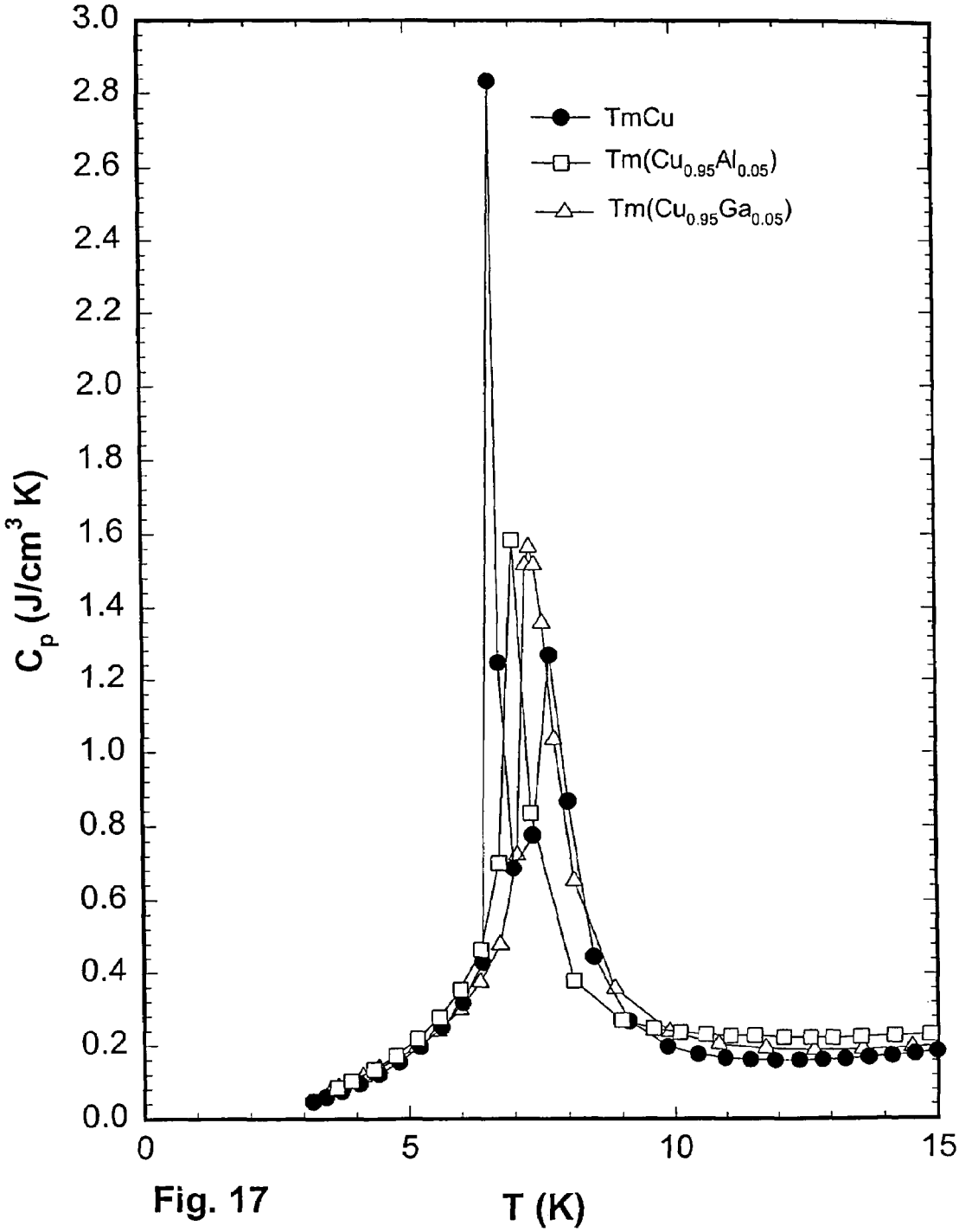
FIG. 17 is a graph which shows the volumetric heat capacity of TmCu and $Tm(Cu_{0.95}M_{0.05})$ doped alloys where M=Al and Ga, from 0 to 15 K.
Figure 18:
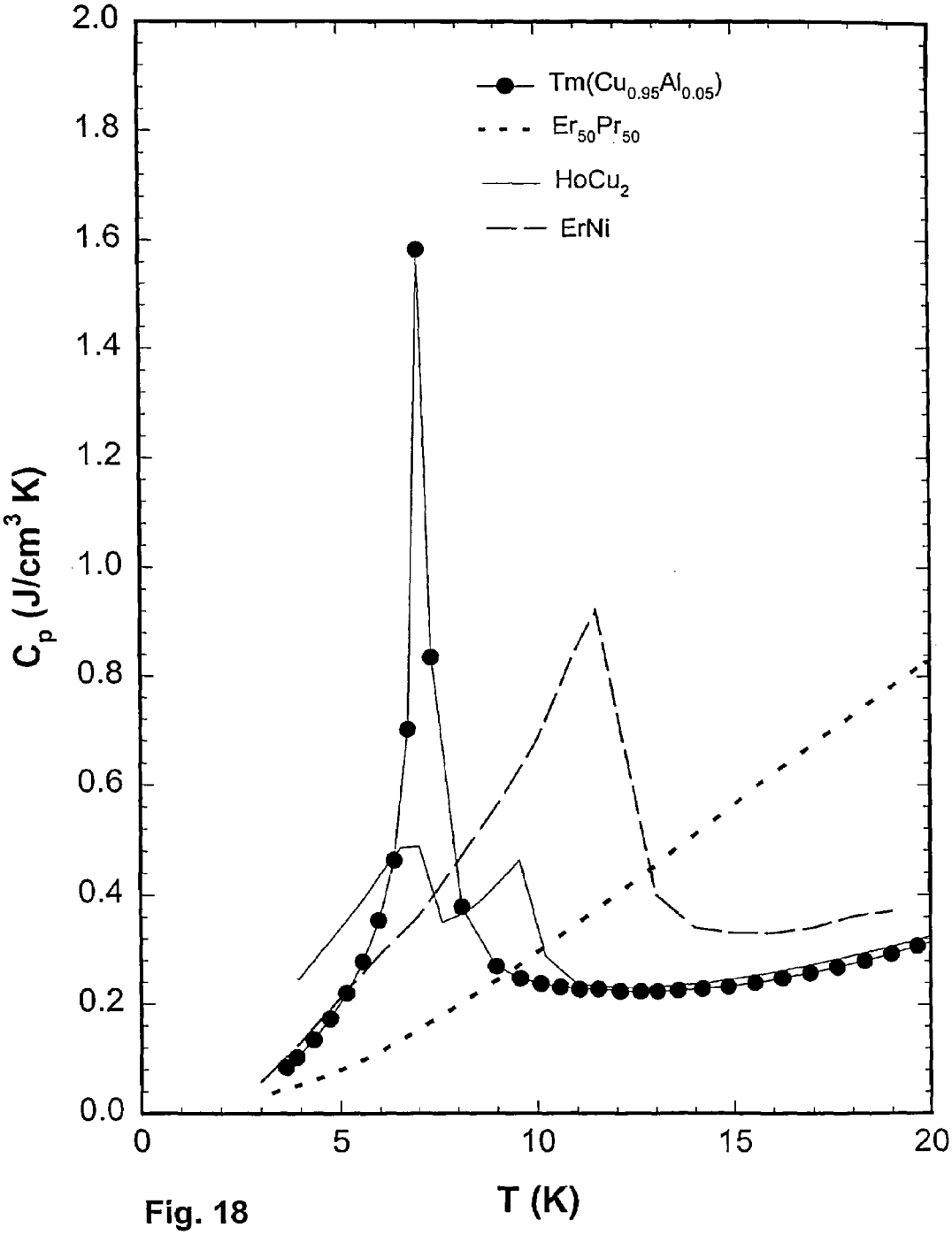
FIG. 18 is a graph which shows the volumetric heat capacity of $Tm(Cu_{0.95}Al_{0.05})$ from 0 to 20 K compared to the low temperature prototype regenerator materials $HoCu_2$, ErNi, $Er_{50}Pr_{50}$.

The substitution of Al and Ga for Cu in TmCu results in the merging of the two peaks in pure TmCu into one peak with a substantial heat capacity, see FIG. 17. As seen $Tm(Cu_{0.95}Al_{0.05})$ has a much larger volumetric heat capacity than $HoCu_2$ (by a factor of three), see FIG. 18, and would make an excellent cryocooler regenerator material to reach about 5 K. The $Tm(Cu_{0.95}Ga_{0.05})$ alloy would also be an excellent cryocooler regenerator alloy because its heat capacity vs. temperature behavior is nearly identical to that of the Al substituted alloy (see FIG. 17). These two ternary alloys have the B2, CsCl-type structure and are ductile intermetallic compounds.

Figure 19:
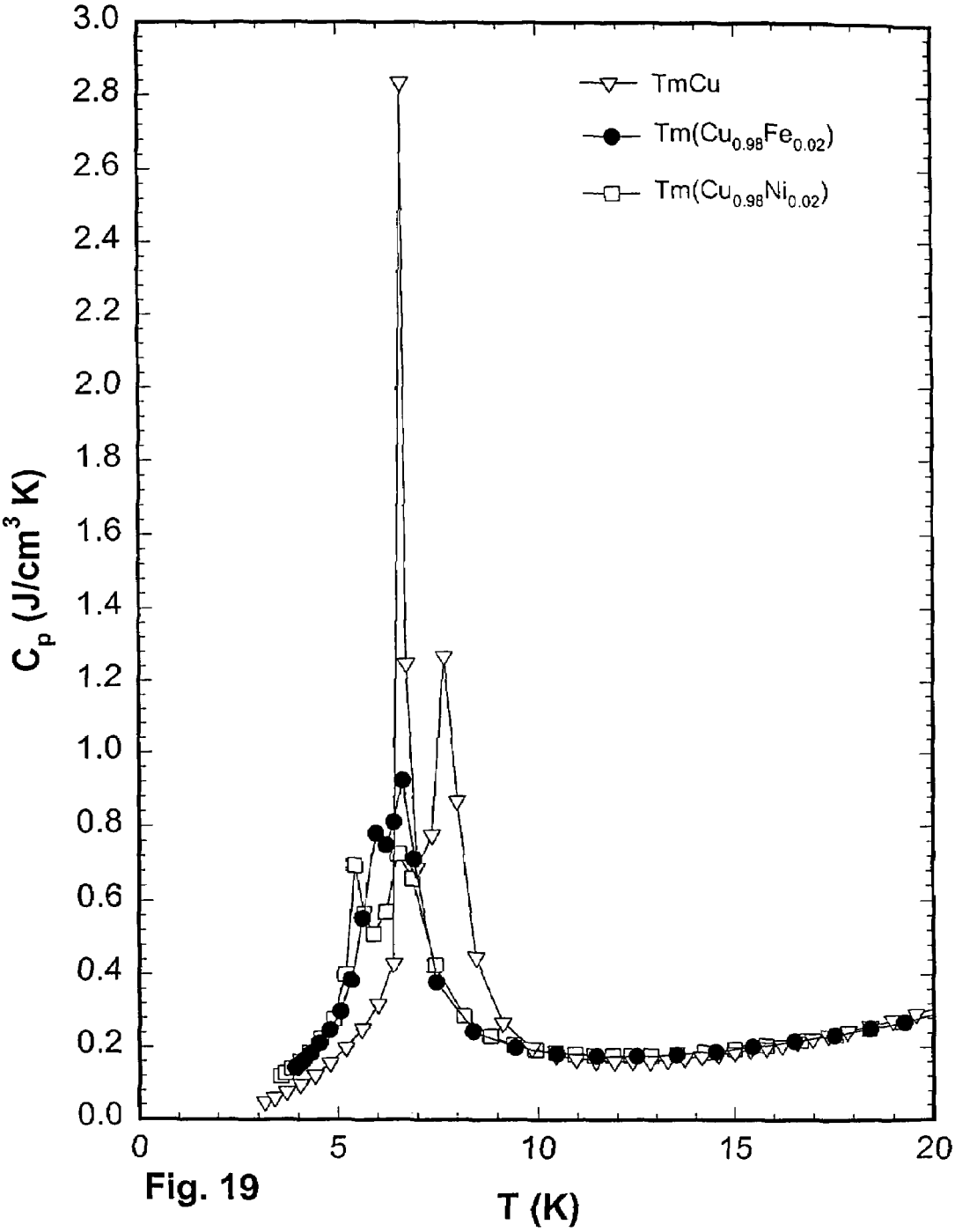
FIG. 19 is a graph which shows the volumetric heat capacity of TmCu and $Tm(Cu_{0.98}M_{0.02})$ doped alloys where M=Fe and Ni, from 0 to 20 K.
Figure 20:
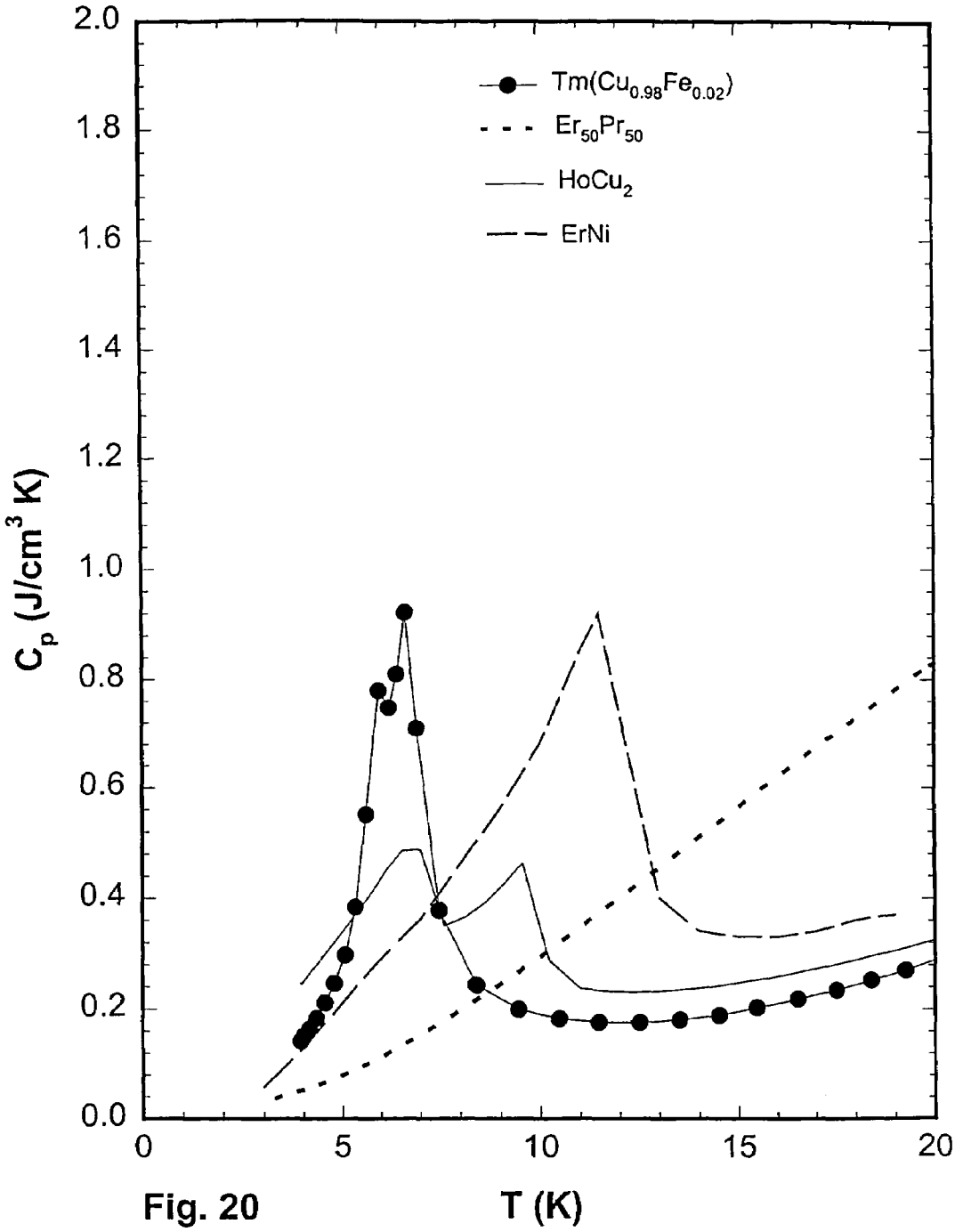
FIG. 20 is a graph which shows the volumetric heat capacity of $Tm(Cu_{0.98}Fe_{0.02})$ from 0 to 20 K compared to the low temperature prototype regenerator materials $HoCu_2$, ErNi, $Er_{50}Pr_{50}$.

FIG. 19 shows the volumetric heat capacity of $Tm(Cu_{1-x}M_x)$ doped alloys, where M=Fe and Ni, from about 3 to 20 K. Both alloying agents shift the two magnetic ordering temperatures to lower values and also cause a diminution of the heat capacity. As is evident in FIG. 20, the $Tm(Cu_{0.98}Fe_{0.02})$ alloy has a significantly higher heat capacity than $HoCu_2$ at 7 K, about twice as large, and would make a good low-temperature magnetic regenerator alloy. This is also true for $Tm(Cu_{0.98}Ni_{0.02})$, but its heat capacity is slightly lower than that for Fe substituted material (see FIG. 19). Both of these ternary alloys are ductile intermetallic compounds with the B2, CsCl-type structure.

Figure 21:
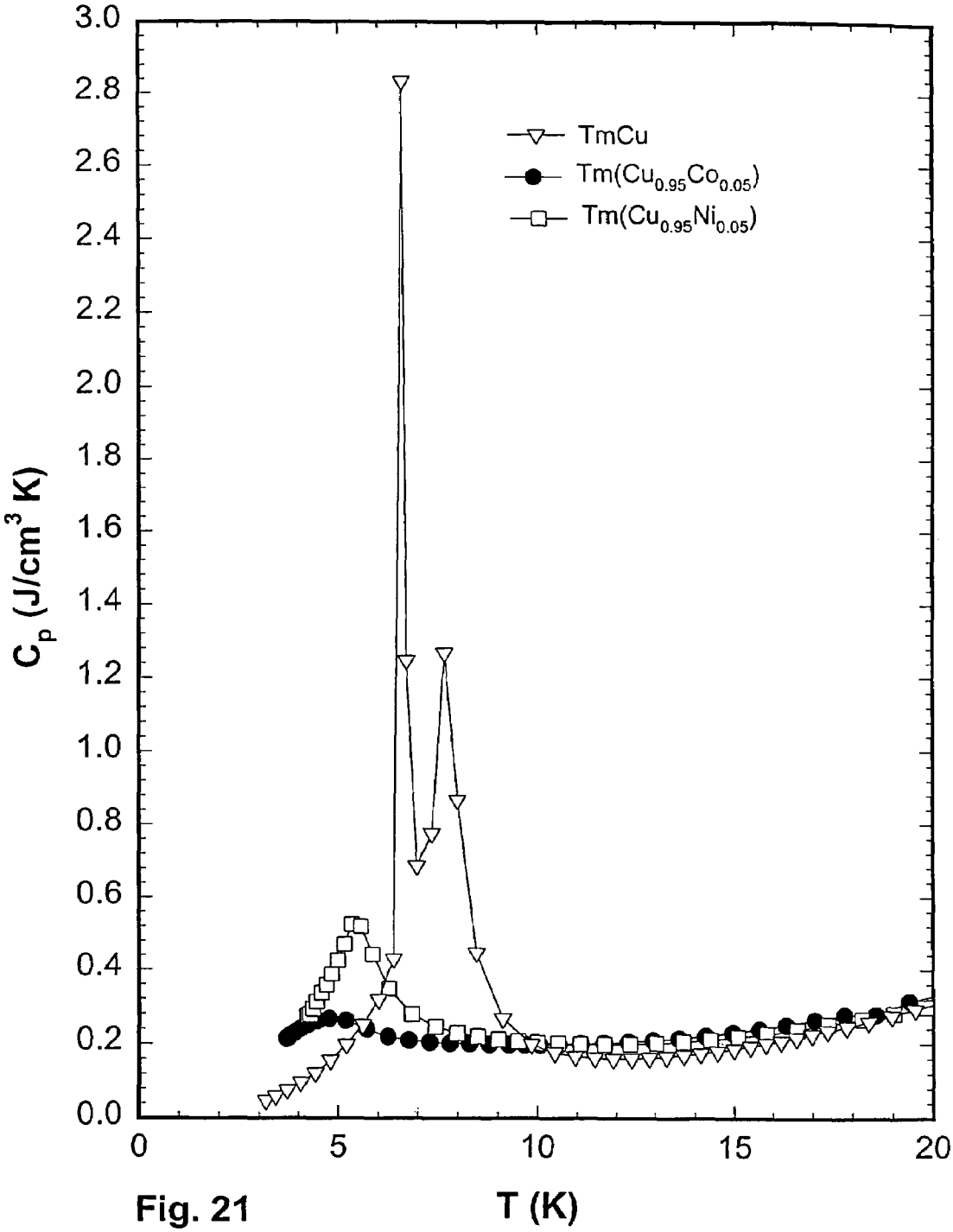
FIG. 21 is a graph which shows the volumetric heat capacity of TmCu and $Tm(Cu_{0.95}M_{0.05})$ doped alloys where M=Co and Ni, from 0 to 20 K.
Figure 22:
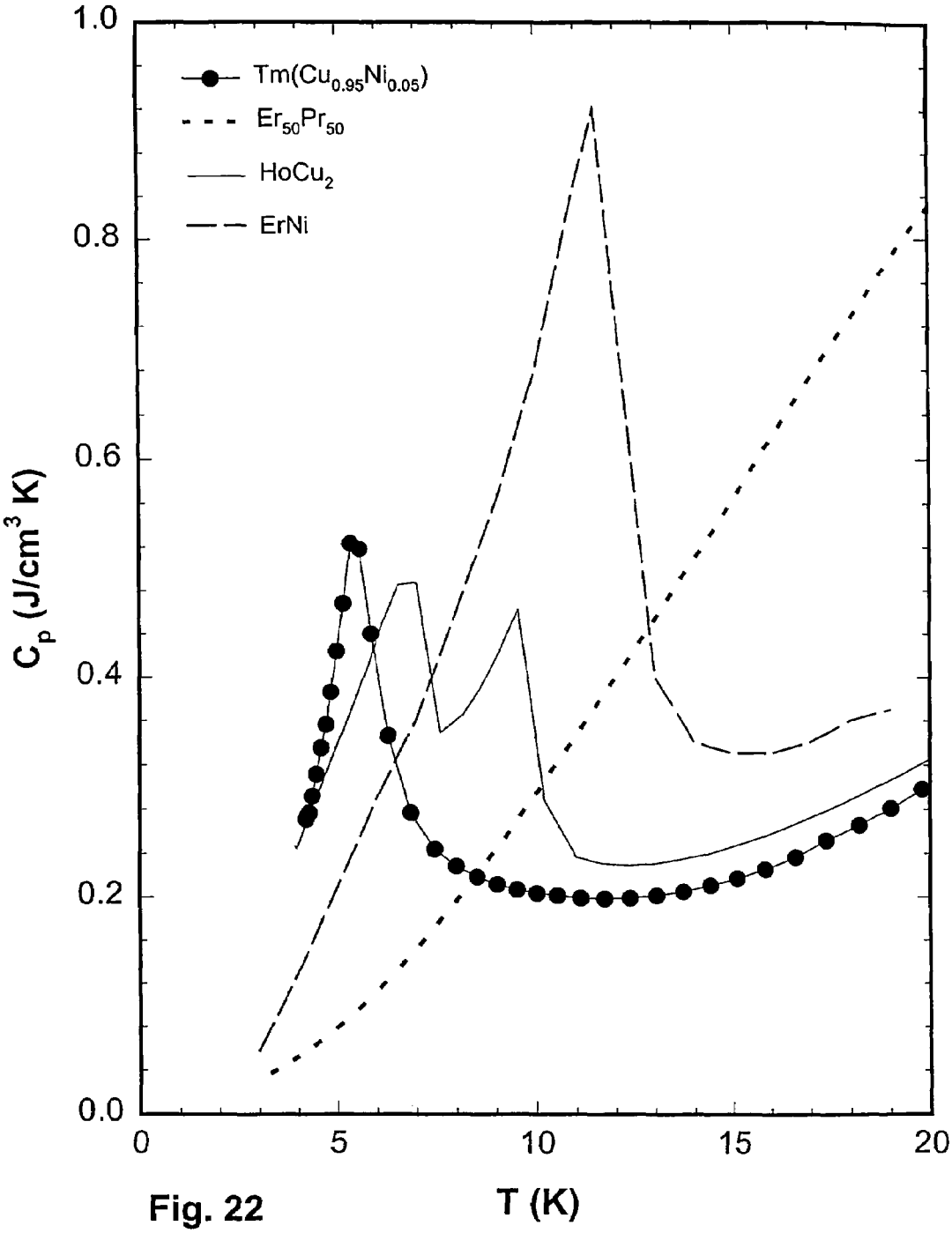
FIG. 22 is a graph which shows the volumetric heat capacity of $Tm(Cu_{0.95}Ni_{0.05})$ from 0 to 20 K compared to the low temperature prototype regenerator materials $HoCu_2$, ErNi, $Er_{50}Pr_{50}$.

The effect of the substitution of Cu by 5% Co and Ni on the volumetric heat capacity of TmCu is shown in FIG. 21. The two magnetic peaks in the TmCu are merged into one for both alloy additives, but the magnetic heat capacity values are drastically reduced, especially for the Co dopant. A comparison of the volumetric heat capacity of $Tm(Cu_{0.95}Ni_{0.05})$ with the standard prototypes $HoCu_2$, ErNi, $Er_{50}Pr_{50}$ is shown in FIG. 22. It is noted that the $Tm(Cu_{0.95}Ni_{0.05})$ would be a good magnetic regenerator material to reach temperatures below the lower temperature limit of $HoCu_2$. These $Tm(Cu_{0.95}M_{0.05})$ alloys have the B2, CsCl-type structure and are ductile.

Figure 23:
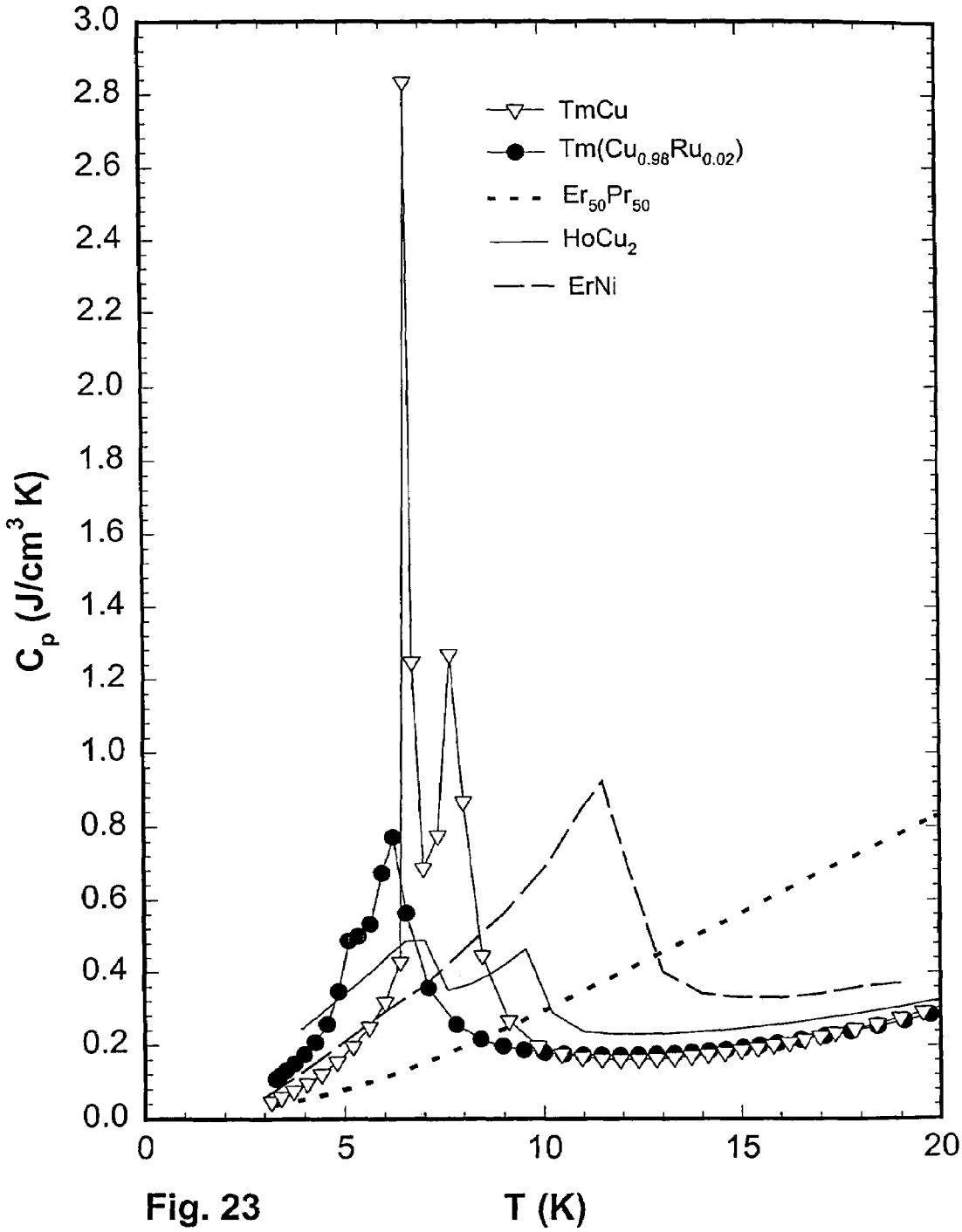
FIG. 23 is a graph which shows the volumetric heat capacity of $Tm(Cu_{0.98}Ru_{0.02})$ from 0 to 20 K compared to the low temperature prototype regenerator materials $HoCu_2$, ErNi, $Er_{50}Pr_{50}$.

The substitution of 2% ruthenium for Cu in TmCu is shown in FIG. 23. It is seen that this alloy has a higher heat capacity by about a factor of two over the low temperature peak of $HoCu_2$. This would make it a good regenerator material for cooling below the lower temperature limit of $HoCu_2$. This material has the B2, CsCl-type structure and is a ductile intermetallic compound.

Figure 24:
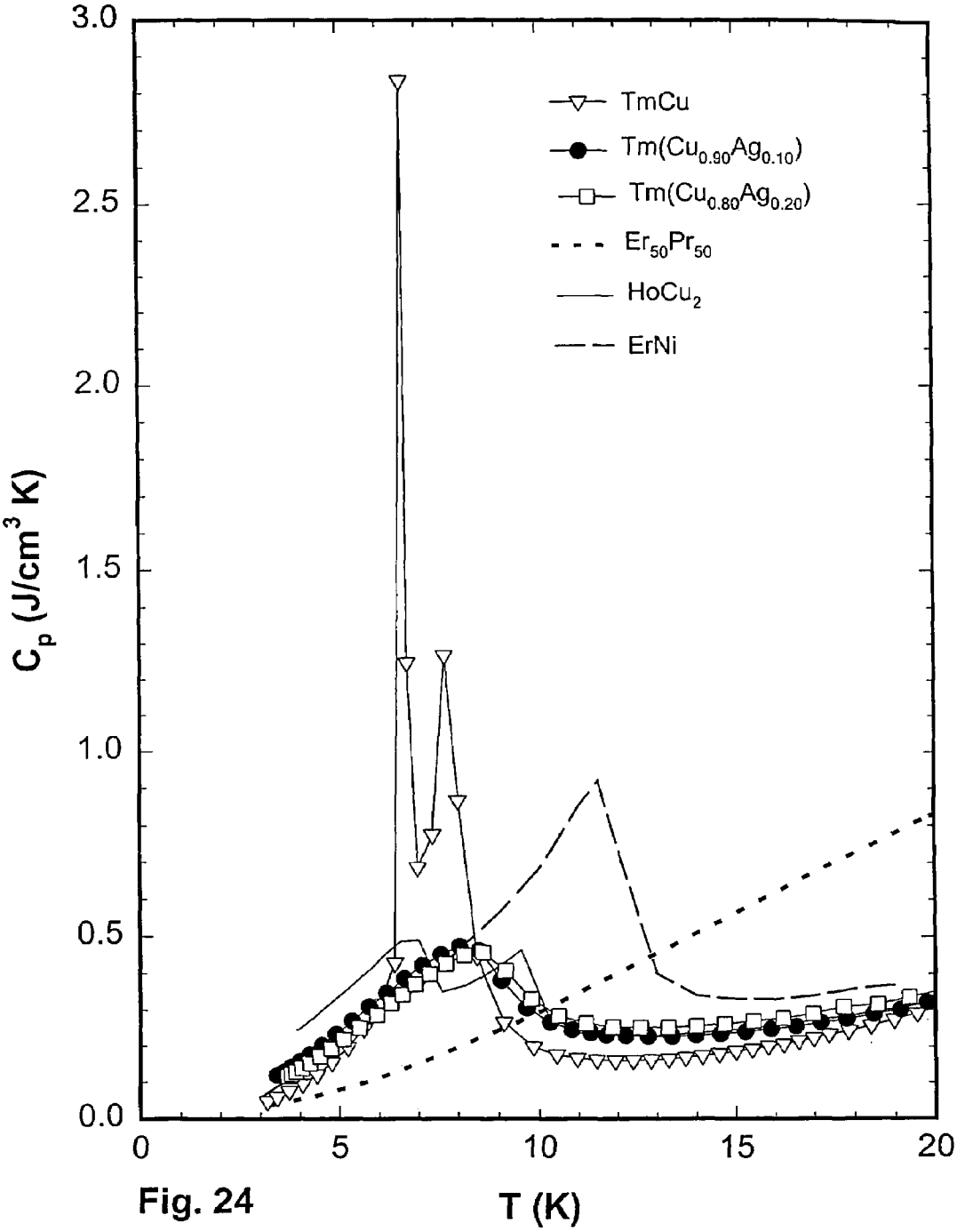
FIG. 24 is a graph which shows the volumetric heat capacity of $Tm(Cu_{1-x}Ag_x)$, where x=010 and 0.20, from 0 to 20 K compared to the low temperature prototype regenerator materials $HoCu_2$, ErNi, $Er_{50}Pr_{50}$.

FIG. 24 shows that the volumetric heat capacity of $Tm(Cu_{1-x}Ag_x)$ doped intermetallic compound for x=0.1 and 0.2 from 3 to 20 K. The two peaks of TmCu are significantly reduced but the heat capacity of both the $Tm(Cu_{1-x}Ag_x)$ alloys is comparable to that of $HoCu_2$ from about 7 K to 20 K, and just slightly smaller from 4 K to 7 K. The volumetric heat capacity of the ErNi and $Er_{50}Pr_{50}$ prototype regenerator material are also shown in this figure. The ternary $Tm(Cu_{1-x}Ag_x)$ intermetallic compound is ductile and has the B2, CsCl type structure.

Figure 25:
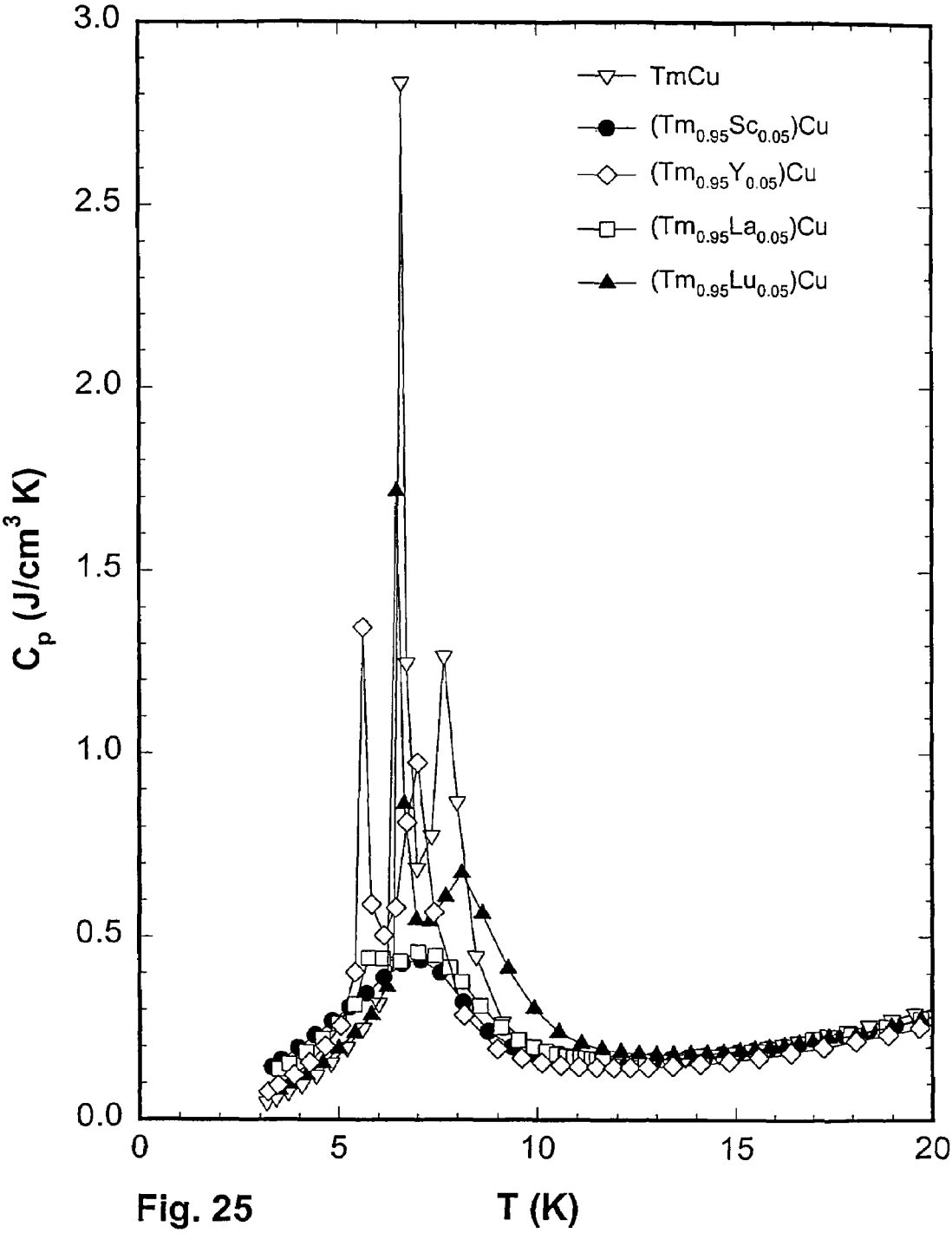
FIG. 25 is a graph which shows the volumetric heat capacity of TmCu and $(Tm_{0.95}R_{0.05})Cu$ doped alloys where R=Sc, Y, La and Lu, from 0 to 20 K.
Figure 26:
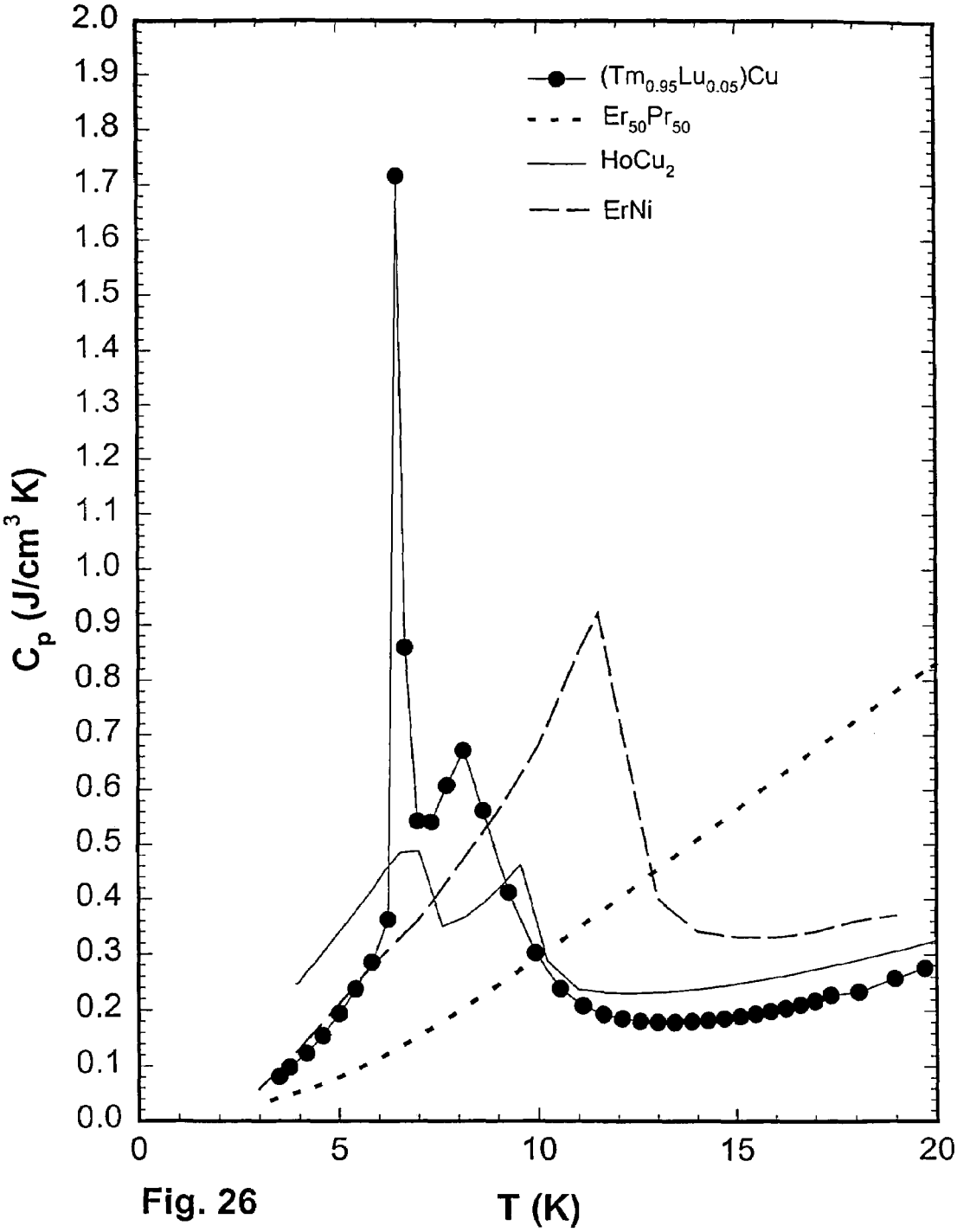
FIG. 26 is a graph which shows the volumetric heat capacity of $(Tm_{0.95}Lu_{0.05})Cu$, from 0 to 20 K compared to the low temperature prototype regenerator materials $HoCu_2$, ErNi, $Er_{50}Pr_{50}$.

The substitution of the non-magnetic rare earth metals for Tm, i.e. $(Tm_{0.95}R_{0.05})Cu$, is TmCu is shown in FIG. 25. Sc and La cause the two peaks to merge and substantially lower the volumetric heat capacity of TmCu, so that it is slightly lower than that of the $HoCu_2$ prototype. Both Y and Lu lower the heat capacity of both peaks of TmCu. However, Y shifts both peaks to lower temperatures and closer together so that its heat capacity is much greater than the lower peak of $HoCu_2$, but quite a bit lower than the lower peak of $HoCu_2$ (also see the next paragraph below). Lu on the other hand, causes the upper temperature to shift to a higher temperature (about 1 K) while the lower ordering peak remains unchanged from that of TmCu (see FIG. 26). This alloy would make an excellent replacement for $HoCu_2$ as a low temperature cryocooler alloy. All of the non-magnetic rare earth doped TmCu alloys above the B2, CsCl type structure and are ductile ternary intermetallic compounds.

Figure 27:
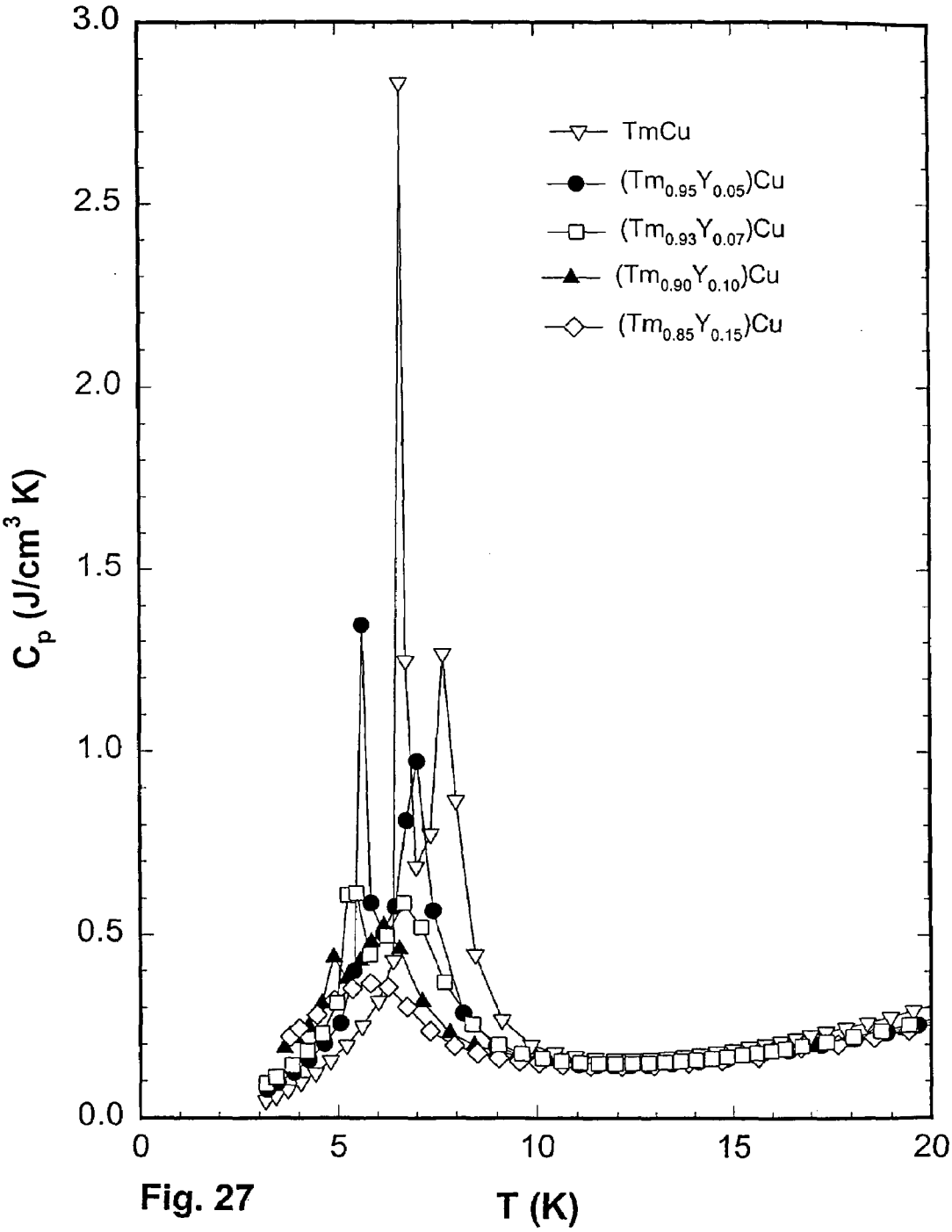
FIG. 27 is a graph which shows the volumetric heat capacity of TmCu and $(Tm_{1-l\ Yx})Cu$ doped alloys where x=0.05, 0.07, 0.10 and 0.15, from 0 to 20 K.
Figure 28:
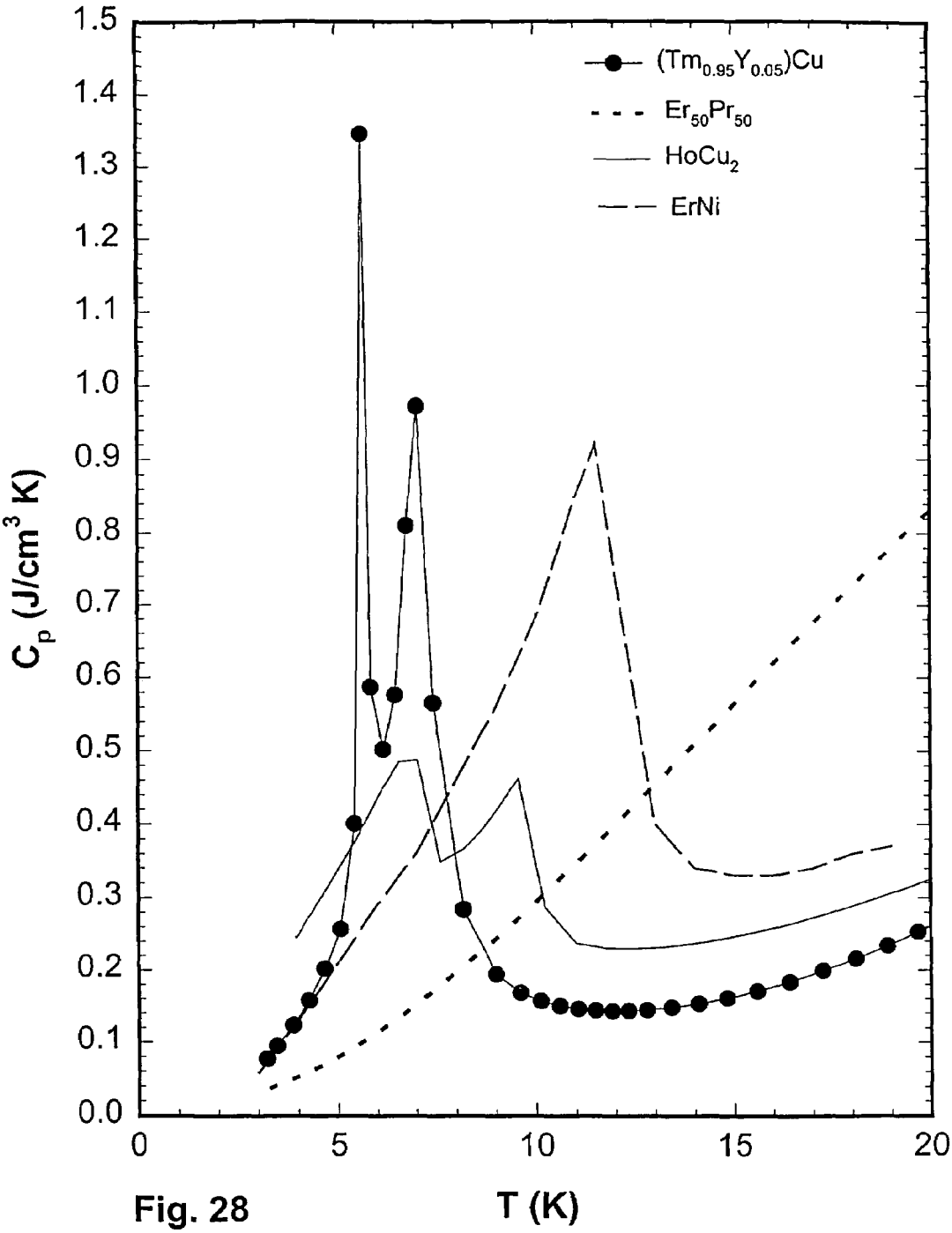
FIG. 28 is a graph which shows the volumetric heat capacity of $(Tm_{0.95}Y_{0.05})Cu$, from 0 to 20 K compared to the low temperature prototype regenerator materials $HoCu_2$, ErNi, $Er_{50}Pr_{50}$.

The influence of Y additions (up to 15%) substituting for Tm in TmCu, i.e. $(Tm_{1-x}Y_x)Cu$, are shown in FIG. 27. The temperatures and the peak volumetric heat capacities values are lowered by Y doping. The upper peak temperature drops more rapidly than the lower one, so that they merge for x=0.15. The volumetric heat capacity of $(Tm_{0.95}Y_{0.05})Cu$ is compared to those of the three low-temperature cryocooler prototype regenerator materials (see FIG. 28). This alloy would be a good regenerator material for cooling down to about 5 K. All of the $(Tm_{1-x}Y_x)Cu$ intermetallic compounds are ductile with the B2, CsCl type structure.

Figure 29:
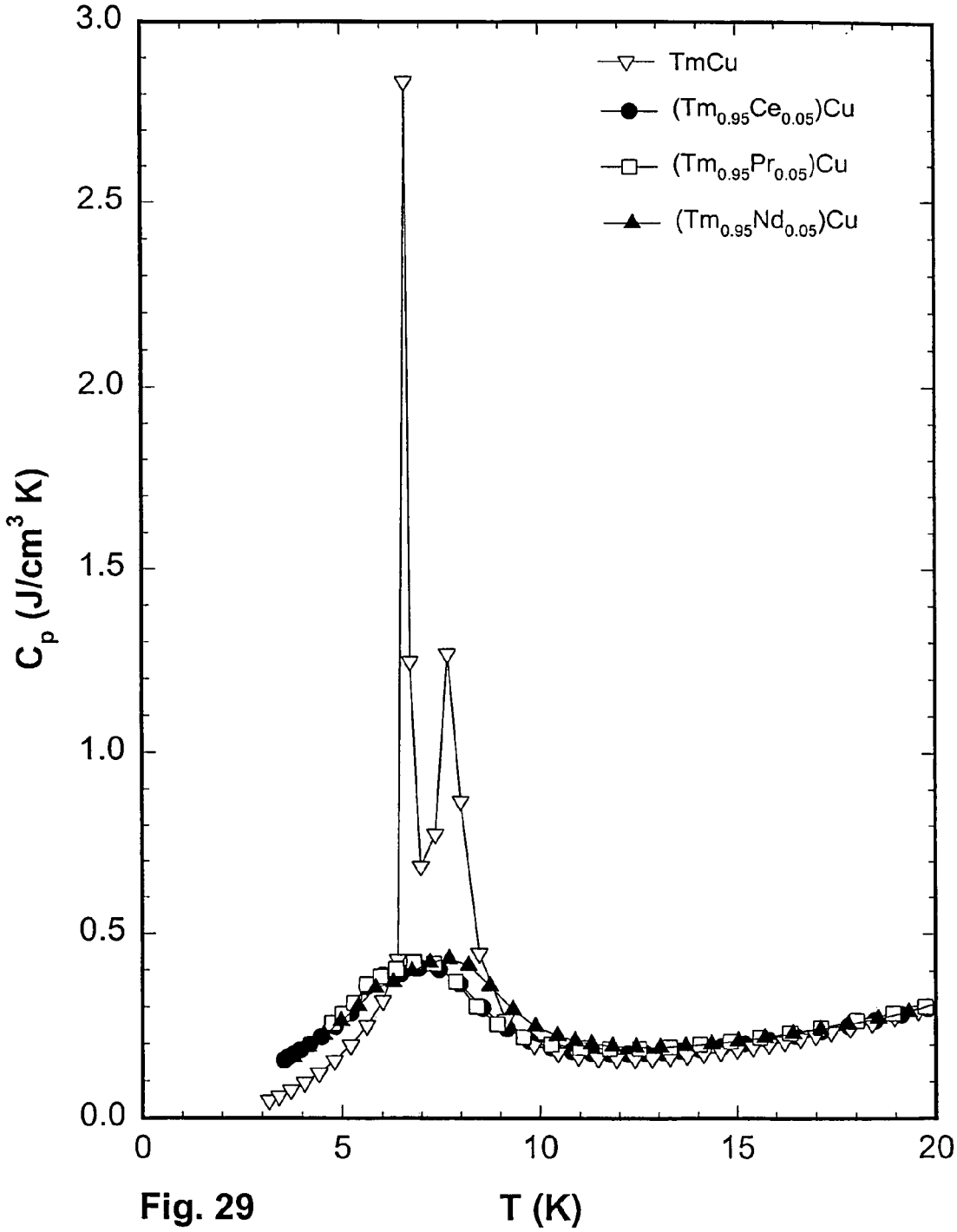
FIG. 29 is a graph which shows the volumetric heat capacity of TmCu and $(Tm_{0.95}R_{0.05})Cu$ doped alloys where R=Ce, Pr, and Nd, from 0 to 20 K.
Figure 30:
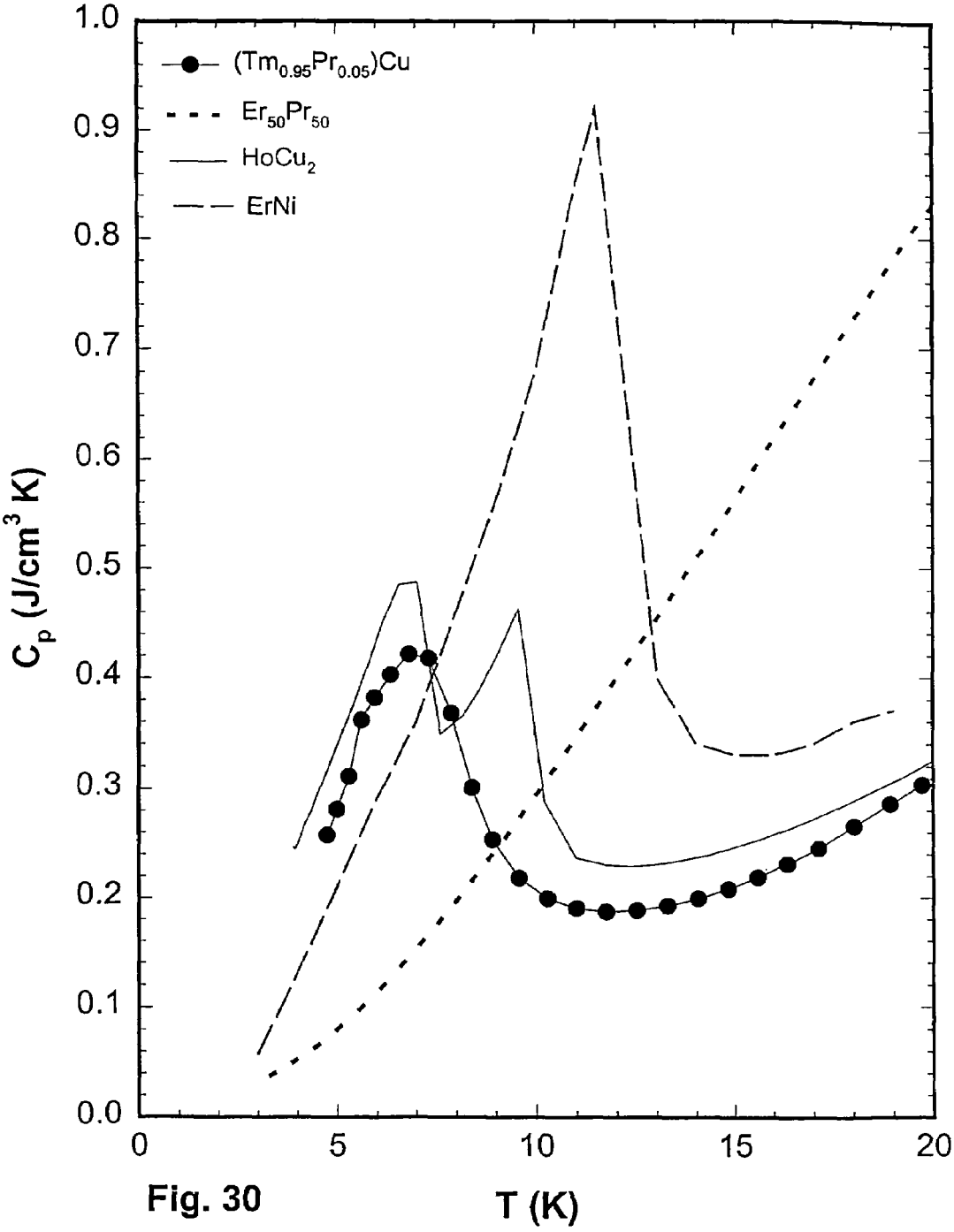
FIG. 30 is a graph which shows the volumetric heat capacity of $(Tm_{0.95}Pr_{0.05})Cu$, from 0 to 20 K compared to the low temperature prototype regenerator materials $HoCu_2$, ErNi, $Er_{50}Pr_{50}$.

The substitution of 5% of the light magnetic lanthanide metals (Ce, Pr and Nd) for Tm in TmCu, i.e. $(Tm_{0.95}R_{0.05})Cu$, wipes out the peaks of pure TmCu, see FIG. 29. The resultant volumetric heat capacities are essentially the same as for $(Tm_{0.95}La_{0.05})Cu$, see FIG. 25, and are slightly smaller than that of $HoCu_2$. This is shown in FIG. 30 for $(Tm_{0.95}Pr_{0.05})Cu$.

Figure 31:
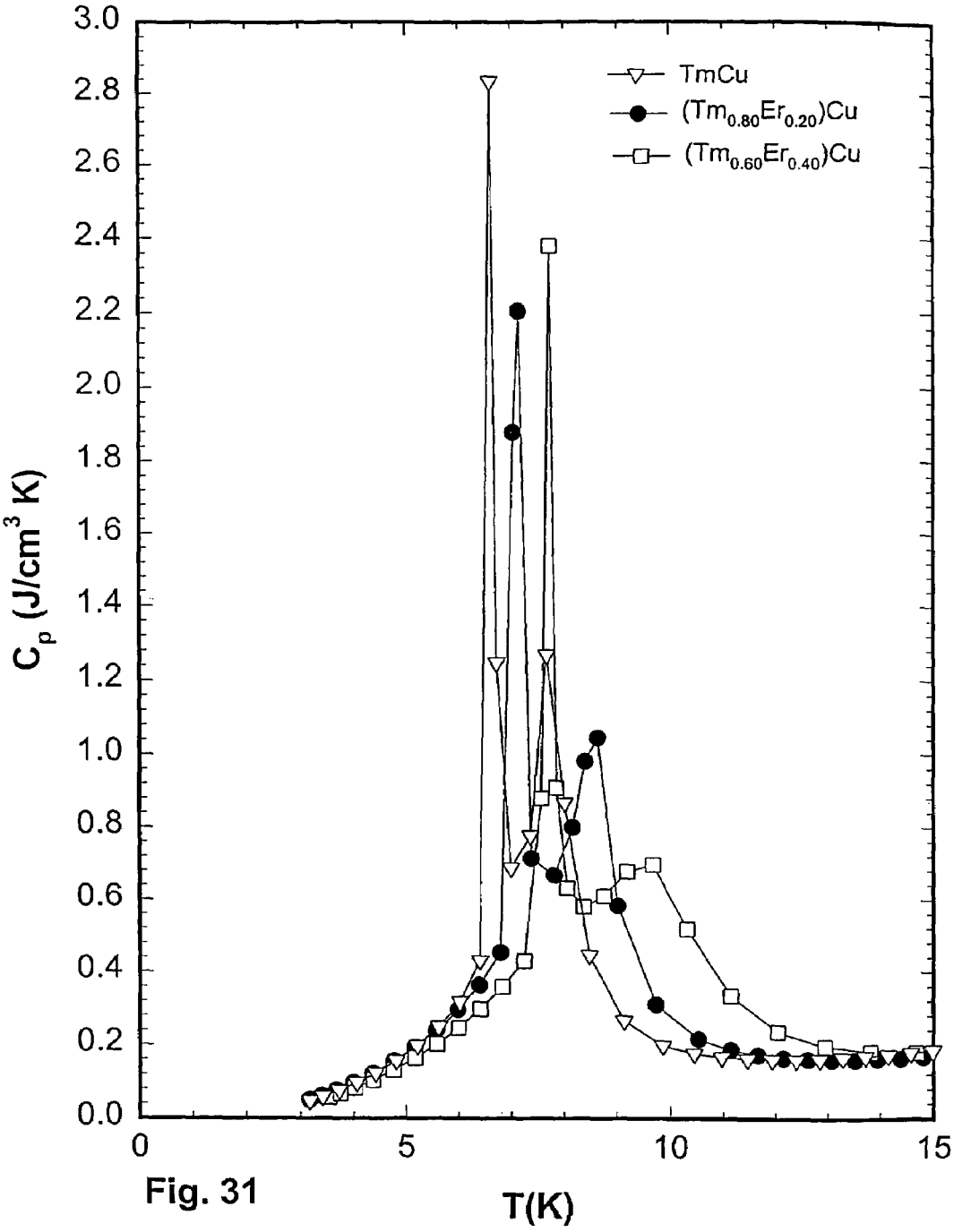
FIG. 31 is a graph which shows the volumetric heat capacity of TmCu and $(Tm_{1-x}Er_x)Cu$ doped alloys where x=0.20 and 0.40, from 0 to 20 K.
Figure 32:
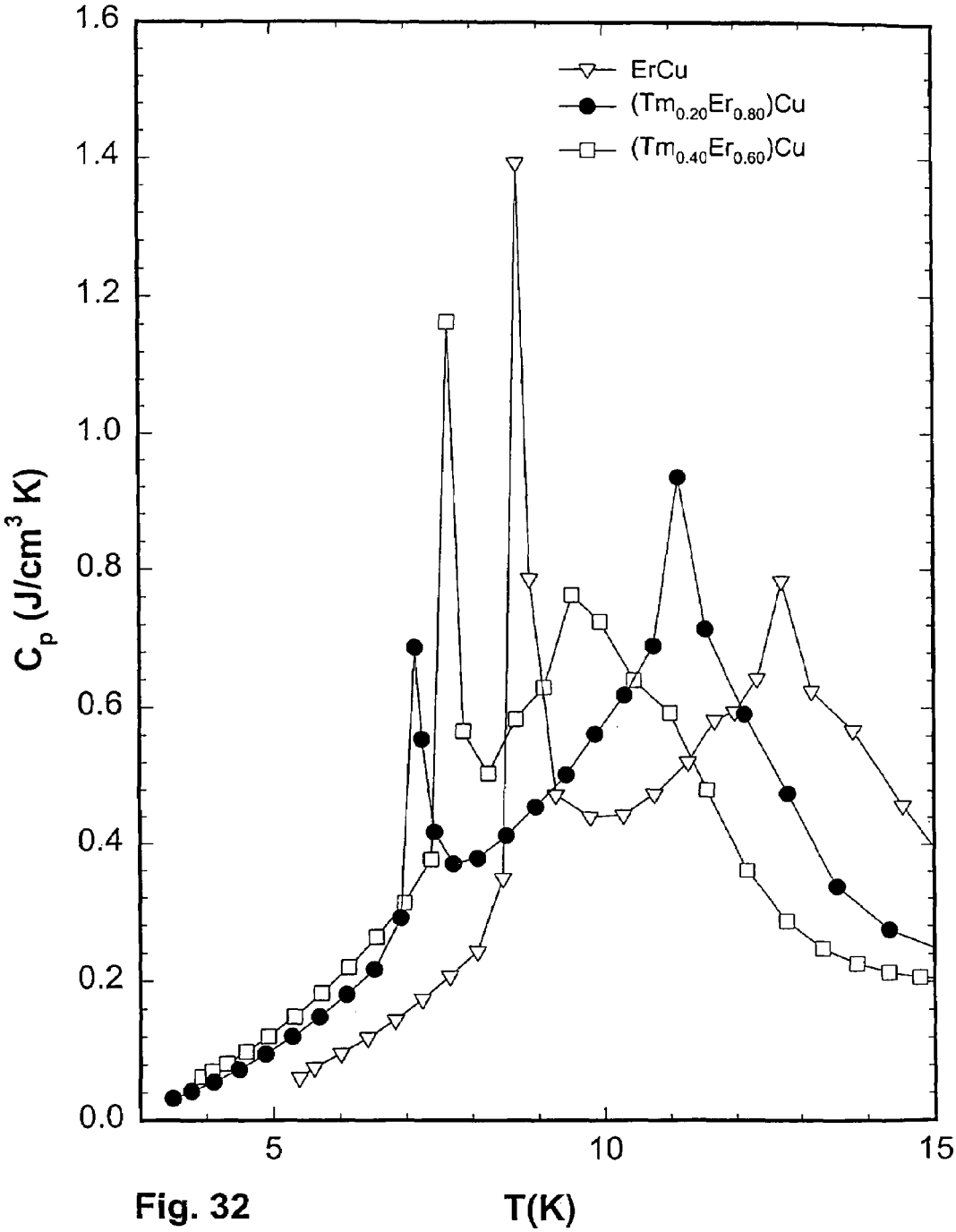
FIG. 32 is a graph which shows the volumetric heat capacity of ErCu and $(Er_{1-x}Tm_x)Cu$ doped alloys where x=0.20 and 0.40, from 0 to 15 K.
Figure 33A:
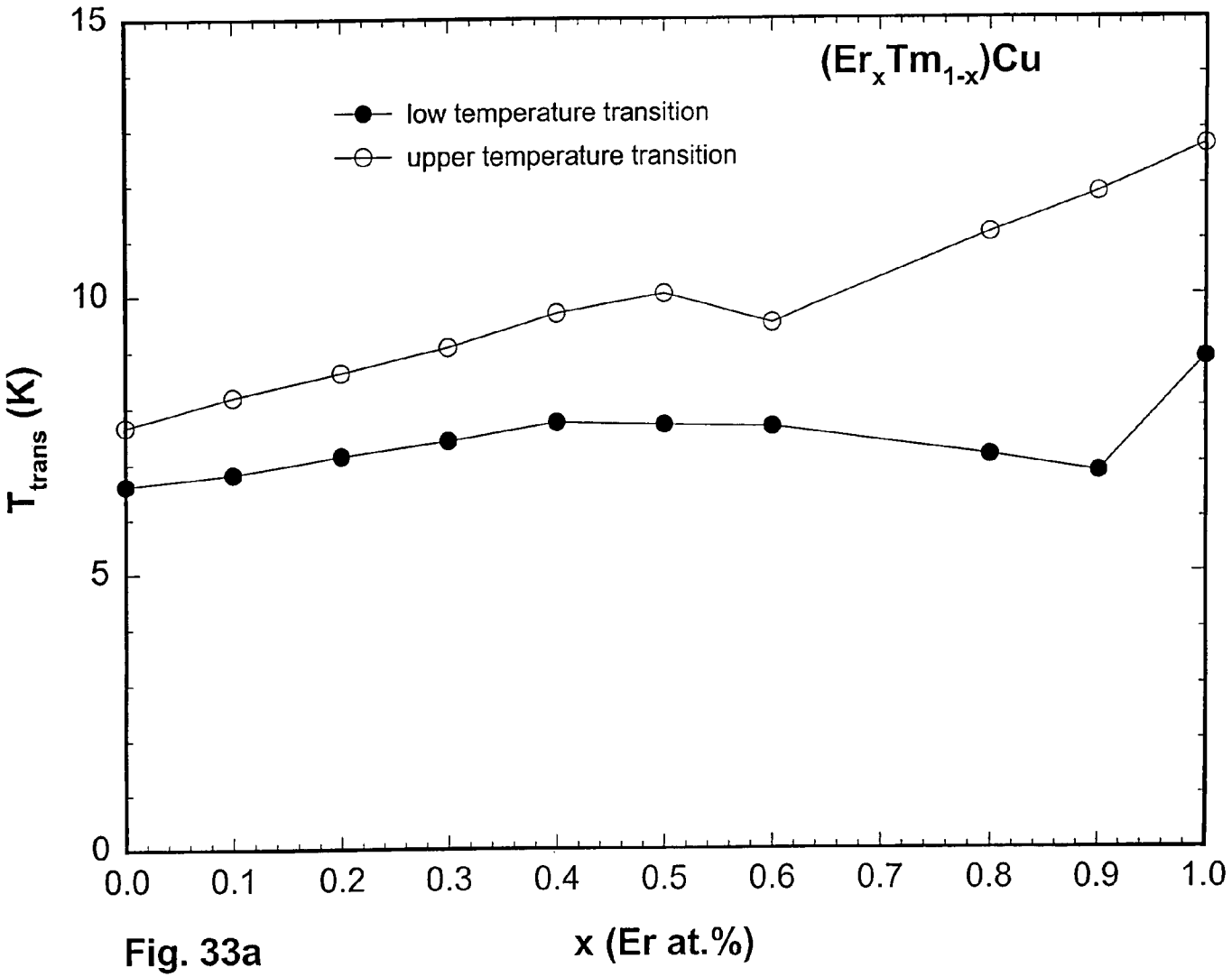
FIGS. 33*a* and 33*b* are a plot of the magnetic ordering transition temperatures of the $(Tm_{1-x}Er_x)Cu$ alloys (FIG. 33*a*) and a plot of the maximum values volumetric heat capacity at the ordering temperatures of $(Tm_{1-x}Er_x)Cu$ alloys (FIG. 33*b*) as a function of x from x=0 to x=1.0.
Figure 33B:
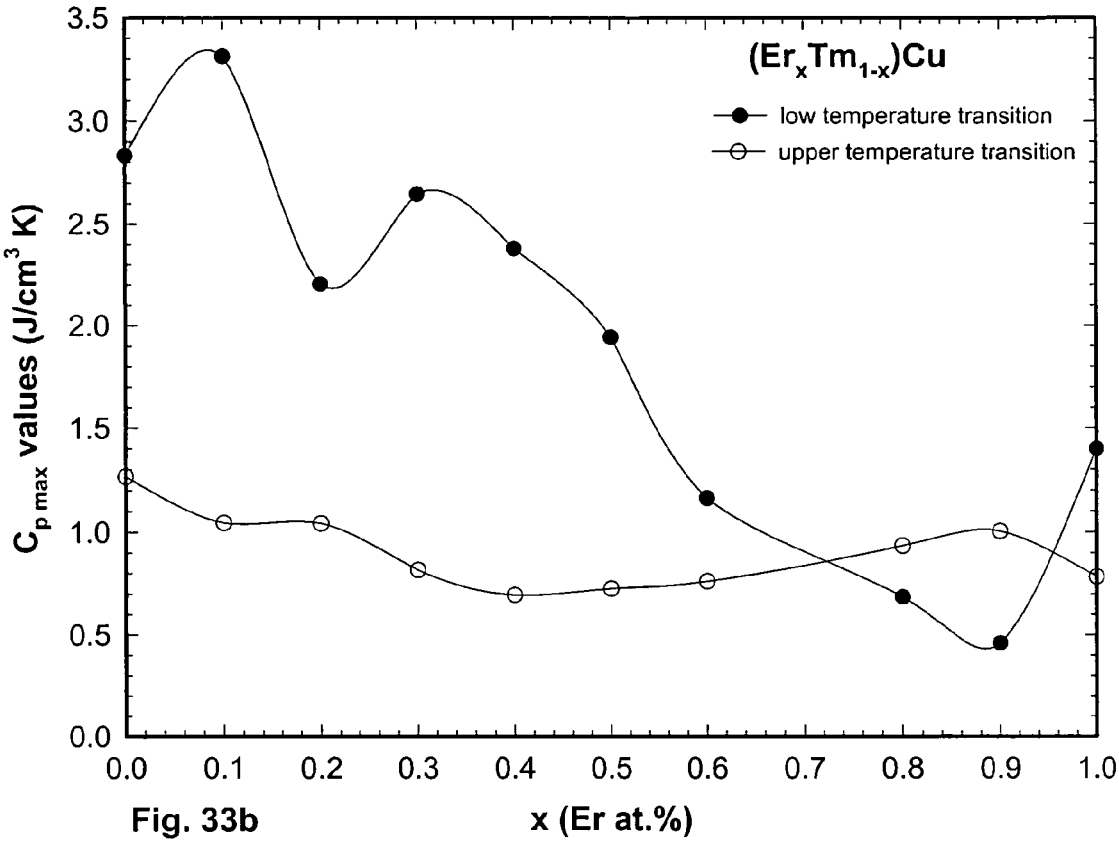
Figure 34:
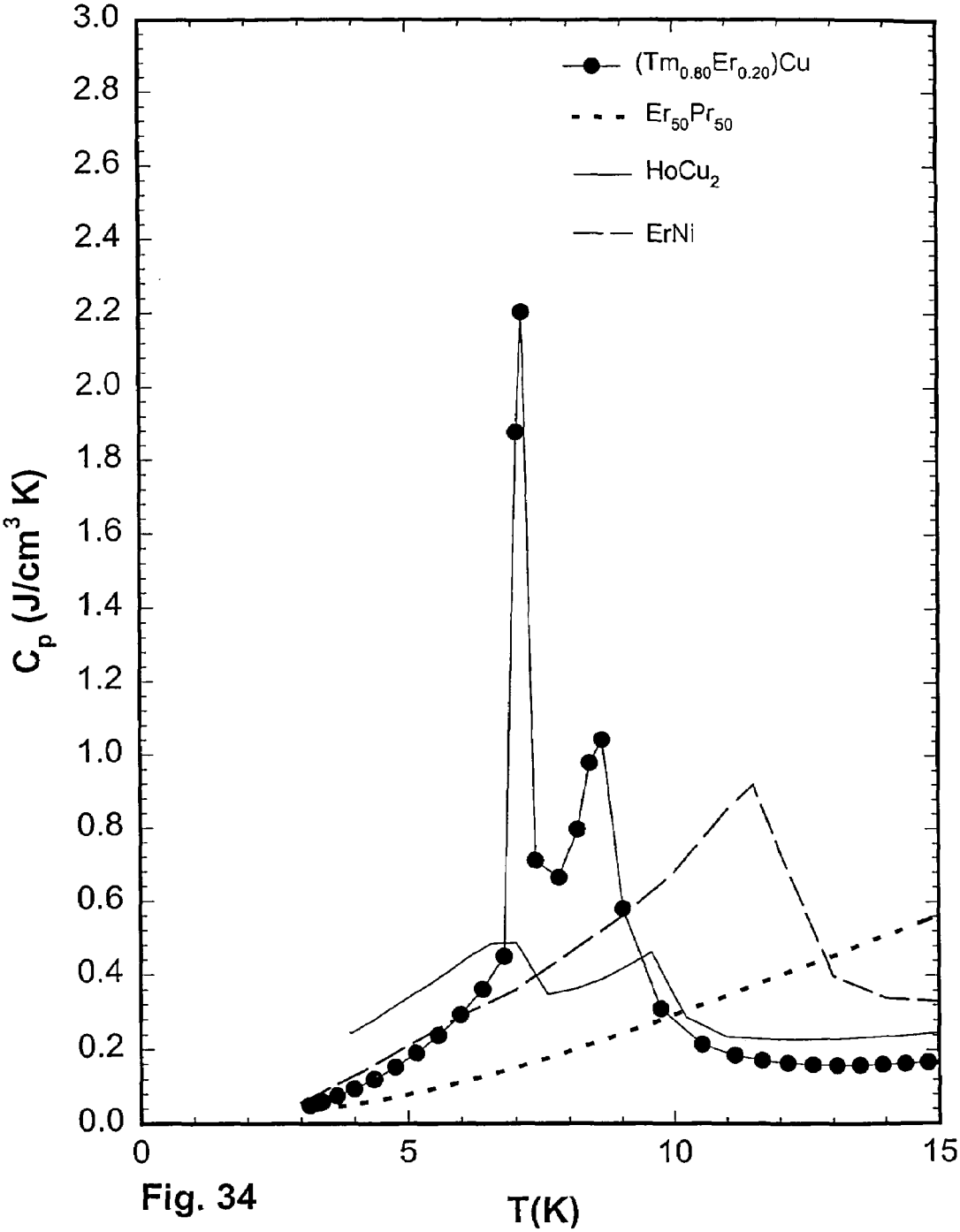
FIG. 34 is a graph which shows the volumetric heat capacity of $(Tm_{0.08}Er_{0.20})Cu$, from 0 to 15 K compared to the low temperature prototype regenerator materials $HoCu_2$, ErNi, $Er_{50}Pr_{50}$.
Figure 35:
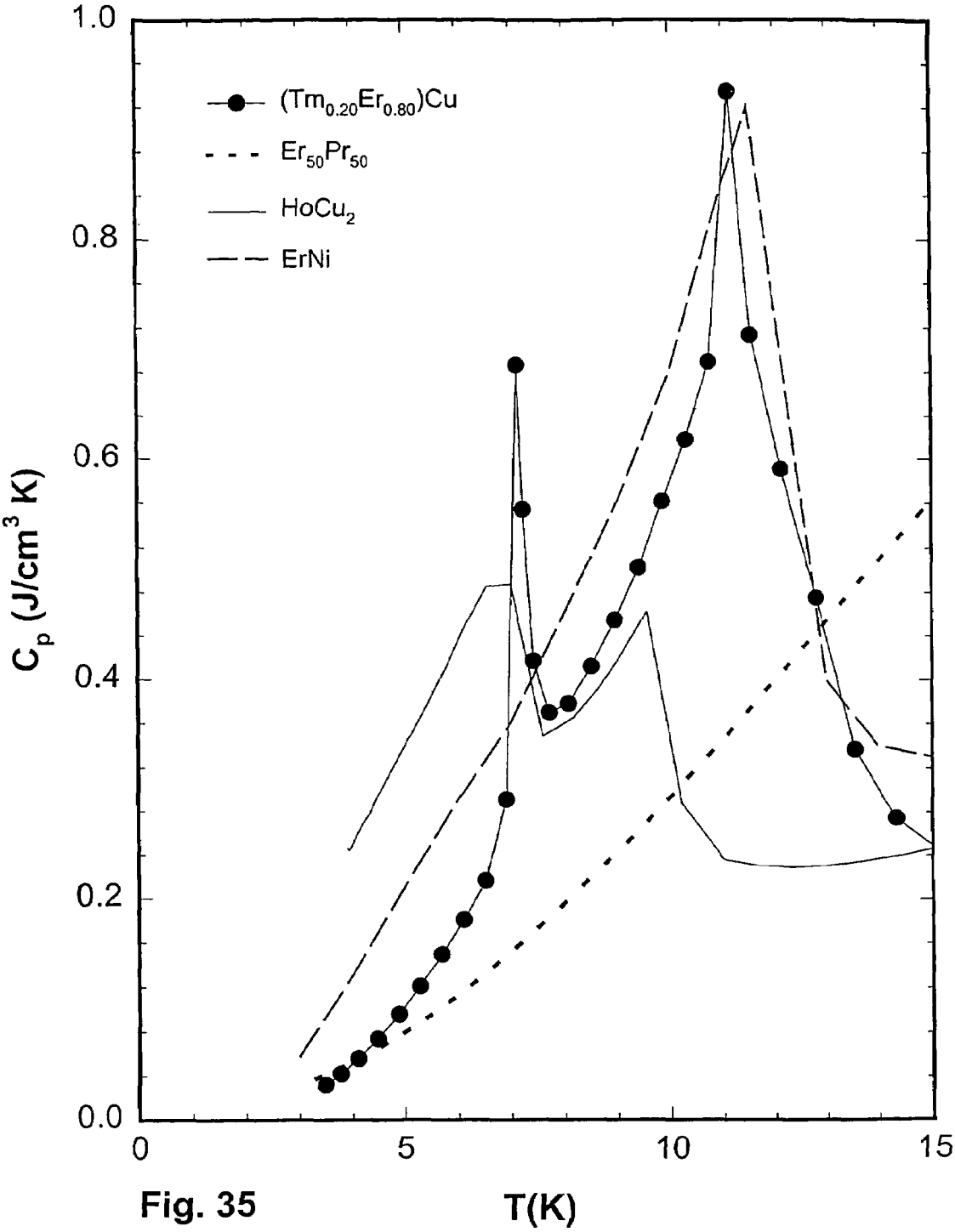
FIG. 35 is a graph which shows the volumetric heat capacity of $(Er_{0.08}Tm_{0.20})Cu$, from 0 to 15 K compared to the low temperature prototype regenerator materials $HoCu_2$, ErNi, $Er_{50}Pr_{50}$.

The effect of the substitution of Er for Tm (Tm-rich alloys) and Tm for Er (Er-rich alloys) on the volumetric heat capacity in the $(Tm_{1-x}Er_x)Cu$ psuedobinary system is shown in FIGS. 31 and 32, respectively. In general, as x increases, the two ordering peaks shift slowly to higher temperatures, and the maximum heat capacity values of the two peaks slowly decrease (the upper one more so and the lower one hardly at all). This is shown in FIGS. 33*a* and 33*b*, respectively. FIG. 34 compares the volumetric heat capacity of $(Tm_{0.8}Er_{0.2})Cu$ with those of the $HoCu_2$, ErNi, $Er_{50}Pr_{50}$ prototype cryocooler regenerator materials. It shows that $(Tm_{0.8}Er_{0.2})Cu$ would be a good replacement alloy for $HoCu_2$ as the lowest temperature regenerator alloyed in a layered bed. FIG. 35 compares the volumetric heat capacity of $(Tm_{0.2}Er_{0.8})Cu$ with the three prototype materials $HoCu_2$, ErNi, $Er_{50}Pr_{50}$. It is seen that this ductile ternary intermetallic compound would be an excellent replacement regenerator alloy for the brittle ErNi prototype material. All of the magnetic lanthanide substituted $(Tm_{1-x}R_x)Cu$ alloys have the B2, CsCl-type structure and are ductile.

Figure 36:
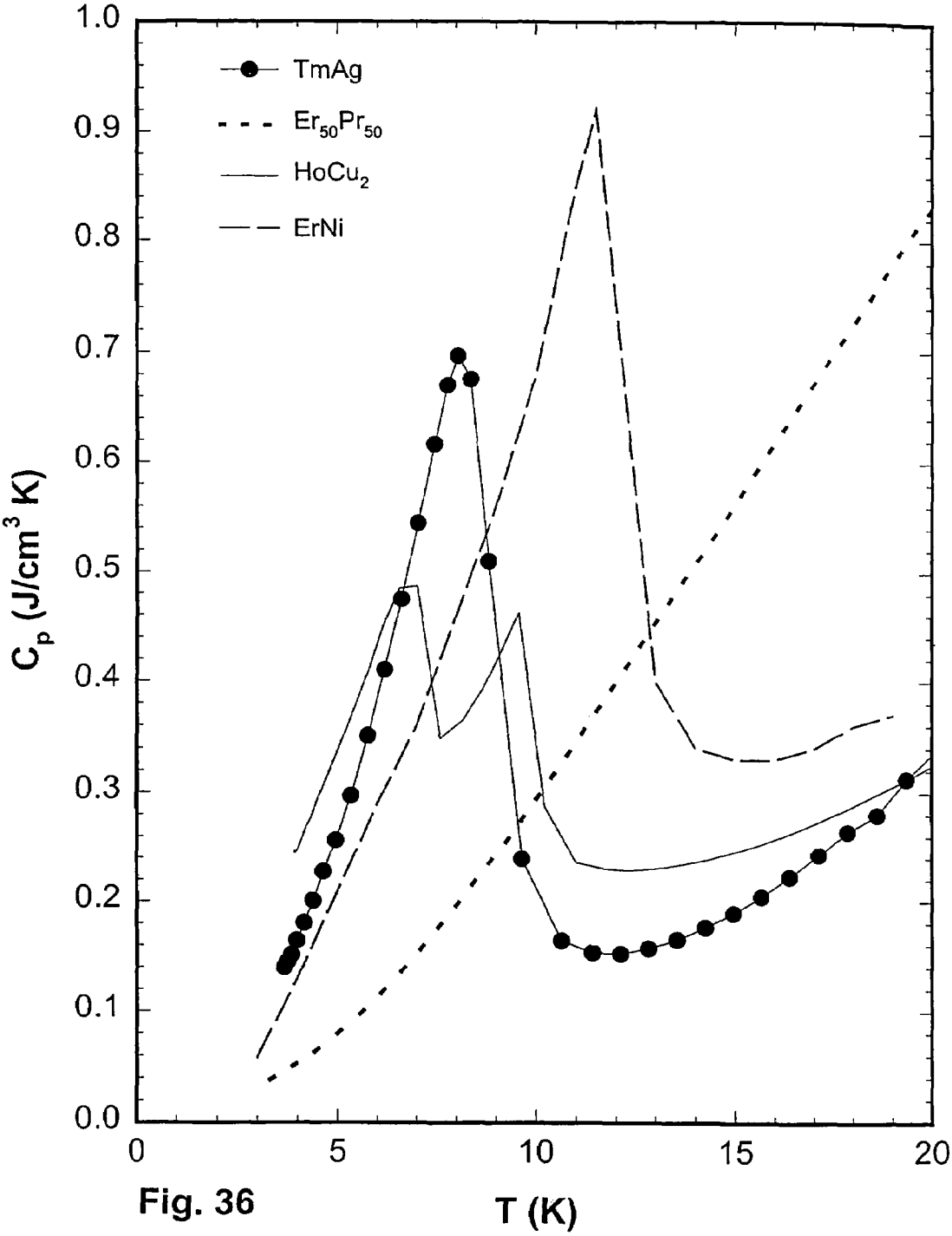
FIG. 36 is a graph which shows the volumetric heat capacity of TmAg, from 0 to 20 K compared to the low temperature prototype regenerator materials $HoCu_2$, ErNi, $Er_{50}Pr_{50}$.

FIG. 36 is a graph of the volumetric heat capacity of TmAg from about 4 K to 20 K. Also shown are volumetric heat capacities of $HoCu_2$, ErNi, $Er_{50}Pr_{50}$. It is seen that TmAg is a good regenerator material for the 5 K to 9 K region, and should be quite competitive with $HoCu_2$. TmAg is a ductile intermetallic compound and has the B2, CsCl-type crystal structure.

Figure 4A:
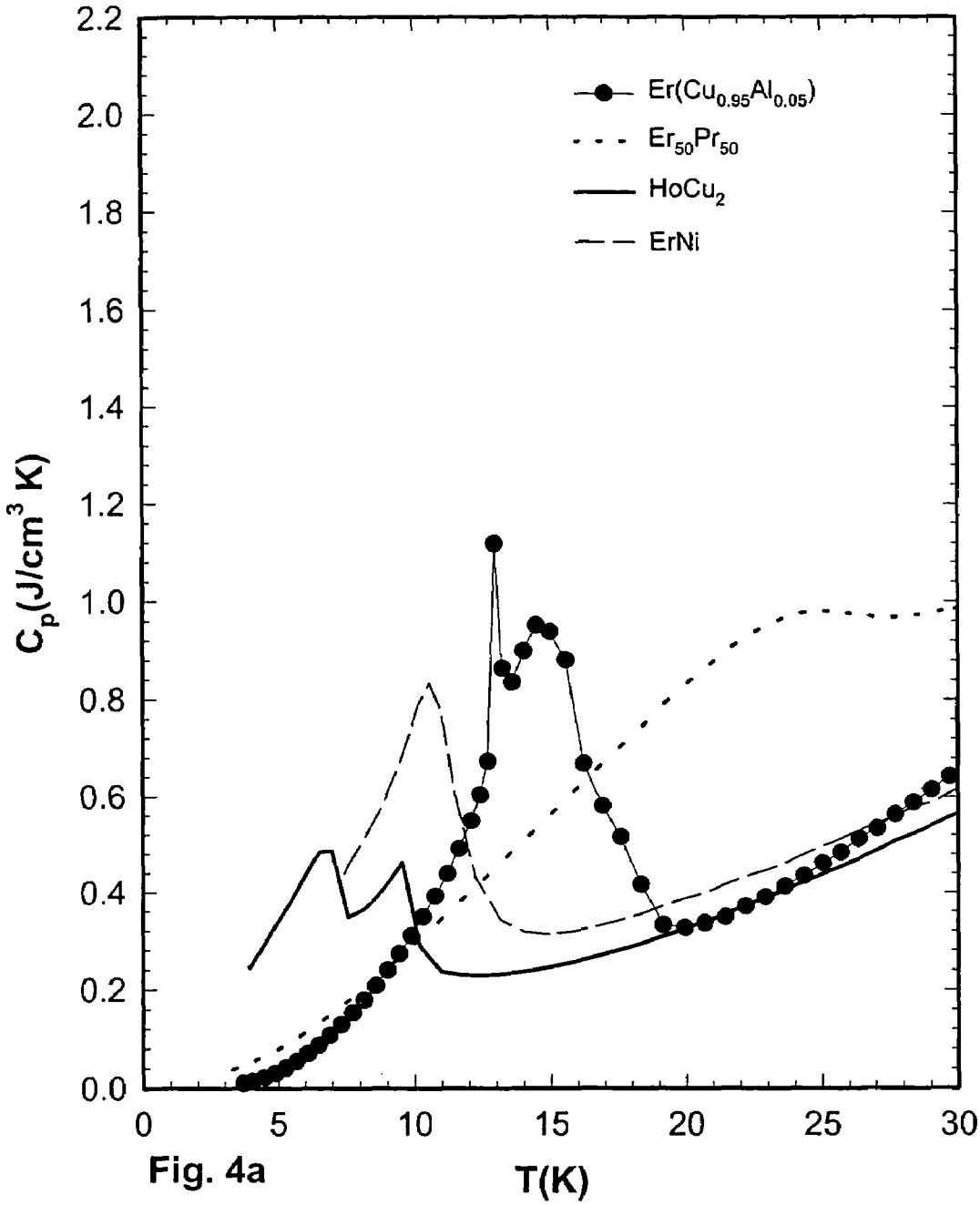
FIGS. 4*a* and 4*b* are graphs which show the volumetric heat capacity of $Er(Cu_{0.95}Al_{0.05})$ and $Er(Cu_{0.95}Ga_{0.05})$, respectively, from 0 to 30 K compared to the low temperature prototype regenerator materials $HoCu_2$, ErNi, $Er_{50}Pr_{50}$.
Figure 4B:
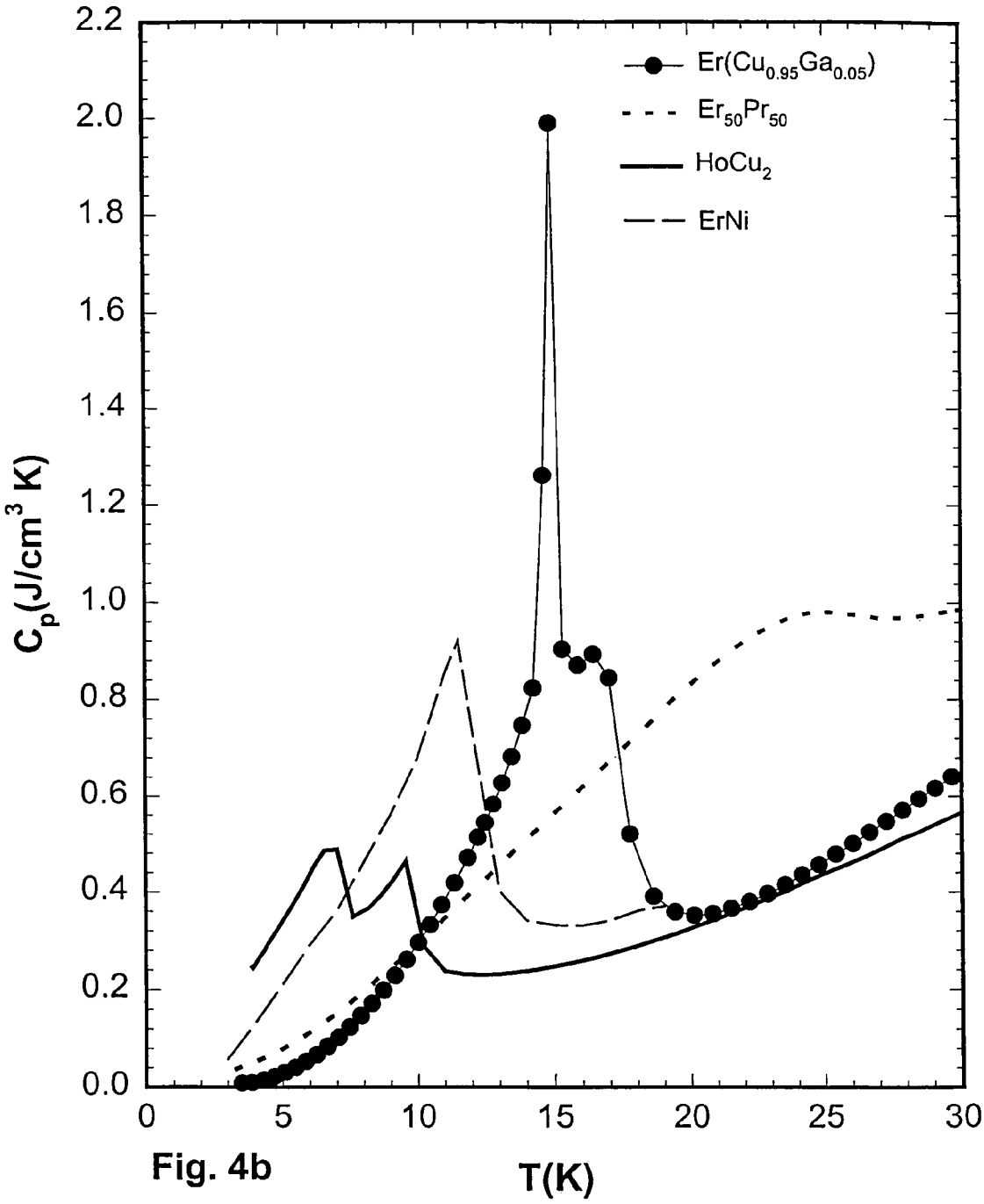
Figure 37:
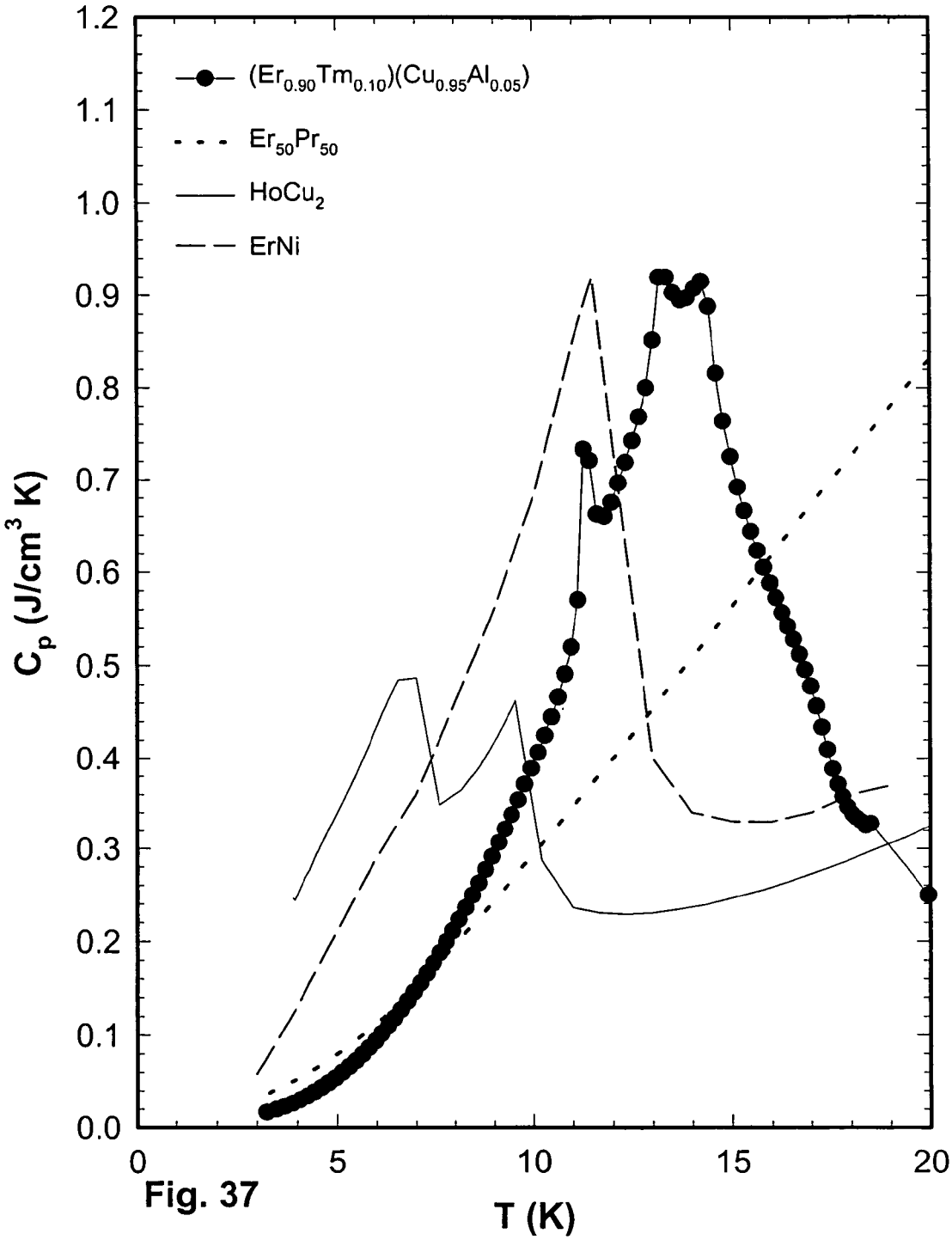
FIG. 37 is a graph which shows the volumetric heat capacity of $(Er_{0.90}Tm_{0.10})(Cu_{0.95}Al_{0.05})$ from 0 to 20K compared to the low temperature prototype regenerator materials $HoCu_2$, ErNi, $Er_{50}Pr_{50}$.
Figure 38:
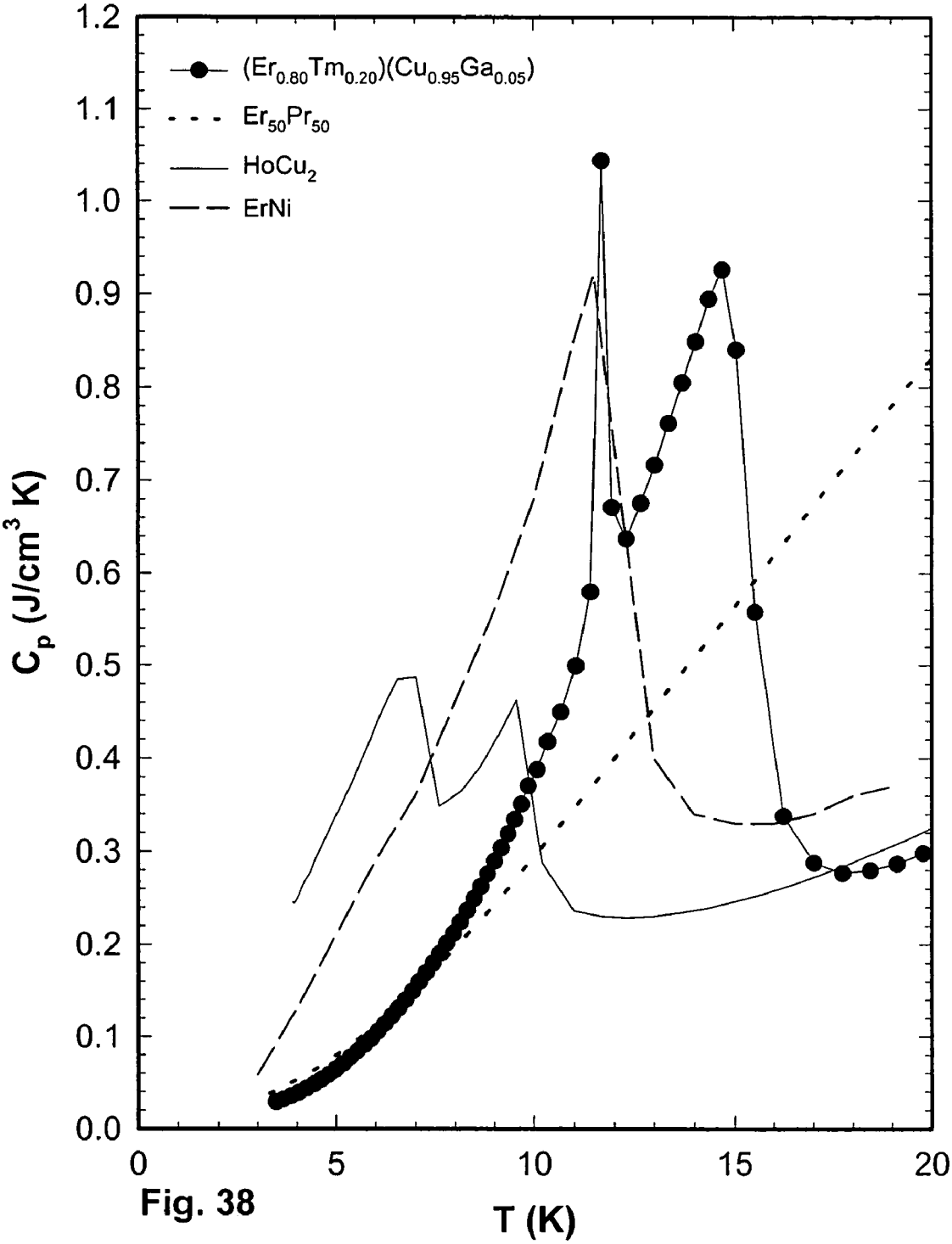
FIG. 38 is a graph which shows the volumetric heat capacity of $(Er_{0.80}Tm_{0.20})(Cu_{0.95}Ga_{0.05})$ from 0 to 20K compared to the low temperature prototype regenerator materials $HoCu_2$, ErNi, $Er_{50}Pr_{50}$.

As shown in FIGS. 3, 4*a*, and 4*b*, substitution of 5 atomic % of the Cu in ErCu by Al or Ga causes a large shift to higher temperatures while still retaining the large heat capacity values; i.e. compare these three figures with the heat capacity of ErCu shown in FIG. 2. Also as shown in FIGS. 33*a* and 33*b*, the substitution of Tm for Er slowly lowers the ordering temperatures (FIG. 33*a*) while retaining the high heat capacities (FIG. 33*b*). Thus it may be possible to fine tune the ordering temperatures by subtitution of some of the Er by Tm in the Al and Ga doped alloys for Cu. This has been demonstrated for two alloy compositions $(Er_{0.90}Tm_{0.10})(Cu_{0.95}Al_{0.05})$, as shown in FIG. 37, and for $(Er_{0.80}Tm_{0.20})(Cu_{0.95}Ga_{0.05})$, as shown in FIG. 38. In the former case, the addition of 10 atomic % Tm for Er lowers the ordering temperatures by about 2K with a small reduction of the heat capacity value of the lower temperature peak, compare FIG. 37 with FIG. 4*a*. In the latter case, the addition of 20 atomic % Tm for Er lowers the magnetic ordering temperature by about 3K with a significant reduction of the lower temperature heat capacity peak value. These results show that the magnetic ordering temperature can be adjusted without a major decrease in the magnetic heat capacity by Tm substitutions for Er provided the alloying addition concentration is less than 20 atomic %.

Most of the ErM and TmM materials described above would be useful cryocooler regenerator materials for the low temperature stage of a multi-stage cryocooler to reach temperatures <15 K, and are excellent candidate materials to replace the prototype regenerator materials $HoCu_2$ and ErNi. Not only are their volumetric heat capacities greater than (especially for $HoCu_2$) or comparable to those of the two prototype materials, but they are ductile materials, which allows them to be fabricated into wires, sheets, screens, etc. in addition to spheres. The prototype materials are brittle and can only be fabricated into spheres to be utilized as regenerator materials. As it turns out, parallel plates (sheets) and screens configurations as regenerator components are much more efficient than spherical particles. Thus, the ErM and TmM materials have two distinct advantages over the $HoCu_2$ and ErNi regenerator materials—the higher volumetric heat capacities and high ductilities.

The regenerator materials described hereabove were prepared as polycrystalline materials by arc-melting stoichiometric amounts of the component materials on a water cooled copper hearth under an argon atmosphere. The alloys generally were turned over six times although the ErIr alloy was turned over about 20 times and remelted to ensure a homogenous ingot. Weight losses after melting were negligible. The component metals used were purchased from various commercial sources. The rare earth metals were 95 to 98 atomic percent pure with the major impurities being O, C, and N while the non-rare earth metals were 99.9+ atomic percent pure. X-ray powder diffraction data were collected on an automated Scintag powder diffractometer using Cu $K_{alpha}$ radiation to check on phase purity and crystallography of samples. Regenerator components of the invention may include one or more of H, O, C, N, and/or B as interstitial elements in an individual or collective amount up to about 5 atomic % of the compound depending upon the starting component materials for melting. All of the samples were found to be single-phase materials within the limitations of the diffraction technique (typically 2 to 5 volume % of an impurity phase). Most of the intermetallic compound samples were not heat treated because they were single phase alloys after arc-melting. ErRh and ErAu, however, were heat treated (annealed) for 335 hours (2 weeks) at 900° C. and rapidly quenched to room temperature to retain the B2 crystal structure. The heat capacities at constant pressure were measured using an adiabatic heat-pulse-type calorimeter from approximately 3.5 to approximately 350K in zero magnetic field. The calorimeter is described in U.S. Pat. No. 5,806,979 and by Pecharsky et al. in "A 3-350 K Fast Automatic Small Sample Calorimeter", Rev. Sci. Instrum., vol. 68, pp. 4196-4207 (1997), which are incorporated herein by reference.

Figure 39A:
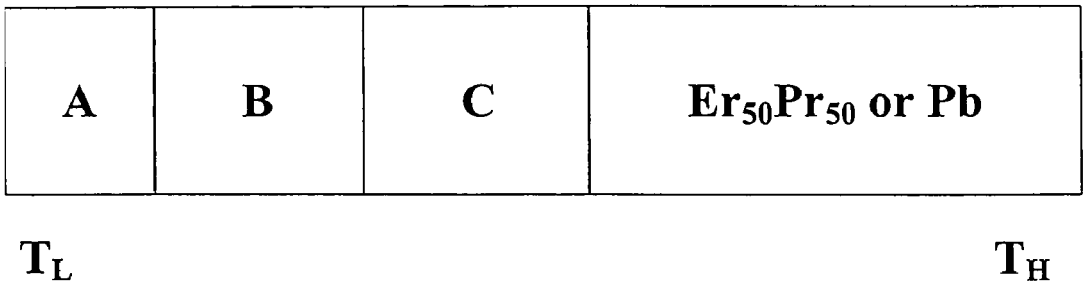
FIGS. 39*a*, 39*b*, and 39*c* are schematic representations of a layered cryocooler regenerator for the lowest temperature stage of a sub 20 K cryocooler, where $T_c$ is the lowest temperature and $T_H$ is the highest temperature; and A is the material with the lowest magnetic ordering temperature, B the material with the middle ordering temperature, and C the material with the highest magnetic ordering temperature for the 4 layered configuration (FIG. 39*a*). For the 3 layered arrangement A has the lowest and B has the highest magnetic ordering temperatures (FIG. 39*b*), while for the 2 layered configuration A has a magnetic ordering temperature less than 15 K (FIG. 39*c*).
Figure 39B:
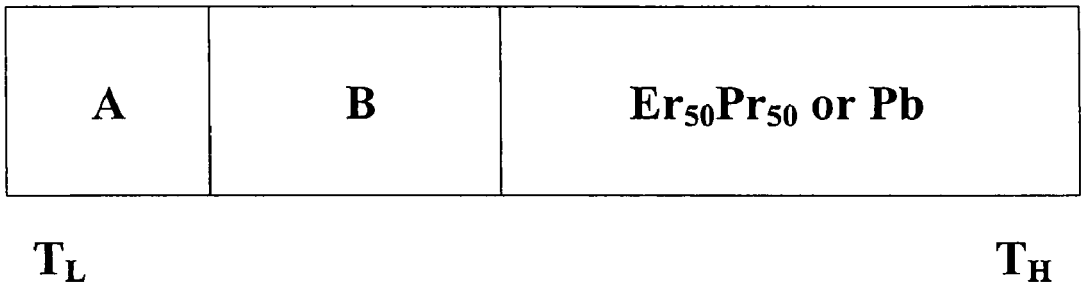
Figure 39C:
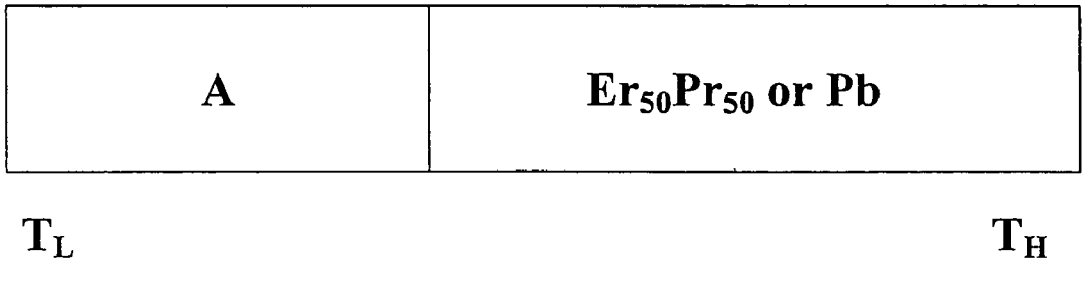

With the aid of FIGS. 39*a*, 39*b*, and 39*c*, which are schematic drawings of layered regenerator configurations, we will describe several possible combinations of materials to reach the desired low temperature. In these examples $T_H$ can vary from about 50 K to about 80 K depending on the amount of cooling obtained from the high temperature stage(s), while $T_L$ will generally vary from about 4 K to 10 K depending upon the intended application. At the RM B2 intermetallic compound—$Er_{50}Pr_{50}$ (or Pb) interface, the temperature is expected to be about 15 K. FIG. 39*a* is a four layered low temperature regenerator configuration consisting of three different RM materials A, B and C, but it is possible that only two (FIG. 39*b*) or even one (FIG. 39*c*) RM material(s) is (are) used on the low temperature side of the regenerator. In general the greatest efficiency will be realized when three different materials are used. Furthermore, it should be pointed out that the regenerator material does not need to be in the form of spheres, but could be in the form of parallel plates, screens, wires, etc. The choice of the form of the regenerator material will be left to the design engineer, and since all of the B2, CsCl-type materials described above can be fabricated into any of these forms by standard metallurgical process we are not concerned with this aspect of the regenerator construction.

Tables 1 through 5 list materials that have reasonably high volumetric heat capacities over certain temperature ranges. That is: for temperatures below 4 K see Table 1; for temperatures between 4 and 10 K (replacement for $HoCu_2$) see Table 2; for materials which have high heat capacities between $HoCu_2$ and ErNi peaks (6 to 9 K) see Table 3; for temperatures between 8 and 13 K (replacements for ErNi) see Table 4; and for temperatures between 11K and 17K, see Table 5.

Examples of some regenerator configurations for the low temperature stage for a high performance cryocooler to reach temperatures below 15 K are described below.

EXAMPLE 1

With FIG. 39*a* in mind, to reach 4K or lower, regenerator section A would consist of one of the materials listed in Table 1, regenerator section B would be a material given in Table 2, while one of the compounds given in Table 4 would be utilized in regenerator section C.

EXAMPLE 2

For a cryocooler to reach a temperature in the 4 to 9 K range using the layering sequence shown in FIG. 39*a*, regenerator section or layer A would be a material listed in Table 2, regenerator section or layer B a compound from Table 3, and regenerator section or layer C would be a compound presented in Table 4.

EXAMPLE 3

Another four layer sequence (FIG. 39*a*) which could be used to cool down to the 4 to 9 K region would consist of a material from Table 2 in section or layer A, a compound from Table 4 in section or layer B, and compound given Table 5 would be the C section or layer component.

EXAMPLE 4

An alternate 3 layer configuration to reach a temperature in the 4 to 9 K range is shown in FIG. 39*b*. In this set-up, section or layer A would consist of a material listed in Table 2 and section or layer B would contain a compound given in Table 4.

EXAMPLE 5

The utilization of a material given in Table 3 in section or layer A plus a compound presented in Table 4 as the section or layer B component in the three layer configuration (FIG. 39*b*) would enable one to reach a temperature in the 6 to 9 K.

EXAMPLE 6

A four layer cryocooler regenerator (FIG. 39*a*) which enables one to reach a temperature between 8 and 12 K would consist of an alloy from Table 3 as the section A material, a compound listed in Table 4 for section B and a compound given in Table 5 as section C.

EXAMPLE 7

Another four layer regenerator configuration (FIG. 39*a*) could be utilized to efficiently reach the 8 to 12 K temperature regime would consist of alloys from Tables 2, 4 and 5, as the materials for sections A, B and C, respectively.

EXAMPLE 8

An alternative solution to reach the 8 to 12 K temperature range is the utilization of a three layered regenerator configuration (FIG. 39*b*) in which a material from Table 2 is the section A component and a material from Table 4 is the section B component.

EXAMPLE 9

Another three layered arrangement (FIG. 39*b*) which would also enable one to efficiently cool to the 8 to 12 K range would be to use a compound from Table 3 as the section A material and an alloy from Table 4 as section B.

EXAMPLE 10

For a cryocooler to reach an ultimate low temperature of 12 to 16 K a three layered regenerator (FIG. 39*b*) would make use of a material from Table 4 and from Table 5 as the components for sections A and B, respectively.

EXAMPLE 11

The two layered regenerator configuration as shown in FIG. 39*c* would also enable one to reach the 12 to 16 K regime by utilizing a compound listed in Table 5 as the section A material.

EXAMPLE 12

An alternate material chosen from Table 4 as the section A component in a two layered regenerator (FIG. 39*c*) would also enable one to reach the 12 to 16 K regime.

The layers described above in the Examples may comprise different layers of spherical powder or other particles, or other forms of the materials.

The regenerator intermetallic compound may also include other metals or non-metals preferably selected from Li, B, C, Si, P, Ga, Ge, Mn, Fe and other metals or non-metals to modify a particular property of the regenerator component such that the compound retains the B2 (CsCl-type) ordered crystal structure as apparent below.

Tables 1, 2, 3, 4, and 5 illustrate intermetallic compounds of general types represented by RM, $Er(M_x,M'_{1-x})$ and $Tm(M_x,M'_{1-x})$ where M and M' represent one or more non-rare earth metals; $(Er_{1-x},R_x)M$ and $(Tm_{1-x},R_x)M$ where R represents one or more rare earth metals and M represents one or more non-rare earth metals; and $Er(M_x,M'_{1-x})$ and $Tm(M_x,M'_{1-x})$ where M and M' represent one or more non-rare earth metals.

TABLE 1

Regenerator Alloys for Temperatures below 4 K

| Composition | FIG. |
|---|---|
| ErRh | 15 |
| ErIr | 15 |
| $Tm(Cu_{0.95}Ni_{0.05})$ | 21, 22 |
| $Tm(Cu_{0.98}Ru_{0.02})$ | 23 |

TABLE 2

Regenerator Alloys for the 4-10 K Temperature Range

| Composition | FIG. |
|---|---|
| $Er(Cu_{0.85}Ni_{0.15})$ | 7b, 8 |
| TmCu | 16 |
| $Tm(Cu_{0.95}Al_{0.05})$ | 17, 18 |
| $Tm(Cu_{0.95}Ga_{0.05})$ | 17 |
| $Tm(Cu_{0.98}Fe_{0.02})$ | 19, 20 |
| $Tm(Cu_{0.98}Ni_{0.02})$ | 19 |
| $Tm(Cu_{0.90}Ag_{0.10})$ | 24 |
| $Tm(Cu_{0.80}Ag_{0.20})$ | 24 |
| $(Tm_{0.95}Lu_{0.05})Cu$ | 25, 26 |
| $(Tm_{0.95}Y_{0.05})Cu$ | 25, 28 |
| TmAg | 36 |

TABLE 3

Regenerator Alloys for the 6-9 K Temperature Range

| Composition | FIG. |
|---|---|
| $Er(Cu_{0.95}Mn_{0.05})$ | 5a |
| $Er(Cu_{0.95}Fe_{0.05})$ | 5a |
| $Er(Cu_{0.95}Ni_{0.05})$ | 5b |
| $Er(Cu_{0.98}Ru_{0.02})$ | 9, 10 |
| $(Er_{0.60}Tm_{0.40})Cu$ | 32 |
| $(Tm_{0.80}Er_{0.20})Cu$ | 31, 34 |
| $(Tm_{0.06}Er_{0.40})Cu$ | 31 |

TABLE 4

Regenerator Alloys for the 8-13 K Temperature Range

| Composition | FIG. |
|---|---|
| $(Tm_{0.20}Er_{0.80})Cu$ | 32, 35 |

TABLE 5

Regenerator Alloys for 11-17 K Temperature Range

| Composition | FIG. |
|---|---|
| $Er(Cu_{0.95}Al_{0.05})$ | 3, 4a |
| $Er(Cu_{0.95}Ga_{0.05})$ | 3, 4b |
| $Er(Cu_{0.95}Zn_{0.05})$ | 3 |
| $(Er_{0.90}Tm0_{.10})(Cu_{0.95}Al_{0.05})$ | 37 |
| $(Er_{0.80}Tm0_{.20})(Cu_{0.95}Ga_{0.05})$ | 38 |

REFERENCES CITED

U.S. PATENT DOCUMENTS

U.S. Pat. No. 5,124,215 * June 1992 Hashimoto . . . 428/611

U.S. Pat. No. 5,186,765 * February 1993 Arai et al. . . . 148/301

U.S. Pat. No. 5,269,854 * December 1993 Takahashi et al. . . . 148/301

U.S. Pat. No. 5,332,029 * July 1994 Tokai et al. . . . 165/4

U.S. Pat. No. 5,537,826 * July 1996 Gschneidner et al. . . . 62/6

U.S. Pat. No. 5,593,517 * January 1997 Saito et al. . . . 148/301

U.S. Pat. No. 6,003,320 * December 1999 Okamura et al. . . . 62/6

U.S. Pat. No. 6,022,486 * February 2000 Tokai et al. . . . 252/67

U.S. Pat. No. 6,318,090 * November 2001 Gschneidner et al. . . . 62/6

U.S. Ser. No. 60/425,964 * November 2002 Gschneidner et al.

OTHER PUBLICATIONS

"Cryogenic Regenerative Heat Exchangers", *Plenum Press*, New York, 1997, by R. A. Ackerman.

"Cryocoolers Part 1: Fundamentals", *Plenum Press*, New York, 1983, by G. Walker.

"Cryocooler Applications", *Cold Facts,* vol. 16, no. 1 (Winter 2000) by R. Radebaugh, pp. 1,6,7,8, 16,21,24-25.

"Low-power Cryocooler Survey", *Cryogenics*, vol. 42, (2002), by ter Brake and Wiegerinck, pp. 705-718.

"Extremely Large Heat Capacities between 4 and 10 K", *Cryogenics*, vol. 15, (1975), by Buschow et al., pp. 261-264.

"New Magnetic Material R3T System with Extremely Large Heat Capacities Used as Heat Regenerators", *Adv. Cryogenic Eng.*, vol. 35, (1990), by Sahashi et al., pp. 1175-1182.

"High Efficient Two-Stage GM Refrigerator with Magnetic Material in Liquid Helium Temperature Region", *Adv. Cryogenic Eng.*, vol. 35, (1990), by Kuriyama et al., pp. 1261-1269.

"A Gifford-McMahon Cycle Cryocooler below 2 K", *Cryocoolers* 11, R. G. Ross, Jr., editor, *Kluwer Academic/Plenum Publishers*, New York, (2001), by Satoh, et al., pp. 381 -386.

"New Regenerator Material for Sub-4K Cryocoolers", *Cryocoolers* 11, R. G. Ross, Jr., editor, *Kluwer Academic/Plenum Publishers*, New York, (2001), by Numazawa, et al., pp. 465-473.

"Competition Between Multi-q Antiferromagnetic Structures in Cubic Rare Earth-Copper Compounds", *J. Magn. Magn. Mater.*, vol. 21, (1980) by Morin and Schmidt, pp. 243-256.

"The Specific Heats of ErAg and TbAg Between 0.5 and 21 K", *J. Phys. F: Met. Phys.,* vol. 17, (1987) by R. W. Hill.

"Evaluation of Low-temperature Specific Heats and Thermal Conductivities of Er-Ag Alloys as Regenerator Materials", *Jpn. J. Appl. Phys.*, vol. 35, (1996) by Biwa et al., pp. 2244-2248.

"Studies of Low Temperature Specific Heats and Thermal Conductivities of CsCl-type $(Pr_{1-x}Nd_x)Ag$ $(0 \leqq x \leqq 1)$ Intermetallic Compounds: Application to Regenerator Materials", *Jpn. J. Appl. Phys.*, vol. 36, (1997) by Yagi et al., pp. 5638-5643.

"The Similar Dependence of the Magnetocaloric Effect and Magneto-resistance in TmCu and TmAg Compounds and Its Implications", *J. Phys: Condens. Matter*, vol. 13, (2001) by Rawat and Das, pp. L379-L387.

"Low Temperature Cryocooler Regenerator Materials", *Cryocoolers* 12, R. G. Ross, Jr., editor, *Kluwer Academic/Plenum Publishers*, New York, (2003), by Gschneidner, et al., pp. 457-465.

"Effect of Interstitial Impurities on Magnetic Transitions of Er-rich $Pr_xEr_{1-x}$ Alloys", *J. Solid State Chem.*, vol. 171, (2003) by Gschneidner, et al., pp. 324-328.

What is claimed is:

1. A cryocooler magnetic regenerator, comprising one or more regenerator components comprising a ductile intermetallic compound including one or more rare earth elements and one or more non-rare earth metals wherein the ductile intermetallic compound comprises a CsCl crystal structure and wherein the one or more non-rare earth metals is/are so selected from Cu, Ag, or Au, or combinations thereof that the intermetallic compound is ductile whereby the compound is resistant to attrition in service in the regenerator.

2. The regenerator of claim 1 wherein the one or more rare earth elements is/are selected from Sc, Y, La, Ce, Pr, Nd, Pm, Sm, Eu, Gd, Tb, Dy, Ho, Er, Tm, Yb, or Lu or combinations thereof.

3. The regenerator of claim 1 wherein the one or more non-rare earth metals further includes Al, Ni, Ga, In, Mg, Co, Fe, Mn, Zn, Ru, Pd, Cd, Ir, Pt, Hg, or Tl or combinations thereof as a minority non-rare metal substitute.

4. The regenerator of claim 1 wherein the one or more regenerator components is/are selected from a ductile particle layer, a ductile plate, a ductile sheet, a ductile wire or a ductile screen.

5. The regenerator of claim 1 wherein said intermetallic compound is a binary alloy, ternary alloy or quaternary alloy including said one or more rare earth elements and said one or more non-rare earth elements so selected that the intermetallic compound is ductile.

6. The regenerator of claim 1 wherein the intermetallic compound comprises at least one of ErM where M represents one or more of the non-rare earth metals and TmN where M represents one or more of the non-rare earth metals so selected that the intermetallic compound is ductile.

7. The regenerator of claim 1 where the intermetallic compound comprises at least one of $(Er_{1-x}, R_x)M$ where R represents one or more rare earth metals other than Er and M represents one or more non-rare earth metals and $(Tm_{1-x}, R_x)M$ where R represents one or more rare earth metals other than Tm and M represents one or more non-rare earth metals so selected that the intermetallic compound is ductile.

8. The regenerator of claim 1 where the intermetallic compound includes at least one of $Er(M_x,M'_{1-x})$ and $Tm(M_x, M'_{1-x})$ where M and M' represent one or more different non-rare earth metals so selected that the intermetallic compound is ductile.

9. The regenerator of claim 1 where the compound includes at least one of $(Er_{1-x}, R_x)$ $(M_x,M'_{1-x})$ and $(Tm_{1-x},R_x)$ $(M_x, M'_{1-x})$ where R represents one or more rare earth metals other than Er and M and M' represent one or more different non-rare earth metals so selected that the intermetallic compound is ductile.

10. The regenerator of claim 1 wherein the compound is selected from one or more of $(Tm_{0.95}Lu_{0.05})Cu$, $(Tm_{0.6}Er_{0.4})Cu$, $(Tm_{0.2}Er_{0.8})Cu$, $(Tm_{0.8}Er_{0.2})Cu$, $(Tm_{0.95}Y_{0.05})Cu$, $Tm(Cu_{0.95}Al_{0.05})$, $Tm(Cu_{0.95}Ga_{0.05})$, $Tm(Cu_{0.98}Fe_{0.02})$, $Tm(Cu_{0.95}Ni_{0.05})$, $Tm(Cu_{0.98}Ni_{0.02})$, $Tm(Cu_{0.98}Ru_{0.02})$, $Tm(Cu_{0.85}Ni_{0.15})$, $Tm(Cu_{0.90}Ag_{0.10})$, $Tm(Cu_{0.80}Ag_{0.20})$, $(Er_{0.6}Tm_{0.4})Cu$, $Er(Cu_{0.85}Ni_{0.15})$, $Er(Cu_{0.95}Ni_{0.05})$, $Er(Cu_{0.95}\ Mn_{0.05})$, $Er(Cu_{0.95}Fe_{0.05})$, $Er(Cu_{0.98}Ru_{0.02})$, $Er(Cu_{0.95}Al_{0.05})$, $Er(Cu_{0.95}Zn_{0.05})$, $Er(Cu_{0.95}Ga_{0.05})$, $(Er_{0.90}Tm_{0.10})(Cu_{0.95}Al_{0.05})$, or $(Er_{0.80}Tm_{0.20})(Cu_{0.95}Ga_{0.05})$.

11. A multi-stage cryocooler having a relatively low temperature stage to cool to less than about 15K, comprising a magnetic regenerator including a ductile intermetallic compound including one or more rare earth elements and one or more non-rare earth metals wherein the ductile intermetallic compound comprises a CsCl crystal structure and wherein the one or more non-rare earth metals is/are so selected from Cu, Ag, or Au, or combinations thereof that the intermetallic compound is ductile whereby the compound is resistant to attrition in service in the regenerator.

12. The cryocooler of claim 11 where the intermetallic compound includes at least one of ErM and TmM where M represents one or more of the non-rare earth metals so selected that the intermetallic compound is ductile.

13. The cryocooler of claim 11 where the intermetallic compound includes at least one of $(Er_{1-x}, R_x)M$ and $(Tm_{1-x}, R_x)M$ where R represents one or more rare earth metals other than Er or Tm, respectively, and M represents one or more non-rare earth metals so selected that the intermetallic compound is ductile.

14. The cryocooler of claim 11 where the intermetallic compound includes at least one of $Er(M_x,M'_{1-x})$ and $Tm(M_x, M'_{1-x})$ where M and M' represent one or more different non-rare earth metals so selected that the intermetallic compound is ductile.

15. The cryocooler of claim 11 where the intermetallic compound includes at least one of $(Er_{1-x}, R_x)$ $(M_x,M'_{1-x})$ and $(Tm_{1-x},R_x)(M_x,M'_{1-x})$ where R represents one or more rare earth metals and M and M' represent one or more different non-rare earth metals so selected that the intermetallic compound is ductile.

16. The regenerator of claim 11 wherein the compound is selected from one or more of $(Tm_{0.95}Lu_{0.05})Cu$, $(Tm_{0.6}Er_{0.4})Cu$, $(Tm_{0.2}Er_{0.8})Cu$, $(Tm_{0.8}Er_{0.2})Cu$, $(Tm_{0.95}Y_{0.05})Cu$, $Tm(Cu_{0.95}Al_{0.05})$, $Tm(Cu_{0.95}Ga_{0.05})$, $Tm(Cu_{0.98}Fe_{0.02})$, $Tm(Cu_{0.95}Ni_{0.05})$, $Tm(Cu_{0.98}Ni_{0.02})$, $Tm(Cu_{0.98}Ru_{0.02})$, $Tm(Cu_{0.85}Ni_{0.15})$, $Tm(Cu_{0.90}Ag_{0.10})$, $Tm(Cu_{0.80}Ag_{0.20})$, $(Er_{0.6}Tm_{0.4})Cu$, $Er(Cu_{0.85}Ni_{0.15})$, $Er(Cu_{0.95}Ni_{0.05})$, $Er(Cu_{0.95}\ Mn_{0.05})$, $Er(Cu_{0.95}Fe_{0.05})$, $Er(Cu_{0.98}Ru_{0.02})$, $Er(Cu_{0.95}Al_{0.05})$, $Er(Cu_{0.95}Zn_{0.05})$, $Er(Cu_{0.95}Ga_{0.05})$, $(Er_{0.90}Tm_{0.10})(Cu_{0.95}Al_{0.05})$, or $(Er_{0.80}Tm_{0.20})(Cu_{0.95}Ga_{0.05})$.

17. In a method of cooling using a magnetic regenerator, the improvement comprising using a magnetic regenerator comprising one or more regenerator components comprising a ductile intermetallic compound including one or more rare earth elements and one or more non-rare earth metals wherein the ductile intermetallic compound comprises a CsCl crystal structure and wherein the one or more non-rare earth metals is/are so selected from Cu, Ag, or Au, or combinations thereof that the intermetallic compound is ductile whereby the compound is resistant to attrition in service in the regenerator.

18. In a method of cooling using a cryocooler, the improvement comprising using a cryocooler of claim 11.

* * * * *